US009370934B2

(12) United States Patent
Asauchi et al.

(10) Patent No.: US 9,370,934 B2
(45) **Date of Patent: *Jun. 21, 2016**

(54) PRINTING APPARATUS, PRINTING MATERIAL CARTRIDGE, ADAPTOR FOR PRINTING MATERIAL CONTAINER, AND CIRCUIT BOARD

(71) Applicant: SEIKO EPSON CORPORATION, Tokyo (JP)

(72) Inventors: Noboru Asauchi, Nagano-ken (JP); Shuichi Nakano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

This patent is subject to a terminal disclaimer.

(21) Appl. No.: 14/319,609

(22) Filed: Jun. 30, 2014

(65) Prior Publication Data

US 2014/0307031 A1 Oct. 16, 2014

Related U.S. Application Data

(62) Division of application No. 13/221,181, filed on Aug. 30, 2011, now Pat. No. 8,764,172.

(30) Foreign Application Priority Data

Sep. 3, 2010 (JP) ..... 2010-197316

(51) Int. Cl.
*B41J 2/175* (2006.01)
*G03G 15/08* (2006.01)

(52) U.S. Cl.
CPC ..... *B41J 2/17526* (2013.01); *B41J 2/1752* (2013.01); *B41J 2/1753* (2013.01);

(Continued)

(58) Field of Classification Search
CPC ..... B41J 2/17526
See application file for complete search history.

(56) References Cited

U.S. PATENT DOCUMENTS 5,138,344 A 8/1992 Ujita
8,678,541 B2 * 3/2014 Uchiyama ..... 347/19

(Continued)

FOREIGN PATENT DOCUMENTS

CN 1990255 A1 7/2007
CN 100373163 C 3/2008

(Continued)

OTHER PUBLICATIONS

Examination Report issued on Mar. 28, 2013 in corresponding Canadian Patent Application No. 2,768,790.

(Continued)

*Primary Examiner* — Stephen Meier
*Assistant Examiner* — John P Zimmermann
(74) *Attorney, Agent, or Firm* — Stroock & Stroock & Lavan LLP

(57) ABSTRACT

A printing material cartridge comprises: a memory device; a plurality of first terminals through which a power source voltage and signals for operating the memory device are supplied from a printing apparatus; and a plurality of second terminals to be used for detecting attachment conditions of the printing material cartridge in a cartridge attachment unit. The plurality of first terminals have a plurality of first contact portions that get in contact with corresponding apparatus-side terminals when the printing material container is properly attached to the cartridge attachment unit. The plurality of second terminals have a plurality of second contact portions that get in contact with corresponding apparatus-side terminals when the printing material container is properly attached to the cartridge attachment unit. The plurality of first and second contact portions are arranged so as to form a first row and a second row. Four contact portions among the plurality of second contact portions are placed at both ends of the first and second rows, respectively.

11 Claims, 58 Drawing Sheets

(52) U.S. Cl.
CPC ..... *B41J2/17513* (2013.01); *B41J 2/17546* (2013.01); *B41J 2/17553* (2013.01); *G03G 15/0863* (2013.01)

(56) References Cited

U.S. PATENT DOCUMENTS

| | | | | |
|---|---|---|---|---|
| 2002/0112878 | A1 | 8/2002 | Ishizawa et al. | |
| 2003/0002080 | A1 | 1/2003 | Asauchi | |
| 2006/0238558 | A1 | 10/2006 | Hatasa et al. | |
| 2007/0002087 | A1* | 1/2007 | Matsui et al. | 347/9 |
| 2007/0092270 | A1 | 4/2007 | Inukai | |
| 2007/0126770 | A1 | 6/2007 | Asauchi | |
| 2007/0149044 | A1 | 6/2007 | Asauchi | |
| 2008/0259135 | A1 | 10/2008 | Asauchi et al. | |
| 2009/0085939 | A1 | 4/2009 | Asauchi | |
| 2009/0237439 | A1 | 9/2009 | Ishizawa et al. | |
| 2009/0262161 | A1 | 10/2009 | Nishihara | |
| 2010/0259579 | A1 | 10/2010 | Wu | |
| 2010/0289847 | A1 | 11/2010 | Ishizawa et al. | |

FOREIGN PATENT DOCUMENTS

| | | | |
|---|---|---|---|
| CN | 101486272 | A | 7/2009 |
| EP | 0440261 | A2 | 8/1991 |
| EP | 1800872 | A1 | 6/2007 |
| JP | 03-284953 | A | 12/1991 |
| JP | 06-155758 | A | 6/1994 |
| JP | 06-262771 | A | 9/1994 |
| JP | 2002-198627 | A | 7/2002 |
| JP | 2002-273900 | A | 9/2002 |
| JP | 2003-300333 | A | 10/2003 |
| JP | 2005-007893 | A | 1/2005 |
| JP | 2005-119228 | A | 5/2005 |
| JP | 2005-326779 | A | 11/2005 |
| JP | 2006-297826 | A | 11/2006 |
| JP | 2007-121551 | A | 5/2007 |
| JP | 2007-168078 | A | 5/2007 |
| JP | 2007-196664 | A | 8/2007 |
| JP | 2009-241591 | A | 10/2009 |
| JP | 2009-274438 | A | 11/2009 |
| WO | 02/40275 | A1 | 5/2002 |
| WO | 2006/025575 | A1 | 3/2006 |
| WO | 2006/025578 | A1 | 3/2006 |
| WO | 2007/077747 | A1 | 7/2007 |
| WO | 2010/131480 | A1 | 11/2010 |

OTHER PUBLICATIONS

International Search Report issued in PCT/JP2011/004882 dated Oct. 11, 2011.

* cited by examiner $$I_{DET} = \frac{VHV}{R_c} \qquad R_c = R\frac{1}{\sum_{j=1}^{N}\frac{1}{2^j}}$$

$$V_{DET} = VHV \frac{R}{R + R_c} \qquad R_c = R \frac{1}{\sum_{j=1}^{N} \frac{1}{2^j}}$$

PRINTING APPARATUS, PRINTING MATERIAL CARTRIDGE, ADAPTOR FOR PRINTING MATERIAL CONTAINER, AND CIRCUIT BOARD

CROSS-REFERENCE TO RELATED APPLICATIONS

The present application is a divisional of U.S. patent application Ser. No. 13/221,181, filed on Aug. 30, 2011, which claims the priority based on Japanese Patent Application No. 2010-197316 filed on Sep. 3, 2010, the disclosure of which is hereby incorporated by reference in its entirety.

BACKGROUND

1. Technical Field

This invention relates to a printing apparatus, a printing material cartridge used for the printing apparatus, an adaptor for a printing material container, and circuit boards for these components.

2. Related Art

In recent years, a cartridge equipped with a memory device that stores information pertaining to printing materials (such as the amount of remaining ink) is used as a printing material cartridge. Also, a technology to detect attachment conditions of the printing material cartridges has been used. For example, in JP-A-2009-274438, attachment conditions of cartridges are detected by sending signals different from those for detecting the amount of remaining ink to the remaining ink sensor installed in the ink cartridge. In conventional technologies, attachment conditions have been commonly detected by the use of one or two of many terminals on the cartridge.

However, even if the proper attachment of the cartridge is detected, some other terminals not used for the detection of attachment conditions may sometimes be in poor contact with the terminals of the printing apparatus. Especially when the terminals for a memory device are in poor contact, a problem arises that errors tend to occur when data are written and read to and from the memory device.

Meanwhile, known technologies for detecting attachment conditions of ink cartridges include those described in JP-A-2002-198627 and JP-A-2009-241591. According to these documents, the attachment detection terminal on the cartridge side is grounded, while the attachment detection terminal on the printing apparatus side is pulled up to a power supply voltage via a resistance. If the attachment detection terminal on the cartridge side is in good contact with that on the printing apparatus side, the terminal on the printing apparatus side bears a ground voltage, whereas it is applied with a power supply voltage in case of non-contact. Therefore, attachment of the cartridge can be detected by monitoring the voltage of the attachment detection terminal on the printing apparatus side. Detection of cartridge attachment is also possible in a way opposite to that mentioned above, that is, by connecting the attachment detection terminal on the cartridge side to the power supply voltage, and at the same time, pulling down the attachment detection terminal on the printing apparatus side via a resistance. In general, cartridge attachment can be detected by connecting the attachment detection terminal on the cartridge side to a first fixed voltage, and connecting the attachment detection terminal on the printing apparatus side to a second fixed voltage via a resistance. However, keeping the voltage of the attachment detection terminal on the cartridge side constant may cause another problem. For example, in a configuration where the attachment detection terminal on the cartridge side is grounded, if the attachment detection terminal on the printing apparatus side bears a ground voltage from any cause, the system may erroneously identify a non-attached cartridge as attached. This would cause a problem of less reliability of attachment detection. Also, in a configuration where the attachment detection terminal on the cartridge side is grounded, if a high voltage (e.g. voltage for operating a print head) is mistakenly applied to the attachment detection terminal, a problem may arise that a large current flows through the attachment detection terminal to inflict damages to the circuitry of the cartridge or the printing apparatus.

In addition, on a circuit board installed on a cartridge, increased number of terminals or contact portions means a higher risk of poor contact at one or more of them. Therefore, there has been a desire to reduce the number of terminals and contact portions as much as possible.

The various problems mentioned above are not limited to ink cartridges but also applicable to printing material cartridges containing other types of printing materials (e.g. tonner). Moreover, the same problem existed with liquid injection devices that inject different types of liquid other than the above printing materials and liquid containers (liquid storages) thereof. In addition, there have been similar problems with the detection of connection conditions between the circuit board terminals used for printing cartridges or liquid containers and the corresponding terminals on the apparatus side.

An object of the present invention is to provide a technology that properly checks attachment conditions of cartridges or their circuit boards. A second object of this invention is to provide a technology to properly evaluate whether the contact between terminals of a memory device for the cartridge or those of the circuit board and the corresponding apparatus-side terminals is enough or not. A third object of this invention is to provide a technology to perform attachment detection without keeping the attachment detection terminals of a cartridge or a circuit board for a cartridge at a fixed voltage. This invention does not need to have a configuration that achieves all of the above objects, and may be implemented in a way in which to have a configuration that achieves one of the above objects or other effects described later.

SUMMARY (1) According to an aspect of the invention, there is provided a circuit board electrically connectable to a plurality of apparatus-side terminals of a cartridge attachment unit of a printing apparatus. The circuit board comprises: a memory device; a plurality of first terminals through which a power source voltage and signals for operating the memory device are supplied from the printing apparatus; and a plurality of second terminals to be used for detecting connection conditions between the plurality of apparatus-side terminals and the circuit board. The plurality of first terminals have a plurality of first contact portions that get in contact with corresponding apparatus-side terminals. The plurality of second terminals have a plurality of second contact portions that get in contact with corresponding apparatus-side terminals. The plurality of first and second contact portions are arranged so as to form a first row and a second row. Four contact portions among the plurality of second contact portions are placed at both ends of the first and second rows, respectively. According to this configuration, connection conditions or attachment conditions of the circuit board may be properly judged because four contact portions for the detection of the connection conditions of the circuit board are placed at both ends of the first and second rows.

(2) As to the circuit board, the plurality of first contact portions may be placed within a first area. The four contact portions among the plurality of second contact portions may be placed outside the first area and are arranged at positions corresponding to four corners of a second area of a quadrangular shape encompassing the first area. The second area may have a trapezoid shape having a first base corresponding to the first row shorter than a second base corresponding to the second row. According to this configuration, since four second contact portions are placed at both ends of the first bottom base and the second bottom base of the second area of a trapezoidal shape, it is possible to reduce the severity of the problem, as opposed to the situation where the second area is of a rectangular shape, that the contact condition at the second contact portions is poor even if the contact conditions at the plurality of first contact portions are good, when the circuit board is tilted from the normal position.

(3) As to the circuit board, among the four contact portions of the plurality of second contact portions, two contact portions placed at both ends of the first row may be connected with each other and neither of them are connected to a fixed voltage, and two contact portions placed at both ends of the second row may be connectable to an electric device. According to this configuration, it is possible to use two contact portions placed at both ends of the second row for both contact detection and sending/receiving of signals to and from the electric device. Also, since neither of two contact portions placed at both ends of the first row is connected at a fixed voltage, it is possible to prevent a problem that if they are grounded, for example, a terminal of the circuit board of poor contact is misjudged to be in a good contact when the terminal on the printing apparatus side bears a ground voltage from any cause. Also, when a high voltage (e.g. voltage for driving a print head) is erroneously applied to the contact portions for connection detection, it is possible to prevent a problem of having a large current flow through the contact portions to damage the circuitry of the circuit board or the printing apparatus.

(4) As to the circuit board, a contact portion of a ground terminal for the memory device may be placed at the center of the second row. According to this configuration, it is possible to prevent the plurality of second contact portions from being connected to a ground terminal due to foreign matters such as dirt or dust.

(5) As to the circuit board, during detection of connection conditions between the plurality of apparatus-side terminals and the circuit board, a voltage which is no higher than a first power supply voltage supplied to a power terminal for the memory device may be applied to the two contact portions at both ends of the first row, and a voltage which is no higher than a second power supply voltage for driving a print head of the printing apparatus and higher than the first power supply voltage may be applied to the two contact portions at both ends of the second row. According to this configuration, since detection of connection conditions is performed with a lower voltage at two contact portions at both ends of the first row than at two contact portions at both ends of the second row, time required for charging the wiring can be reduced compared to the case of detecting with a higher voltage, thus completing the detection in shorter time. Also, since detection of connection conditions is performed with a higher voltage at two contact portions at both ends of the second row than at those at both ends of the first row, it is possible to enhance the detection accuracy compared to the case of detecting with a lower voltage.

(6) As to the circuit board, during detection of connection conditions between the plurality of apparatus-side terminals and the circuit board, a first attachment inspection signal is inputted, as a first pulse signal, to one of the two contact portions at both ends of the first row, and a first attachment response signal may be outputted from the other of the two contact portions in response to the first attachment inspection signal, and a first voltage no more than the second power supply voltage and higher than the first power supply voltage may be applied to one of the two contact portions at both ends of the second row, and a voltage lower than the first voltage and higher than the first power supply voltage is outputted from the other of the two contact portions at both ends of the row. According to this configuration, two contact portions at both ends of the first row are used for attachment detection (contact detection) as a first pair, whereas two contact portions at both ends of the second row are used for the same as a second pair. Therefore, it is possible to perform attachment detection (contact detection) without providing extra contact portions other than those four contact portions, thus reducing the number of contact portions on the circuit board.

(7) As to the circuit board, the two contact portions at both ends of the first row may be also used for detecting an overvoltage applied to the two contact portions at both ends of the first row, and a high level voltage of the first attachment inspection signal may be set lower than the overvoltage. According to this configuration, since two contact portions at both ends of the first row can be used for both contact detection and overvoltage detection, it is possible to reduce the number of contact portions on the circuit board. Also, since the high level voltage of the first attachment detection signal is set at a lower voltage than the overvoltage, it is possible to prevent a problem of misjudging it as overvoltage in the process of attachment detection (contact detection).

(8) As to the circuit board, two contact portions placed at both ends of the second row may be connectable to an electric device, and the electric device may be a resistance element installed in the circuit board. According to this configuration, it is possible to evaluate in high precision whether the circuit boards are properly installed by measuring the current or voltage corresponding to the voltage applied to the contact portions at both ends of the second row.

(9) As to the circuit board, during detection of connection conditions between the plurality of apparatus-side terminals and the circuit board, a first attachment inspection signal may be inputted, as a first pulse signal, to one of the two contact portions at both ends of the first row, and a first attachment response signal may be outputted from the other of the two contact portions in response to the first attachment inspection signal; and a second attachment inspection signal may be inputted, as a second pulse signal, to one of the two contact portions at both ends of the second row, and a second attachment response signal may be outputted from the other of the two contact portions in response to the second attachment inspection signal. According to this configuration, contact portions at both ends of the first row are used for attachment detection (contact detection) as a first pair, while those at both ends of the second row are used for the same as a second pair. This makes it possible to perform attachment detection (or contact detection) without providing extra contact portions other than the above four. Also, according to this configuration, since the attachment detection (or contact detection) pertaining to the first and second pairs is performed by the use of the first and second attachment inspection signals that are different from each other, it is always possible to evaluate properly which pair of contact portions are in poor attachment (or contact) conditions.

(10) As to the circuit board, a rise timing of the second attachment inspection signal from a low to a high level may be different from a rise timing of the first attachment inspection signal from a low to a high level. According to this configuration, since the rise timings of the first and second attachment inspection signals are different from each other, it is always possible to evaluate properly which of the first and second pairs of contact portions are in poor attachment (or contact) conditions.

(11) As to the circuit board, the two contact portions at both ends of the first row may be also used for detecting an overvoltage applied to the two contact portions at both ends of the first row, and a high level voltage of the first attachment inspection signal may be set lower than the overvoltage. According to this configuration, since two contact portions at both ends of the first row can be used for detecting both contact conditions and overvoltage, it is possible to reduce the number of contact portions on the circuit board. Also, the high level voltage of the first attachment inspection signal is set at a lower voltage than the overvoltage, which prevents the condition from being misjudged as overvoltage in the process of attachment (or contact) detection.

(12) As to the circuit board, two contact portions placed at both ends of the second row may be connectable to an electric device, and the electric device may be a sensor to be used for detecting a remaining amount of printing material within a printing material cartridge attached to the cartridge attachment unit. According to this configuration, since two contact portions at both ends of the second row can be used for detecting both contact conditions and the remaining amount of the printing material, it is possible to reduce the number of contact portions on the circuit board.

(13) As to the circuit boar, the plurality of first terminals may include a ground terminal for supplying a ground voltage from the printing apparatus to the memory device, a power supply terminal for supplying power at a different voltage than the ground voltage from the printing apparatus to the memory device, a clock terminal for supplying clock signals from the printing apparatus to the memory device, a reset terminal for supplying reset signals from the printing apparatus to the memory device, and a data terminal for supplying data signals from the printing apparatus to the memory device. Two of the first contact portions may be placed in the first row, and three of the first contact portions are placed in the second row. According to this configuration, it is possible to surely detect contact conditions at the contact portion of each terminal for the memory device, whether they are good or poor, by the four contact portions surrounding them.

(14) As to the circuit board, a distance between two contact portions which are placed at both ends among the first and second contact portions existing in the first row may be longer than a distance between two contact portions which are placed at both ends among the first contact portions existing in the second row.

(15) As to the circuit board, the circuit board may be to be attached to a cartridge attachment unit of the printing apparatus that comprises a print head and the cartridge attachment unit.

(16) According to another aspect of the invention, there is provided a printing material cartridge attachable to a cartridge attachment unit of a printing apparatus having a plurality of apparatus-side terminals. The printing material cartridge comprises: a memory device; a plurality of first terminals through which a power source voltage and signals for operating the memory device are supplied from the printing apparatus; and a plurality of second terminals to be used for detecting attachment conditions of the printing material cartridge in the cartridge attachment unit. The plurality of first terminals have a plurality of first contact portions that get in contact with corresponding apparatus-side terminals when the printing material container is properly attached to the cartridge attachment unit. The plurality of second terminals have a plurality of second contact portions that get in contact with corresponding apparatus-side terminals when the printing material container is properly attached to the cartridge attachment unit. The plurality of first and second contact portions are arranged so as to form a first row and a second row. Four contact portions among the plurality of second contact portions are placed at both ends of the first and second rows, respectively. According to this configuration, attachment conditions of the printing material container may be properly judged because four contact portions of the plurality of second terminals are placed at both ends of the first and second rows.

(17) According to an aspect of the invention, there is provided a printing material container adapter to which a printing material container is to be attached, the adapter being attachable to a cartridge attachment unit of a printing apparatus having a plurality of apparatus-side terminals. The adapter comprises: a memory device; a plurality of first terminals through which a power source voltage and signals for operating the memory device are supplied from the printing apparatus; and a plurality of second terminals to be used for detecting attachment conditions of the printing material container adapter in the cartridge attachment unit. The plurality of first terminals have a plurality of first contact portions that get in contact with corresponding apparatus-side terminals when the printing material container adapter is properly attached to the cartridge attachment unit. The plurality of second terminals have a plurality of second contact portions that get in contact with corresponding apparatus-side terminals when the printing material container adapter is properly attached to the cartridge attachment unit. The plurality of first and second contact portions are arranged so as to form a first row and a second row. Four contact portions among the plurality of second contact portions are placed at both ends of the first and second rows, respectively. According to this configuration, attachment conditions of the printing material container adapter may be properly judged because four contact portions of the plurality of second terminals are placed at both ends of the first and second rows.

(18) According to still another aspect of the invention, there is provided a printing apparatus. The printing apparatus comprises: a cartridge attachment unit to which a printing material cartridge is attached; a printing material cartridge attachable to the cartridge attachment unit; an attachment detection circuit for detecting attachment conditions of the printing material cartridge; and apparatus-side terminals. The printing material cartridge comprises: a memory device; a plurality of first terminals through which a power source voltage and signals for operating the memory device are supplied from the printing apparatus; and a plurality of second terminals to be used for detecting attachment conditions of the printing material cartridge in the cartridge attachment unit. The plurality of first terminals have a plurality of first contact portions that get in contact with corresponding apparatus-side terminals when the printing material container is properly attached to the cartridge attachment unit. The plurality of second terminals have a plurality of second contact portions that get in contact with corresponding apparatus-side terminals when the printing material container is properly attached to the cartridge attachment unit. The plurality of first and second contact portions are arranged so as to form a first row and a second row. Four contact portions among the plurality of second contact portions are placed at both ends of the first and second rows, respectively. According to this configuration, attachment conditions of the printing material container may be properly judged because four contact portions of the plurality of second terminals are placed at both ends of the first and second rows.

(19) In the above printing apparatus, N pieces of printing material cartridges may be attachable to the cartridge attachment unit where N is an integer no less than 2. Two contact portions placed at both ends of the first row in respective ones of the N pieces of printing material cartridges may be connected in series according to an arrangement order of the N pieces of printing material cartridges in the cartridge attachment unit via plural device-side terminals installed in the cartridge attachment unit so as to form a wiring route, and both ends of the wiring route is connected to the attachment detection circuit. Two contact portions placed at both ends of the second row in respective ones of the N pieces of printing material cartridges may be connected individually to the attachment detection circuit per each printing material cartridge. The attachment detection circuit may judge: (i) whether all the N pieces of printing material cartridges are attached to the cartridge attachment unit by detecting connection conditions of the wiring route, and (ii) whether individual printing material cartridges are attached by detecting connection conditions of the two contact portions placed at both ends of the second row in each printing material cartridge. According to this configuration, the first attachment detection process using the two contact portions at both ends of the first row and the second attachment detection process using the two contact portions at both ends of the second row may be respectively performed. Thus, if the proper attachment conditions are confirmed by these two kinds of attachment detection processes, it is confirmed that the memory device terminals for each cartridge are also in good contact conditions.

This invention may also be realized as the following application examples.

Application Example 1

A printing material cartridge attachable to a cartridge attachment unit having a plurality of apparatus-side terminals of a printing apparatus, comprising: a memory device, a plurality of first terminals connected to the memory device, and a plurality of second terminals to be used for detecting attachment conditions of the printing material cartridge in the cartridge attachment unit; the plurality of first terminals have respective first contact portions that get in contact with corresponding apparatus-side terminals when the printing material cartridge is properly attached to the cartridge attachment unit; the plurality of second terminals have respective second contact portions that get in contact with corresponding apparatus-side terminals when the printing material cartridge is properly attached to the cartridge attachment unit; the first contact portions are arranged within a first area, the second contact portions are arranged outside the first area; and the second contact portions include four contact portions located at four corners of a quadrangular second area encompassing the first area.

According to this configuration, all the first terminals connected to the memory device may be confirmed to be in good contact with the corresponding apparatus-side terminals by checking the contact conditions between the plurality of second contact portions, which are used for detecting attachment conditions of the printing material cartridges, and the corresponding apparatus-side terminals.

Application Example 2

The printing material cartridge described in Application example 1, wherein the first and second contact portions are arranged so as to form a first row and a second row, and the four contact portions among the second contact portions are arranged at both ends of the first row and second row respectively.

According to this configuration, attachment conditions of the printing material cartridge may be checked properly because the second contact portions for detecting attachment conditions are provided at both ends of the first row and the second row.

Application Example 3

The printing material cartridge described in Application example 2, wherein among the four contact portions of the second contact portions, two contact portions arranged at both ends of the first row are connected with each other via wiring, and an electric device installed in the printing material cartridge is connected between the two contact portions arranged at both ends of the second row.

According to this configuration, the two contact portions placed on both ends of the second row may be used for both detecting the attachment conditions and for sending and receiving signals to and from the electric device.

Application Example 4

The printing material cartridge described in Application example 3, wherein, the electric device is a sensor used for detecting a remaining amount of the printing material within the printing material cartridge.

Application Example 5

The printing material cartridge described in Application example 3, wherein, the electric device is a resistance element.

Application Example 6

The printing material cartridge described in one of Application examples 2-5, wherein the printing apparatus further comprises a print head for discharging printing material, and the two contact portions arranged at both ends of the first row are supplied with a same voltage as a first power voltage for driving the memory device or a voltage generated from the first power voltage, and the two contact portions arranged at both ends of the second row are supplied with a same voltage as a second power voltage for driving the print head or a voltage generated from the second power voltage.

According to this configuration, there is no need for providing a special power source to detect attachment conditions because the attachment detection is possible by the use of the first power-supply voltage for driving the memory device and the second power-supply voltage for driving the print head.

Application Example 7

An adaptor for a printing material container attachable to a cartridge attachment unit having a plurality of apparatus-side terminals of a printing apparatus, comprising: a memory device, a plurality of first terminals connected to the memory device, and a plurality of second terminals to be used for detecting attachment conditions of the adaptor in the cartridge attachment unit; the plurality of first terminals have respective first contact portions that get in contact with corresponding apparatus-side terminals when the adaptor is properly attached to the cartridge attachment unit; the plurality of second terminals have respective second contact portions that get in contact with corresponding apparatus-side terminals when the adaptor is properly attached to the cartridge attachment unit; the first contact portions are arranged within a first area; the second contact portions are arranged outside the first area; and the second contact portions include four contact portions located at four corners of a quadrangular second area encompassing the first area.

According to this configuration, all the first terminals connected to the memory device may be confirmed to be in good contact with the corresponding apparatus-side terminals by checking the contact conditions between the plurality of second contact portions, which are used for detecting attachment conditions of the adaptor, and the corresponding apparatus-side terminals.

Application Example 8

A circuit board electrically connectable to a plurality of apparatus-side terminals in a cartridge attachment unit of a printing apparatus, comprising: a memory device, a plurality of first terminals connected to the memory device, and a plurality of second terminals to be used for detecting attachment conditions of the circuit board in the cartridge attachment unit; the plurality of first terminals have respective first contact portions that get in contact with corresponding apparatus-side terminals; the plurality of second terminals have respective second contact portions that get in contact with corresponding apparatus-side terminals; the first contact portions are arranged within a first area; the second contact portions are arranged outside the first area, and the second contact portions include four contact portions located at four corners of a quadrangular second area encompassing the first area.

According to this configuration, all the first terminals connected to the memory device may be confirmed to be in good contact with the corresponding apparatus-side terminals by checking the contact conditions between the plurality of second contact portions, which are used for detecting attachment conditions of the circuit board, and the corresponding apparatus-side terminals.

Application Example 9

A printing apparatus comprising a cartridge attachment unit to which a printing material cartridge is attached, a printing material cartridge that is attachable to and detachable from the cartridge attachment unit, an attachment detection circuit that detects attachment conditions of the printing material cartridge, and apparatus-side terminals; the printing material cartridge comprises: a memory device, a plurality of first terminals connected to the memory device, and a plurality of second terminals to be used for detecting attachment conditions of the printing material cartridge in the cartridge attachment unit; the plurality of first terminals have respective first contact portions that get in contact with corresponding apparatus-side terminals when the printing material cartridge is properly attached to the cartridge attachment unit; the plurality of second terminals have respective second contact portions that get in contact with corresponding apparatus-side terminals when the printing material cartridge is properly attached to the cartridge attachment unit; the first contact portions are arranged within a first area; the second contact portions are arranged outside the first area, and the second contact portions include four contact portions located at four corners of a quadrangular second area encompassing the first area.

According to this configuration, all the first terminals connected to the memory device may be confirmed to be in good contact with the corresponding apparatus-side terminals by checking the contact conditions between the plurality of second contact portions, which are used for detecting attachment conditions of the printing material cartridges, and the corresponding apparatus-side terminals.

This invention may be embodied in various forms, for example, in a form of a printing material cartridge, a printing material cartridge set composed of plural kinds of printing material cartridges, a cartridge adapter, a cartridge adapter set composed of plural kinds of cartridge adapters, a circuit board, a printing apparatus, a liquid injection device, a printing material supply system equipped with a printing apparatus and cartridges, a liquid supply system equipped with a liquid injection device and cartridges, and a method for detecting attachment conditions of the cartridges or circuit boards.

DESCRIPTION OF EXEMPLARY EMBODIMENTS

A. First Embodiment

Figure 1:
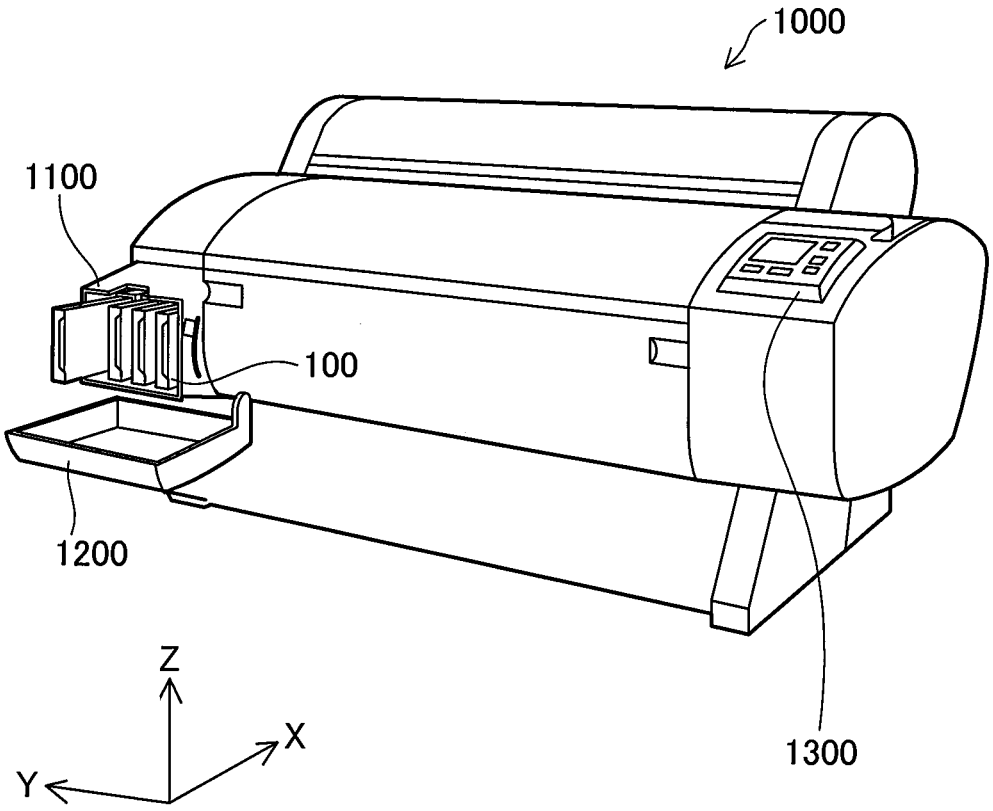
FIG. 1 is a perspective view showing a configuration of the printing apparatus according to an embodiment of this invention.

FIG. 1 is a perspective view showing a configuration of the printing apparatus according to the first embodiment of this invention. A printing apparatus 1000 includes a cartridge attachment unit 1100 to which ink cartridges are attached, an open-close cover 1200 and an operation unit 1300. This printing apparatus 1000 is a large format inkjet printer that prints on large-size paper (e.g. A2-A0 sizes) such as posters. The cartridge attachment unit 1100 is also called a "cartridge holder" or simply a "holder." In the example shown in FIG. 1, four ink cartridges of black, yellow, magenta and cyan, for example, may be attached individually to the cartridge attachment unit 1100. As ink cartridges to be attached to the cartridge attachment unit 1100, any other plural types of ink cartridges may be used. FIG. 1 shows X, Y and Z axes that are at right angles to each other for the sake of explanation. The +X direction is the direction in which an ink cartridge 100 is inserted into the cartridge attachment unit 1100 (hereinafter called "insertion direction" or "attachment direction"). The cover 1200 is provided to the cartridge attachment unit 1100 in an open-close manner. The cover 1200 may be omitted. The operation unit 1300 is an input device by which the user enters various commands and settings, and is equipped with a display to give various messages to the user. This printing apparatus 1000 is provided with a print head, a main scanning drive mechanism and a sub-scanning drive mechanism for scanning the print head, and a head driving mechanism that ejects ink by driving the print head, which are not shown in the figure. This type of printing apparatus, like the printing apparatus 1000, is called "off-carriage type" where a cartridge to be replaced by the user is attached to the cartridge attachment unit which is placed at a location other than the carriage of the printer head.

Figure 2A:
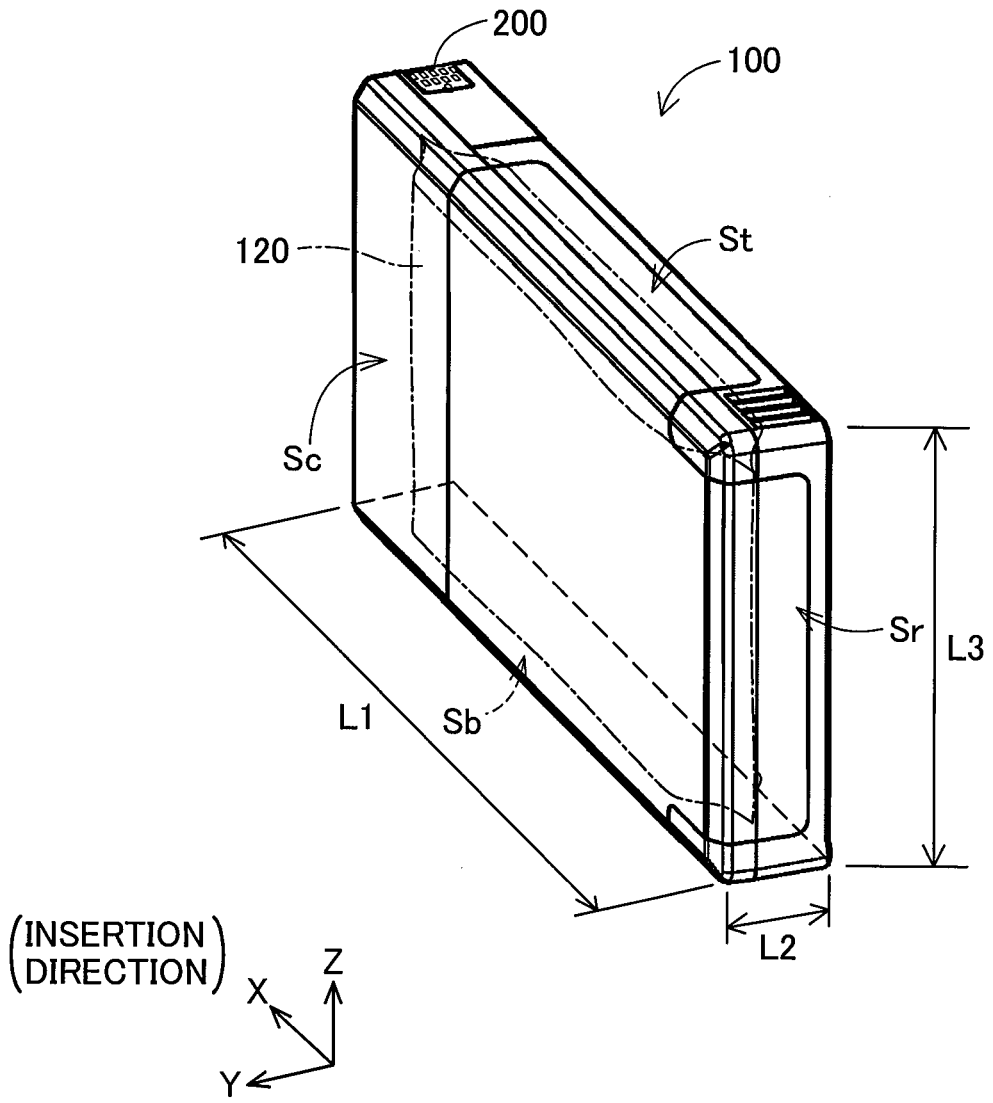
FIGS. 2A and 2B are perspective views showing a configuration of an ink cartridge.
Figure 2B:
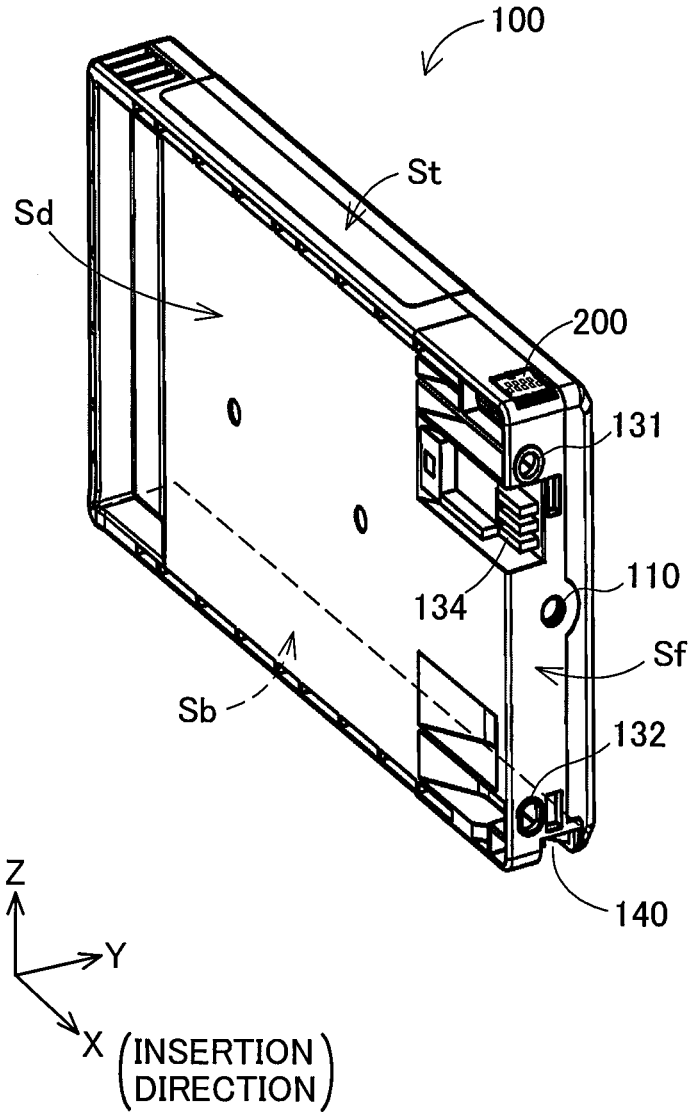

FIGS. 2A and 2B show a perspective view of the ink cartridge 100. The X, Y and Z axes in FIGS. 2A and 2B correspond to those in FIG. 1. An ink cartridge may be simply called a "cartridge." This cartridge 100 is in an approximate shape of a flat cuboid, having its dimensions in three directions L1, L2 and L3, of which the length L1 in insertion direction is the largest, the width L2 is the smallest, and the height L3 falls in between. However, depending on the type of printing apparatus, some cartridges have smaller length L1 than the height L3.

The cartridge 100 comprises a front surface (first surface) Sf, a rear surface (second surface) Sr, a top surface (third surface) St, a bottom surface (fourth surface) Sb, as well as two side surfaces Sc and Sd (fifth and sixth surfaces). The front surface Sf is a plane located at the front end in the insertion direction X. The front surface Sf and rear surface Sr are the smallest among the six planes and are opposing each other. Each of the front surface Sf and rear surface Sr intersects with the top surface St, bottom surface Sb, and the two side surfaces Sc and Sd. Under the condition where the cartridge 100 is attached to the cartridge attachment unit 1100, the top surface St is located at the top in the vertical direction, while the bottom surface Sb is located at the bottom in the same direction. The two side surfaces Sc and Sd are the largest among the six planes, and are opposing each other. In the cartridge 100, an ink chamber 120 (also called an "ink bag") made of a flexible material is installed. Since the ink chamber 120 is formed with a flexible material, it shrinks as ink is consumed, mainly reducing its thickness (width in Y-direction).

On the front surface, two positioning holes 131 and 132 and an ink supply outlet 110 are provided. The two positioning holes 131 and 132 are used for positioning where the cartridge is attached. The ink supply outlet 110 is connected to an ink supply tube of the cartridge attachment unit 1100 to supply ink from the cartridge 100 to the printing apparatus 1000. On the top surface St, a circuit board 200 is provided. In the example of FIGS. 2A and 2B, the circuit board 200 is fixed at the edge of the top surface St (at the farthest end of the insertion direction X). However, the circuit board 200 may be placed at a location away from the edge of the top surface St, or even at a location other than the top surface St. The circuit board 200 is equipped with a non-volatile storage element used for storing information on ink. The circuit board 200 may be simply called the "board." The bottom surface Sb has a stopper groove 140 used for fixing the cartridge 100 at the attachment location. The first side surface Sc and the second side surface Sd are opposing each other intersecting with the front surface Sf, top surface St, rear surface Sr and bottom surface Sb. At the location where the second side surface Sd intersects with the front surface Sf, a comb joint 134 is placed. This comb joint 134, together with another comb joint of the cartridge attachment unit 1100, is used for preventing the cartridge from being erroneously attached.

The cartridge 100 is for large format inkjet printers. The cartridge 100 has dimensions larger than those of small format inkjet printers for individual users, and more capacity to contain ink. For example, the cartridge's length L1 is no less than 100 mm in case of large format inkjet printers, whereas it is no more than 70 mm in case of small format inkjet printers. Also, the amount of ink in full quantities is 17 ml or more (typically 100 ml or more) in case of cartridges for large format inkjet printers, whereas it is 15 ml or less in cartridges for small format inkjet printers. In many cases, cartridges for large format inkjet printers are mechanically engaged with the cartridge attachment unit at their front surface (frontend plane in the insertion direction), whereas those for small format inkjet printers are mechanically engaged with the attachment unit at their bottom surface. Cartridges for large format inkjet printers tend to have more contact failures at the terminals of the circuit board 200 than those for small format inkjet printer, caused by the above characteristics pertaining to the dimensions, weights or the location of engagement with the cartridge attachment unit. This issue will be discussed later.

Meanwhile, detection of attachment conditions is conventionally performed by the use of one or two terminals among many provided in the cartridge. However, even if proper attachment of the cartridge is detected, other terminals not used for the attachment detection may have poor contacts with those of the printing apparatus. Especially when the terminals for a memory device are in poor contact, a problem arises that errors tend to occur when data are written or read from or to the memory device.

Such a problem of poor contact of terminals is critical especially when it comes to cartridges for large format inkjet printers that prints on large-size paper (e.g. A2-A0 sizes) such as posters. In other words, cartridge dimensions of large format inkjet printers are larger than those of cartridges for small format inkjet printers, and the amount of ink contained in the cartridge is larger in the former than the latter. Judging from these differences in dimensions and weights, the inventors have found out that the ink cartridges of large format inkjet printers have more tendency to tilt than those of small format inkjet printers. Also, the location of the engagement between the ink cartridge and cartridge holder (also called "cartridge attachment unit") is often positioned on the side surface of the ink cartridge, whereas such engagement of small format inkjet printer is often located on the bottom surface of the ink cartridge. In light of this location difference of the engagement, it has been found that ink cartridges of large format inkjet printers are more likely to tilt than those of small format inkjet printers. Thus, in large format inkjet printers, ink cartridges are more likely to tilt due to various configurations as compared to those of small format inkjet printers, and as a result, poor contact conditions are likely to occur at the circuit board terminals. Therefore, the inventors have come to expect that proper contact conditions at the memory device terminals should be detected more accurately especially in case of large format inkjet printers.

Figure 3A:
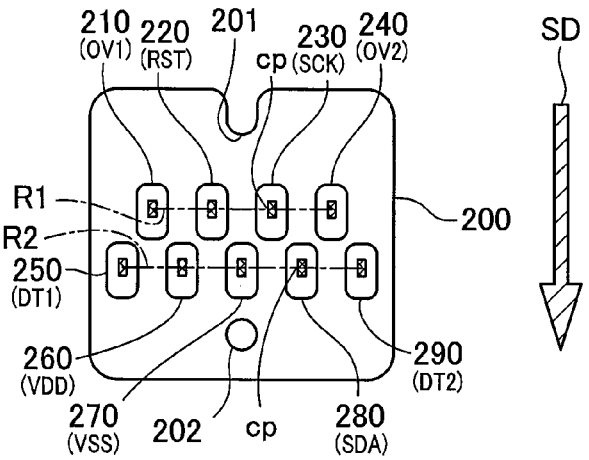
FIGS. 3A-3C show configurations of the circuit boards according to the first embodiment.
Figure 3B:
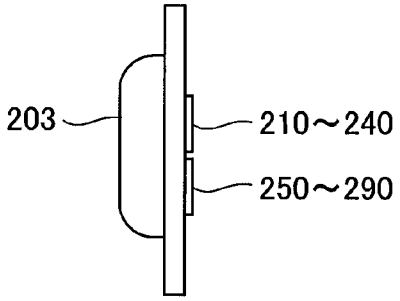

FIG. 3A shows a surface configuration of the board 200. The surface of the board 200 is a plane exposed to outside when the board 200 is attached to the cartridge 100. FIG. 3B shows a side view of the board 200. A boss groove 201 is formed on the top part of the board 200, and a boss hole 202 is formed on the bottom part of the board 200.

The arrow SD in FIG. 3A shows the attachment direction of the cartridge 100 to the cartridge attachment unit 1100. This attachment direction SD coincides with the attachment direction (X direction) of the cartridge shown in FIGS. 2A and 2B. The board 200 has a memory device 203 on its rear surface, and its front surface is provided with a group of terminals composed of nine terminals 210-290. These terminals 210-290 have approximately the same height from the surface of the board 200, and are arranged thereon in a two-dimensional way. The memory device 203 stores information on ink (e.g. remaining amount of ink) in the cartridge 100. The terminals 210-290 are each formed in a rectangular shape and arranged so as to form two rows approximately perpendicular to the attachment direction SD. Among the two rows, the one on the front side of the attachment direction SD (upper row in FIG. 3A) is called the upper row R1 (first row), and the one on the farther side of the attachment direction SD (lower row in FIG. 3A) is called the lower row R2 (second row). Also, it is possible to consider these rows R1 and R2 as formed by contact portions cp of the plural terminals. A group of terminals on the printing apparatus side (described later) get in contact with the terminals 210-290 on the board 200 at these contact portions cp. Each contact portion is in an approximate shape of a point having much smaller area than that of each terminal. When the cartridge 100 is attached to the printing apparatus, contact portions of a group of terminals on the printing apparatus side slide upward on the board 200 from the bottom end in FIG. 3A, and stop at the positions where the respective cartridge-side terminals are in contact with all the corresponding apparatus-side terminals when the attachment is completed.

The terminals 210-240 forming the upper row R1 and the terminals 250-290 forming the lower row R2 have the following functions or uses respectively:

<Upper Row R1>

(1) Attachment detection terminal 210
(2) Reset terminal 220
(3) Clock terminal 230
(4) Attachment detection terminal 240

<Lower Row R1>

(5) Attachment detection terminal 250
(6) Power terminal 260
(7) Ground terminal 270

(8) Data terminal 280

(9) Attachment detection terminal 290

The four attachment detection terminals 210, 240, 250 and 290 are used for detecting the conditions of electrical contact with the corresponding apparatus-side terminals, and these terminals may alternately be called "contact detection terminals." The attachment detection process may also be called "contact detection process." Five other terminals 220, 230, 260, 270 and 280 are terminals for the memory device 203, which may also be called "memory terminals."

Each of the plural terminals 210-290 contains in its center a contact portion cp that gets in contact with the corresponding terminal among plural apparatus-side terminals. All contact portions cp of terminals 210-240 that form the upper row R1 and all contact portions cp of terminals 250-290 that form the lower row R2 are arranged in an alternate manner, making up so-called a staggered or zigzag pattern. Likewise, the terminals 210-240 forming the upper row R1 and the terminals 250-290 forming the lower row R2 are arranged in an alternate manner to make up a staggered or zigzag pattern so as not to have their respective terminal centers aligned in the attachment direction SD.

Contact portions of the two attachment detection terminals 210 and 240 of the upper row R1 are placed at both ends of the upper row R1 respectively, that is, on the outer edges of the upper row R1. Also, contact portions of the two attachment detection terminals 250 and 290 of the lower row R2 are placed at both ends of the lower row R2 respectively, that is, on the outer edges of the lower row R2. Contact portions of the memory terminals 220, 230, 260, 270 and 280 are placed at an approximate center of the area within which the group of plural terminals 210-290 are arranged. Also, contact portions of the four attachment detection terminals 210, 240, 250 and 290 are placed at four corners of the area defined by the cluster of memory terminals 220, 230, 260, 270 and 280.

Figure 3C:
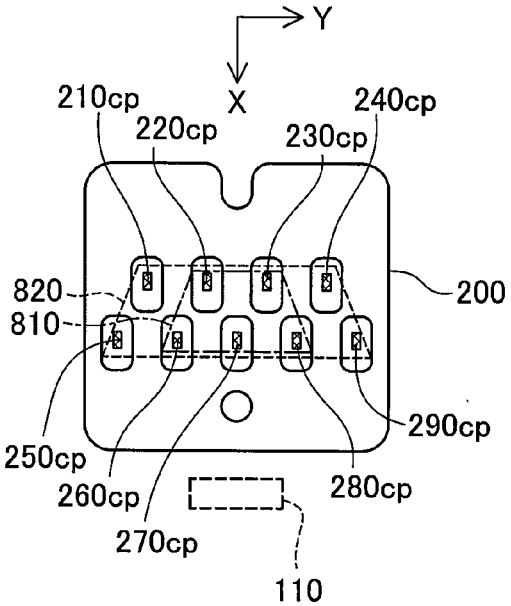

FIG. 3C shows contact portions 210*cp*-290*cp* of the nine terminals 210-290 of FIG. 3A. These nine contact portions 210*cp*-290*cp* are arranged with almost constant intervals in an approximately even distribution. The plural contact portions 220*cp*, 230*cp*, 260*cp*, 270*cp* and 280*cp* for the memory device are placed in the central portion (first area) 810 of an area within which the group of terminal points 210*cp*-290*cp* are arranged. Contact portions 210*cp*, 240*cp*, 250*cp* and 290*cp* of the four attachment detection terminals are placed outside the first area 810. Also, contact portions 210*cp*, 240*cp*, 250*cp* and 290*cp* of the four attachment detection terminals are placed at four corners of a second area 820 having a quadrangular shape that encompasses the first area 810. The shape of the first area 810 is preferably a quadrangle with a minimum area encompassing contact portions 210*cp*, 240*cp*, 250*cp* and 290*cp* of the four attachment detection terminals. Or, the shape of the first area 810 may be a quadrangle that circumscribes contact portions 210*cp*, 240*cp*, 250*cp* and 290*cp* of the four attachment detection terminals. The shape of the second area 820 is preferably be a quadrangle with a minimum area encompassing all of the terminal points 210*cp*-290*cp*. Also, when viewed in the vertical direction (−Z direction) in FIG. 2B, the center of the first area 810 containing the plural contact portions 220*cp*, 230*cp*, 260*cp*, 270*cp* and 280*cp* for the memory device is preferably arranged to align with the center line of the ink supply outlet 110 (FIG. 2B) of the cartridge 100.

In this embodiment, the second area 820 is of a trapezoidal shape. The shape of the second area may be preferably an isosceles trapezoid having a smaller top base (first base) than a bottom base (second base). In the condition where the attachment of the cartridge 100 to the printing apparatus is completed, contact portions 210*cp*, 240*cp*, 250*cp* and 290*cp* of the four attachment detection terminals 210, 240, 250 and 290 are preferably placed close at both ends of the top base and bottom base of the second area 820 in a trapezoidal shape (i.e. at both ends of upper row R1 and lower row R2 in FIG. 3A). The reason for this is as follows. Under the condition where the cartridge 100 is attached to the printing apparatus, an ink supply outlet 110 (see FIG. 2B) of the cartridge 100 is connected to an ink supply pipe (described later) of the printing apparatus. Therefore, if the cartridge 100 gets tilted centered around the ink supply outlet 110 from the normal attachment position in the ±Y direction, it is highly possible that the contact portion of the terminal farthest from the ink supply outlet 110 is displaced from the center of the terminal by the longest distance. In this embodiment, among the terminals 210-240 in the upper row R1, the terminals located farthest from the ink supply outlet 110 are the attachment detection terminals 210 and 240 at both ends of the upper row R1. Among the terminals 250-290 in the lower row R2, the terminals located farthest from the ink supply outlet 110 are the attachment detection terminals 250 and 290 at both ends of the lower row R2. If two rows of terminals are arranged not in a staggered pattern but in a rectangular pattern (or a matrix-like pattern), the second area 820 including contact portions cp on the board 200 becomes a rectangle, too. In that case, the attachment detection terminals 210 and 240 aligned in the upper row R1 are positioned farther from the ink supply outlet 110 than the attachment detection terminals 250 and 290, so that the former terminals get displaced farther from the corresponding apparatus-side terminals. At this time, even if other terminals 220, 230, 250-290 are under proper contact conditions, contacts of the attachment detection terminals 210 and 240 in the upper row R1 may not be sufficient so that they can be misjudged as poor contact. Therefore, in order to reduce such a risk of misjudgment, contact portions 210*cp*, 240*cp*, 250*cp* and 290*cp* of the four attachment detection terminals 210, 240, 250 and 290 are preferably placed at both ends of the upper base and bottom base of the second area 820 in a trapezoidal shape. The advantage of arranging the shape of the second area 820 including all contact portions on the board 200 is more or less the same in case of other embodiments described later.

Figure 4A:
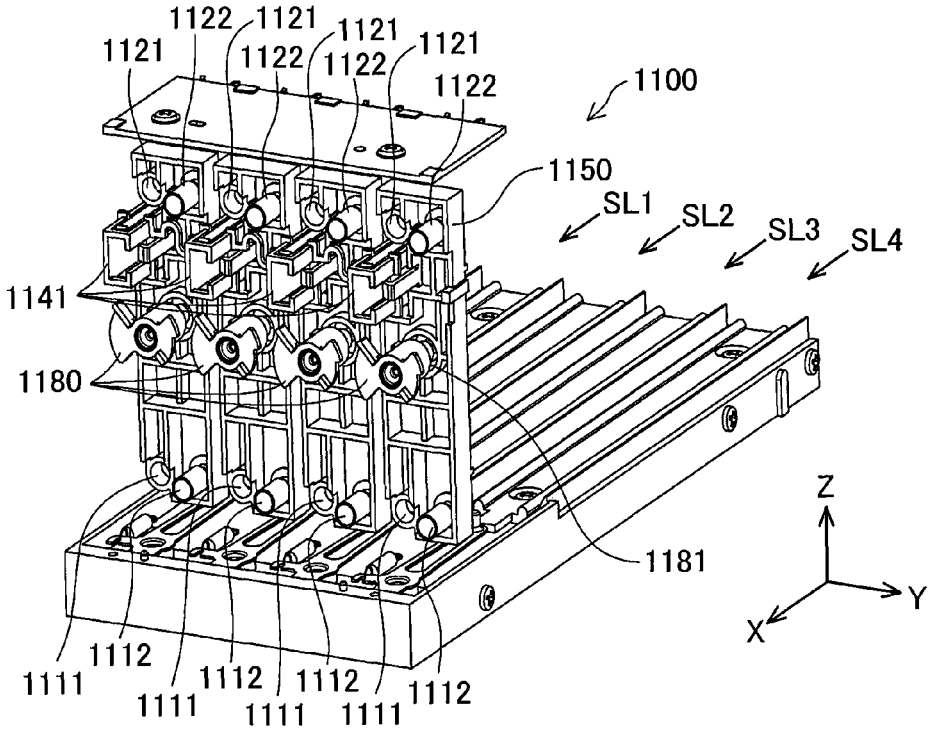
FIGS. 4A-4C shows configuration of the cartridge attachment unit.
Figure 4B:
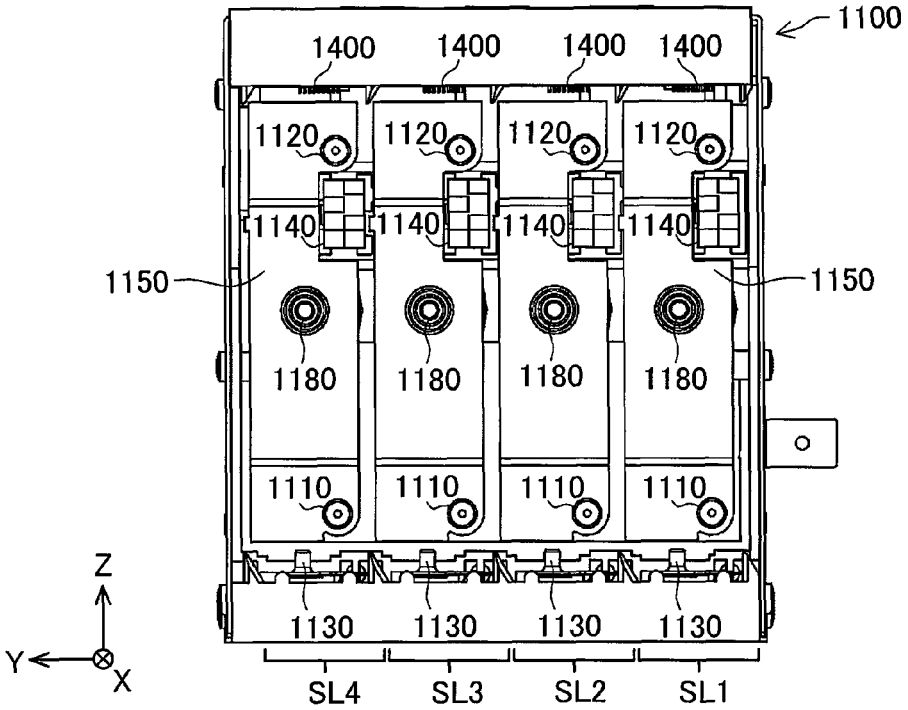
Figure 4C:
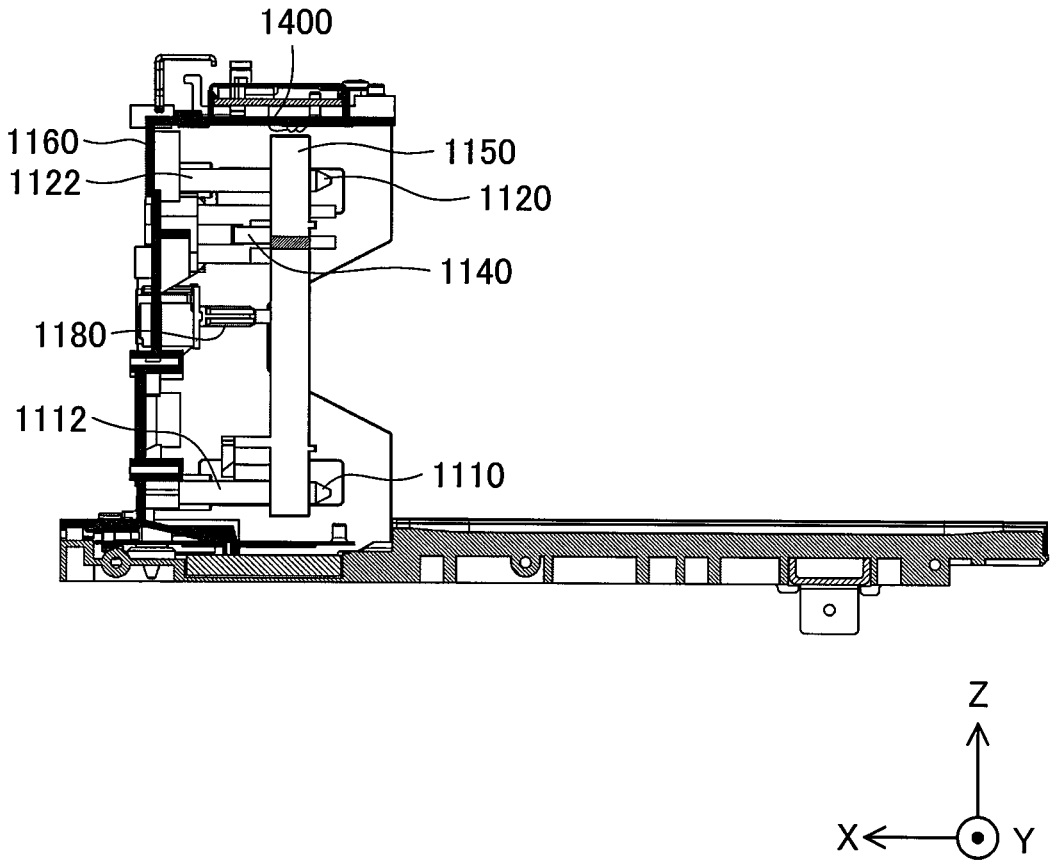

FIGS. 4A-4C are diagrams showing a configuration of the cartridge attachment unit 1100. FIG. 4A is a perspective view seen diagonally from behind the cartridge attachment unit 1100, while FIG. 4B is a front view (on the side where the cartridge is inserted) into the interior of the cartridge attachment unit 1100. FIG. 4C is a sectional view of the interior of the cartridge attachment unit 1100. In FIGS. 4A-4C, some partitions and other elements are omitted for the convenience of illustration. The X, Y and Z axes in FIGS. 4A-4C correspond to those in FIGS. 2A and 2B. The cartridge attachment unit 1100 is provided with four holding slots SL1-SL4 for holding cartridges. As shown in FIG. 4B, inside the cartridge attachment unit 1100, each slot is equipped with an ink supply tube 1180, a pair of positioning pins 1110 and 1120, a comb joint 1140, and a contact mechanism 1400. As shown in FIG. 4C, the ink supply tube 1180, the pair of positioning pins 1110 and 1120, and the comb joint 1140 are fixed to the back wall member 1160 of the cartridge attachment unit. The ink supply tube 1180, the positioning pins 1110 and 1120, and the comb joint 1140 are inserted through holes 1181, 1111, 1121 and 1141 provided on a slider member 1150 and are placed to protrude in the direction opposite to the insertion direction of the cartridge. FIG. 4A is a perspective view seen from behind the slider member 1150 with the back wall member 1160 removed. Positioning pins are omitted in FIG. 4A. As shown in FIG. 4A, a pair of bias springs 1112 and 1122 that correspond to the pair of positioning pins 1110 and 1120 are provided on the rear side of the slider member 1150. As shown in FIG. 4C, the pair of bias springs 1112 and 1122 are fixed in place to the slider member 1150 and back wall member 1160.

The ink supply tube 1180 is inserted into the ink supply outlet 110 (FIG. 2A) of the cartridge 100 to be used for supplying ink to the print head inside the printing apparatus 1000. The positioning pins 1110 and 1120 are inserted into the positioning holes 131 and 132 provided in the cartridge 100 to be used for determining the holding position of the cartridge 100 when the cartridge 100 is inserted into the cartridge attachment unit 1100. The comb joint 1140 has a shape corresponding to that of the comb joint 134 of the cartridge 100 and is different in shape from each other in each of the holding slots SL1-SL4. This allows each of the holding slots SL1-SL4 to accept only the cartridge containing a prescribed type of ink and exclude cartridges of other colors.

The slider member 1150 placed on the back wall in each holding slot is configured to be slidable in the attachment and detachment directions of the cartridge (X direction and −X direction, respectively). The pair of bias springs 1112 and 1122 (FIG. 4A) exert a biasing force on the slider member 1150 in the detachment direction. The cartridge 100, together with the slider member 1150, pushes the pair of bias springs 1112 and 1122 in the attachment direction when inserted into the holding slot to be pushed in against the force of the bias springs 1112 and 1122. Therefore, the cartridge 100, when placed in the cartridge attachment unit 1100, gets biased in the detachment direction by the pair of bias springs 1112 and 1122. Under these conditions where the cartridge is in place, a stopper member 1130 (FIG. 4B) placed at the bottom of each of the holding slots SL1-SL4 is engaged with the stopper groove 140 (FIG. 2A) placed at the bottom surface Sb of the cartridge 100. This engagement between the stopper member 1130 and stopper groove 140 prevents the cartridge 100 from being detached from the cartridge attachment unit 1100 by the force of bias springs 1112 and 1122.

When the user pushes in the cartridge 100 in the attachment direction to dismount the cartridge 100, the stopper member 1130 is disengaged from the stopper groove 140 in response to the push. As a result, the cartridge 100 is pushed over in the detachment direction (−X direction) by the force of the pair of bias springs 1112 and 1122. Thus, the user may easily remove the cartridge 100 from the cartridge attachment unit 1100.

The contact mechanism 1400 (FIG. 4B) includes plural apparatus-side terminals that get in contact with the terminals 210-290 (FIG. 3A) of the circuit board 200 to conduct electricity when the cartridge 100 is inserted into the cartridge attachment unit 1100. The control circuit of the printing apparatus 1000 sends and receives signals to and from the circuit board 200 via this contact mechanism 1400.

Figure 5A:
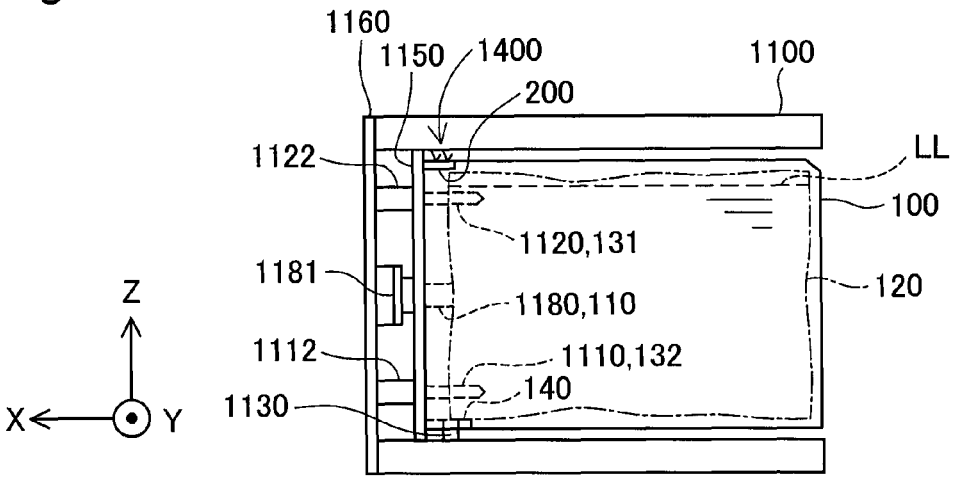
FIGS. 5A-5C show an ink cartridge attached within its housing.

FIG. 5A shows proper attachment of the cartridge 100 in the cartridge attachment unit 1100. In this situation, the cartridge 100 is not tilted and its upper and bottom surfaces are in parallel with the upper and lower members of the cartridge attachment unit 1100. The ink supply tube 1180 of the cartridge attachment unit 1100 is connected to the ink supply outlet 110, while the positioning pins 1110 and 1120 of the cartridge attachment unit 1100 are inserted into the positioning holes 131 and 132. In addition, the stopper member 1130 provided at the bottom of the cartridge attachment unit 1100 is engaged with the stopper groove 140 provided at the bottom of the cartridge 100. Then, the cartridge's front surface Sf receives a biasing force in the detachment direction by the pair of bias springs 1112 and 1122 in the cartridge attachment unit 1100. Under the condition where the cartridge 100 is properly attached, the contact mechanism 1400 of the cartridge attachment unit 1100 and the terminals 210-290 (FIG. 3A) on the circuit board 200 of the cartridge 100 are in good contact with each other.

Figure 5B:
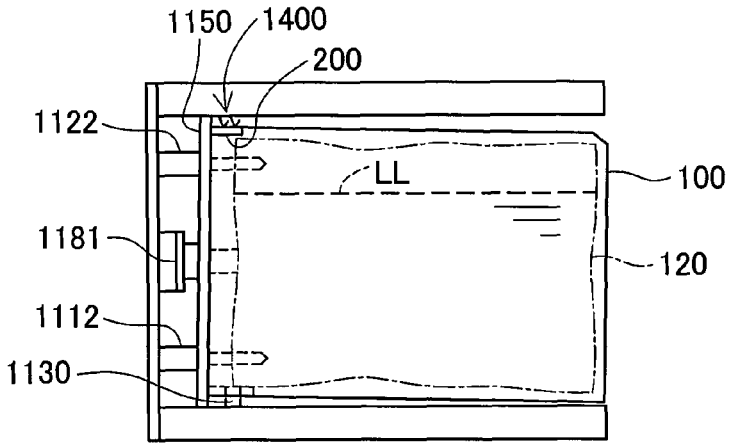
Figure 5C:
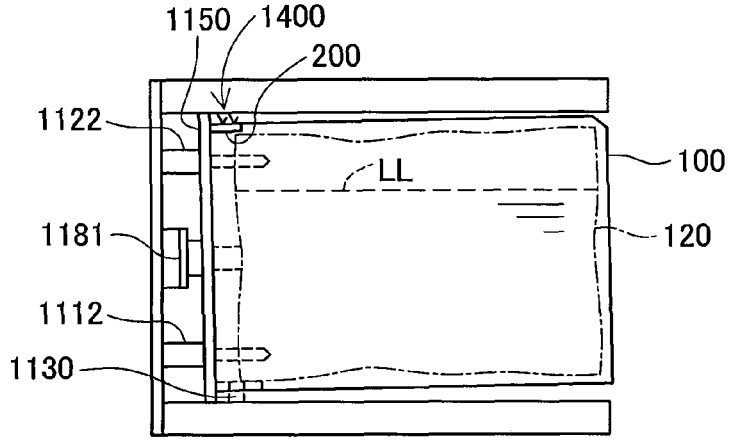

Meanwhile, the cartridge attachment unit 1100 has a small allowance within it in order to accommodate easy attachment of the cartridge 100. For this reason, the cartridge 100 does not necessarily get attached in a proper upright position as shown in FIG. 5A but may possibly tilt around an axis parallel to the cartridge's width direction (Y direction). More specifically, as shown in FIG. 5B, it sometimes tilts with its rear end sagging, or conversely as shown in FIG. 5C, it may tilt with its rear end slightly lifted. Especially as ink is consumed and the liquid level LL drops down, the gravity center shifts in response to the weight reduction of ink contained, and the balance between the force by the bias springs 1112, 1122 and the weight of the cartridge including ink gets shifted. According to this change in weight balance, the cartridge is more likely to tilt. When the cartridge tilts, some of the plural terminals placed on the cartridge's circuit board 200 may experience poor contact. Especially under the conditions of FIGS. 5B and 5C, one or more terminals in either the group of terminals 210-240 in the upper row R1 or the group of terminals 250-290 in the lower row R2 may possibly experience poor contact.

Additionally, when the cartridge tilts, another form of tilt may also happen in the direction perpendicular to the one shown in FIG. 5B or 5C (a tilt around an axis parallel to the attachment direction X). In this case, the board 200 also tilts to the right or left around an axis perpendicular to its attachment direction SD, which may cause poor contact at one or more terminals of either the group of terminals 210, 220, 250 and 260 on the left side of the board 200 or the group of terminals 230, 240, 280 and 290 on the right side thereof.

Once such poor contact occurs, it leads to a failure wherein sending and receiving of signals between the cartridge's memory device 203 and the printing apparatus 1000 may not be performed properly any more. Also, if the area around the board 200 is contaminated with foreign matters such as dust and droplets of ink, unintended shorting or leak may happen between the terminals. The processes of attachment detection according to various embodiments explained below may be performed to detect poor contact arising from the above-mentioned tilting of the cartridge or unintended shorting or leak caused by foreign matters.

Meanwhile, as compared to cartridges for small format inkjet printers for individual users, cartridges for large format inkjet printers have the following characteristics:

(1) Cartridge dimensions are larger (the length L1 is 100 mm or more).

(2) More amount of ink contained (no less than 17 ml, typically 100 ml or more).

(3) Mechanically engaged with the cartridge attachment unit on the front surface (frontend plane in the attachment direction).

(4) The space inside the ink container is not partitioned, forming a single ink container (or ink bag).

Depending on the type of large format inkjet printers, some cartridges lack some of the characteristics (1)-(4), but most cartridges typically have at lease one of them.

Cartridges for large format inkjet printers are more likely to tilt than those for small format inkjet printers due to the above characteristics pertaining to dimensions, weight, the location of connections with the cartridge attachment unit, or the configuration of the ink container, and as a result, poor contact at the terminals of the board 200 is likely to happen.

Therefore, it is of great significance to perform processes as described below to detect poor contact, unintended shorting, and leak at the terminals for the large format printers and their cartridges.

Figure 6:
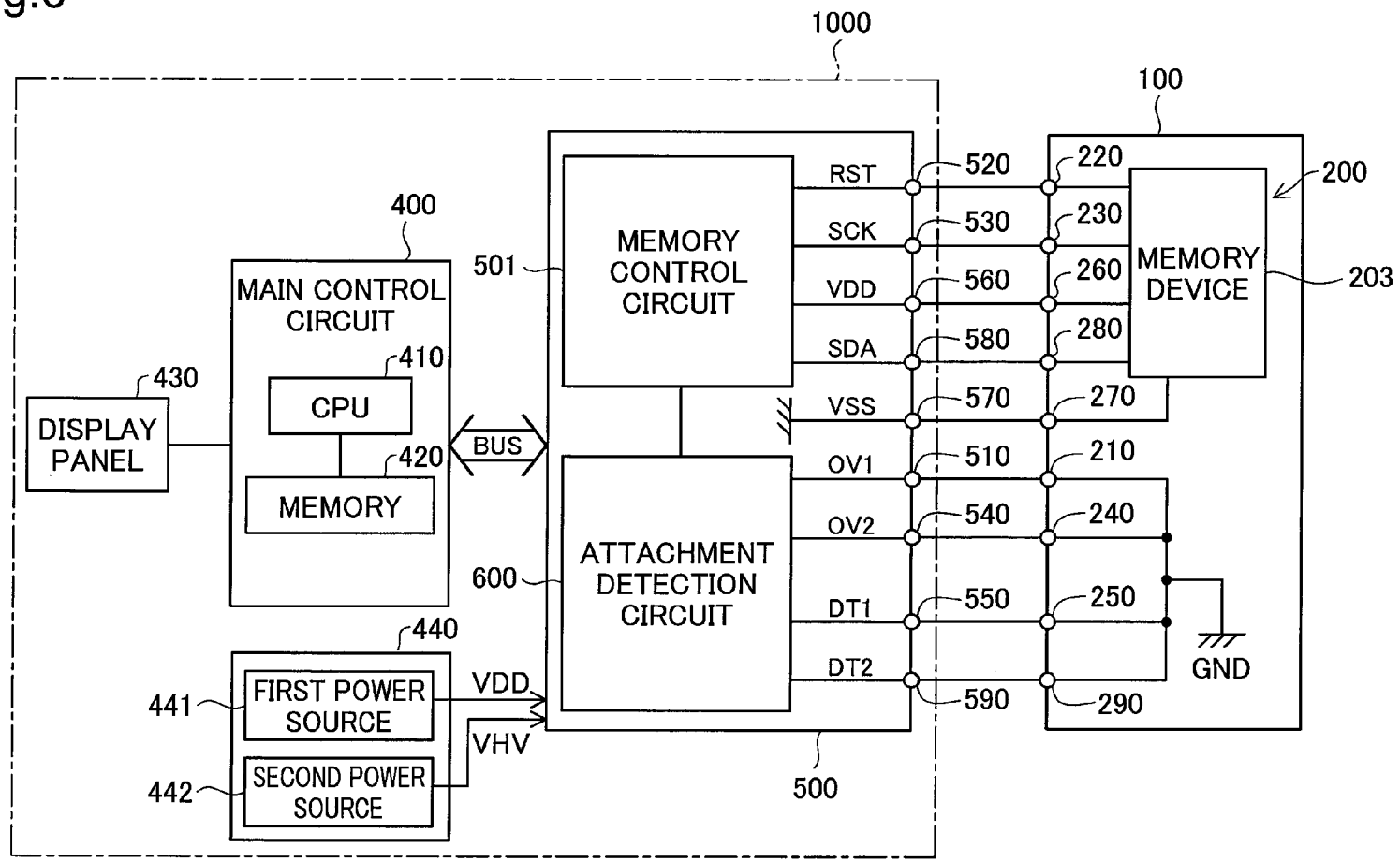
FIG. 6 is a block diagram showing an electrical configuration of the ink cartridge's circuit board and the printing apparatus according to the first embodiment.

FIG. 6 is a block diagram showing an electrical configuration of the ink cartridge's board 200 and the printing apparatus 1000 according to the first embodiment. The printing apparatus 1000 includes a display panel 430, a power circuit 440, a main control circuit 400, and a sub-control circuit 500. The display panel 430 is used for sending various messages to the users on the operating status of the printing apparatus 1000 and attachment conditions of the cartridge. The display panel 430 is installed, for example, at the operation unit 1300 in FIG. 1. The power circuit 440 includes a first power source 441 that generates a first power supply voltage VDD and a second power source 442 that generates a second power supply voltage VHV. The first power supply voltage VDD is a common power voltage used for logic circuits (e.g. rated 3.3V). The second power supply voltage VHV is a higher voltage (e.g. rated 4.2V) to be used for driving the print head to eject ink. These voltages VDD and VHV are supplied to the sub-control circuit 400 as well as to other circuits as necessary. The main control circuit 400 includes a CPU 410 and a memory 420. The sub-control circuit 500 includes a memory control circuit 501 and an attachment detection circuit 600. It is possible to collectively call the main control circuit 400 and the sub-control circuit 500 a "control circuit."

Among the nine terminals provided on the cartridge's board 200 (FIG. 3)A, the reset terminal 220, clock terminal 230, power terminal 260, ground terminal 270 and data terminal 280 are electrically connected to the memory device 203. The memory device 203 is a non-volatile memory with no address terminal that receives data from the data terminal or sends data from the data terminal in synchronous with the clock signal SCK, wherein accessible memory cells are determined based on the number of pulses of the clock signal SCK inputted from the clock terminal and the command data inputted from the data terminal. The clock terminal 230 is used for supplying the clock signal SCK from the sub-control circuit 500 to the memory device 203. The power voltage (e.g. rated 3.3V) and ground voltage (0V) for driving the memory device are supplied from the printing apparatus 1000 to the power terminal 260 and ground terminal 270, respectively. The power voltage for driving the memory device 203 may be a voltage directly given by the first power supply voltage VDD or the one generated therefrom, which is lower than the first power supply voltage VDD. The data terminal 280 is used for transmitting data signals SDA between the sub-control circuit 500 and memory device 203. The reset terminal 220 is used for supplying reset signals RST from the sub-control circuit 500 to the memory device 203. The four attachment detection terminals 210, 240, 250, 290 are connected with each other via wiring inside the board 200 of the cartridge 100 (FIG. 3A), which are all grounded. For example, the grounding of the attachment detection terminals 210, 240, 250, 290 is done by connecting them to the ground terminal 270. However, the grounding via a route other than the ground terminal is permissible. As seen from the above explanation, the attachment detection terminals 210, 240, 250 and 290 may be connected to part of the memory terminals (or the memory device 203), but preferably should not be connected to any memory terminal or memory device other than the ground terminal. Especially, it is preferable, in terms of ensuring the performance of attachment detection, that the attachment detection terminals are connected to none of the memory terminals or memory device, because no signal or voltage other than the attachment detection signal is applied to the attachment detection terminals. The four attachment detection terminals 210, 240, 250 and 290 are connected via wiring in the example of FIG. 6, but part of the wiring may be replaced with some resistances. Here, a connection between two terminals by a wiring may be called "short-circuit connection" or "conductive connection." The short-circuit connection is a different state from that of unintended shorting.

In FIG. 6, the wiring routes between the sub-control circuit 500 and the board 200 that connect the apparatus-side terminals 510-590 with the terminals 210-290 of the board 200 are coded SCK, VDD, SDA, RST, OV1, OV2, DT1 and DT2. Among these wiring codes, the one for the wiring of the memory device is coded the same as the signal name. Here, the apparatus-side terminals 510-590 are provided in the contact mechanism 1400 shown in FIGS. 4B and 5A.

Figure 7:
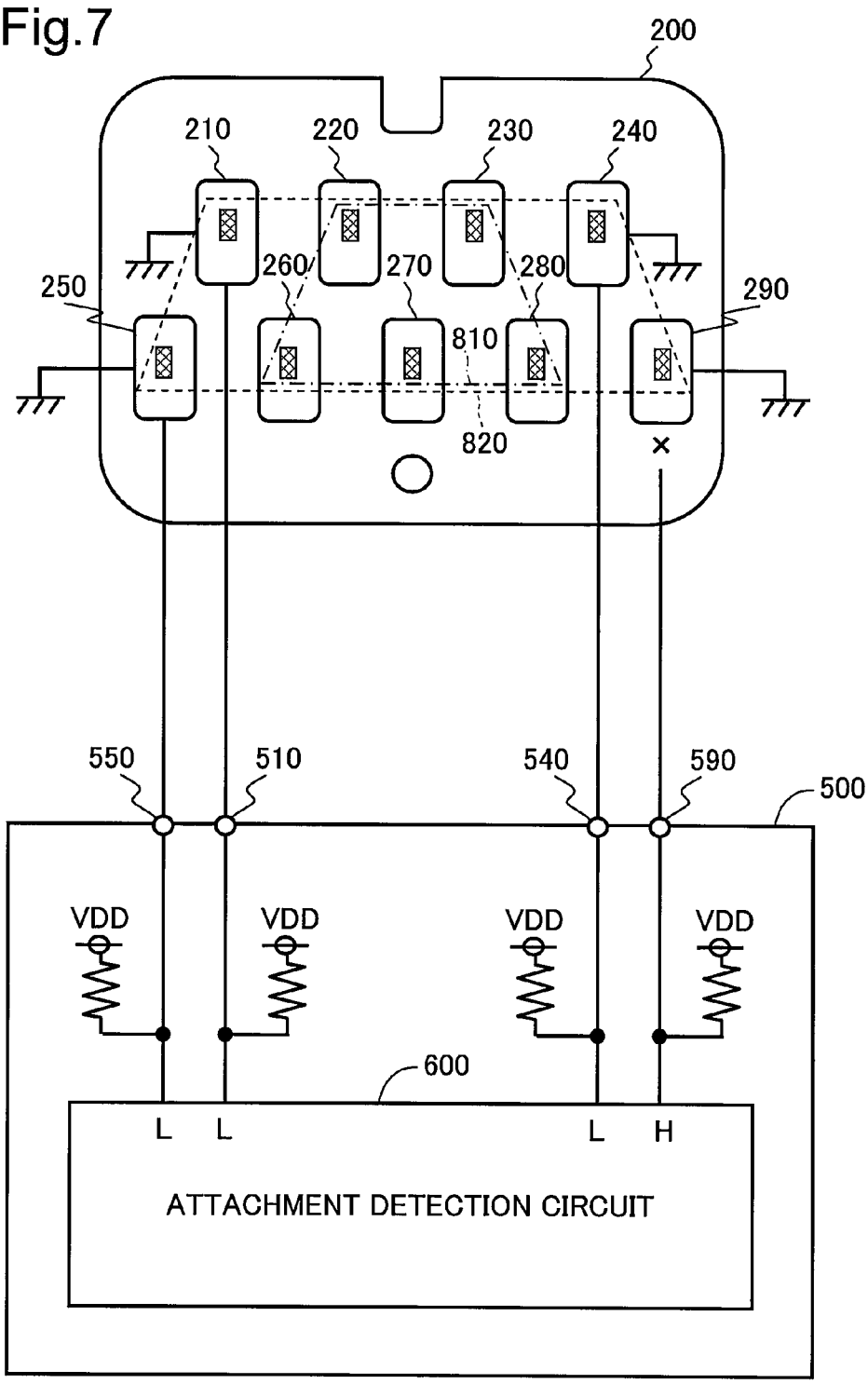
FIG. 7 shows a condition of connection between the circuit board and the attachment detection circuit according to the first embodiment.

FIG. 7 shows connection between the board 200 and the attachment detection circuit 600. The four attachment detection terminals 210, 240, 250 and 290 on the board 200 are connected to the attachment detection circuit 600 via the corresponding apparatus-side terminals 510, 540, 550 and 590. Also, the four attachment detection terminals 210, 240, 250 and 290 on the board 200 are grounded. The wiring that connects the apparatus-side terminals 510, 540, 550 and 590 with the attachment detection circuit 600 are each connected to the power supply voltage VDD (rated 3.3V) within the sub-control circuit 500 via a pull-up resistance.

In the example of FIG. 7, the three terminals 210, 240 and 250 among the four attachment detection terminals 210, 240, 250 and 290 on the board 200 are in good contact with the corresponding apparatus-side terminals 510, 540 and 550. On the other hand, the fourth attachment detection terminal 290 is not in contact with the corresponding apparatus-side terminal 590. The wiring voltage of the three apparatus-side terminals 510, 540 and 550 that are in good contact turns to L level (ground voltage level), whereas the wiring voltage of the apparatus-side terminal 590 that is not in contact turns to H level (power supply voltage VDD). Therefore, it is possible for the attachment detection circuit 600 to detect contact conditions for each of the four attachment detection terminals 210, 240, 250 and 290 by checking each voltage level of such wiring.

Contact portions cp of the four attachment detection terminals 210, 240, 250 and 290 on the board 200 are each placed at four corners along the periphery of the cluster area 810 defined by contact portions cp of the terminals 220, 230, 260, 270 and 280 for the memory device. When all the contacts of the four attachment detection terminals 210, 240, 250 and 290 are in good condition, the cartridge does not tilt much and the contact conditions of the terminals 220, 230, 260, 270 and 280 are in good condition, too. On the contrary, one or more terminals among the four attachment detection terminals 210, 240, 250 and 290 are in poor contact, the cartridge has a significant tilt and one or more terminals among the terminals 220, 230, 260, 270 and 280 for the memory device may possibly in poor contact. If one or more terminals among the four attachment detection terminals 210, 240, 250 and 290 are in poor contact, the attachment detection circuit 600 may preferably display information (by words or images) on the display panel 430 notifying the user of the non-attached condition.

Meanwhile, the reason for providing contact portions cp of the attachment detection terminals at all four corners along the periphery of the cluster area 810 defined by contact portions of the memory device terminals is that the board 200 of the cartridge 100 and the contact mechanism 1400 of the cartridge attachment unit 1100 (FIG. 5A) may sometimes tilt relative to each other due to a degree of freedom in the cartridge 100 to tilt to some extent even in the situation where the cartridge 100 is attached to the cartridge attachment unit 1100. For example, if the rear end of the cartridge 100 tilts as shown in FIG. 5B to let the group of terminals 210-240 (or their contact portions) of upper row R1 shift away from the contact mechanism 1400 farther than the group of terminals 250-290 (or their contact portions) of the lower row R2, the group of terminals 210-240 of the upper row R1 may result in poor contact. On the contrary, if the rear end of the cartridge 100 tilts as shown in FIG. 5C to let the group of terminals 250-290 of the lower row R2 on the board 200 shift away from the contact mechanism 1400 farther than the group of terminals of the upper row R1, the five terminals 250-290 of the lower row R2 on the board 200 may result in poor contact. Also, unlike FIGS. 5B and 5C, if the cartridge 100 tilts around an axis parallel to the X-direction to let the left edge of the board 200 in FIG. 7 shift away from the contact mechanism 1400 farther than the right edge, the terminals 210, 220, 250, 260 and 270 on the left sided of the board 200 may result in poor contact. On the contrary, the right edge of the board 200 shifts farther from the contact mechanism 1400 than the left edge, the terminals 230, 240, 270, 280 and 290 on the right side of the board 200 may result in poor contact. Once such a contact failure occurs, some errors may be caused in writing and reading data to and from the memory device 203. Therefore, as mentioned above, if all the contact conditions are confirmed, whether they are good or poor, at contact portions of the four attachment detection terminals 210, 240, 250 and 290 placed at four corners of the cluster area 810 defined by the contact portions of the memory terminals 220, 230, 260, 270 and 280, it is possible to prevent any contact failure and access error of the memory device caused by such tilting as described above.

Since the first embodiment is provided with contact portions of the attachment detection terminals placed at four corners along the periphery of the cluster area defined by the contract points of the plural memory device terminals on the board, it is possible to secure good contact conditions for memory device terminals by confirming good contact between the attachment detection terminals and the corresponding apparatus-side terminals. Especially in case of cartridges for large format inkjet printers, the cartridge is likely to tilt within the cartridge attachment unit, as explained in FIGS. 5A-5C. Therefore, the necessity and meaning of placing contact portions of the four attachment detection terminals at four corners of the area along the periphery of the area where contact portions of plural memory device terminals are placed (outside the area where contact portions of plural memory device terminals are placed and encompassing such area), as well as confirming all the contact conditions of the four attachment detection terminals, whether they are good or poor, are considered significant especially regarding cartridges for large format inkjet printers. Here, the word "plural memory device terminals" means two power terminals (ground terminal, power terminal) and three signal terminals (reset terminal, clock terminal, data terminal) which are required for the control circuit of the printing apparatus to write or read data to and from the memory device provided in the cartridge.

B. Second Embodiment

Figure 8:
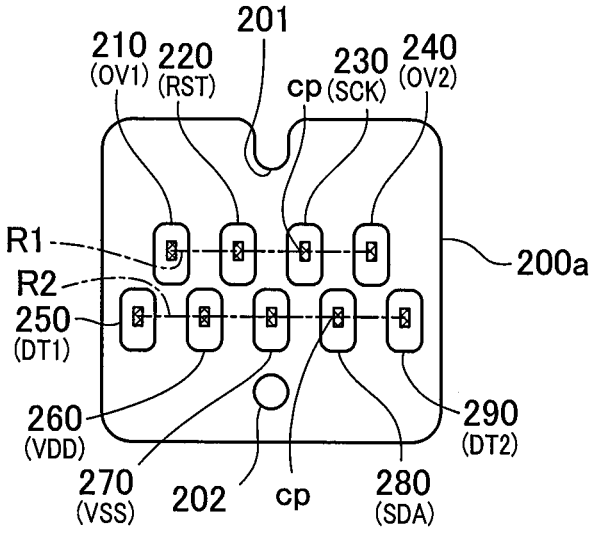
FIG. 8 shows the circuit board configuration according to the second embodiment.

FIG. 8 is a diagram showing the circuit board configuration according to the second embodiment. The arrangement of the terminals 210-290 is the same as that shown in FIG. 3A. However, functions or uses of various terminals are slightly different from those of the first embodiment as follows.

<Upper Row R1>

(1) Overvoltage detection terminal 210 (also used for leak detection and attachment detection)

(2) Reset terminal 220

(3) Clock terminal 230

(4) Overvoltage detection terminal 240 (also used for leak detection and attachment detection)

<Lower Row R1>

(5) Sensor terminal 250 (also used for attachment detection)

(6) Power terminal 260

(7) Ground terminal 270

(8) Data terminal 280

(9) Sensor terminal 290 (also used for attachment detection)

The terminals 210 and 240 located at both ends of the upper row R1 and their contact portions are used for detecting overvoltage (explained later), leak between terminals (explained later), and attachment (contact) conditions. Also, the terminals 250 and 290 of the lower row R2 and their contact portions are used for detecting the remaining amount of ink using a sensor provided in the cartridge 100 as well as for attachment (contact) detection. As in the first embodiment, the four contact portions of the terminals 210, 240, 250 and 290 located at four corners of the quadrangular area including contact portions of the group of terminals 210-290 are used for attachment detection (contact detection). In the second embodiment, however, the same voltage as the first power supply voltage VDD for driving the memory device, or a voltage generated from the first power supply voltage VDD is applied to contact portions of the two terminals 210 and 240 placed at both ends of the upper row R1, and the same voltage as the second power supply voltage VHV used for driving the print head, or a voltage generated from the second power supply voltage VHV is applied to contact portions of the two terminals 250 and 290 placed at both ends of the lower row R2. As the "voltage generated from the first power supply voltage VDD," it is preferable to use a voltage that is lower than the first power supply voltage VDD (ordinarily 3.3V) but higher than the ground voltage, and more preferably, a voltage that is lower than an "overvoltage threshold value" which is applied to the terminal 210 or 240 when an overvoltage is detected by an overvoltage detection unit described later. As the "voltage generated from the second power supply voltage VHV," it is preferable to use a voltage that is higher than the first power supply voltage VDD but lower than the second power supply voltage VHV.

On the board 200*a* in FIG. 8, as is the case for the board 200 in FIG. 3A, contact portions of the four attachment detection terminals 210, 240, 250 and 290 are placed close at both ends of the upper base and bottom base of the trapezoidal area. Therefore, compared to the situation where those contact portions of the attachment detection terminals are placed at four corners of a rectangle, there is an advantage of a lower risk of misjudgments concerning the attachment conditions.

By the way, as one of the aspects of attachment detection or contact detection of a printing material cartridge, a shorting detection is sometimes performed to check if there is any unintended shorting between the cartridge terminals. If a shorting detection is to be performed, a shorting detection terminal is placed at a location adjacent to a high-voltage terminal where a voltage higher than the regular power supply voltage (3.3V) is applied in order to detect an overvoltage at the shorting detection terminal. And, if any such overvoltage is detected at the shorting detection terminal, the high voltage applied to the high-voltage terminal is stopped. However, even if the high voltage is stopped when overvoltage is detected at the shorting detection terminal, a problem remains that a possibility cannot be ruled out that some failures might occur in the cartridge or printing apparatus caused by the overvoltage that had been generated before the stoppage. The second and third embodiments described below include some measures to solve such a conventional problem.

Figure 9:
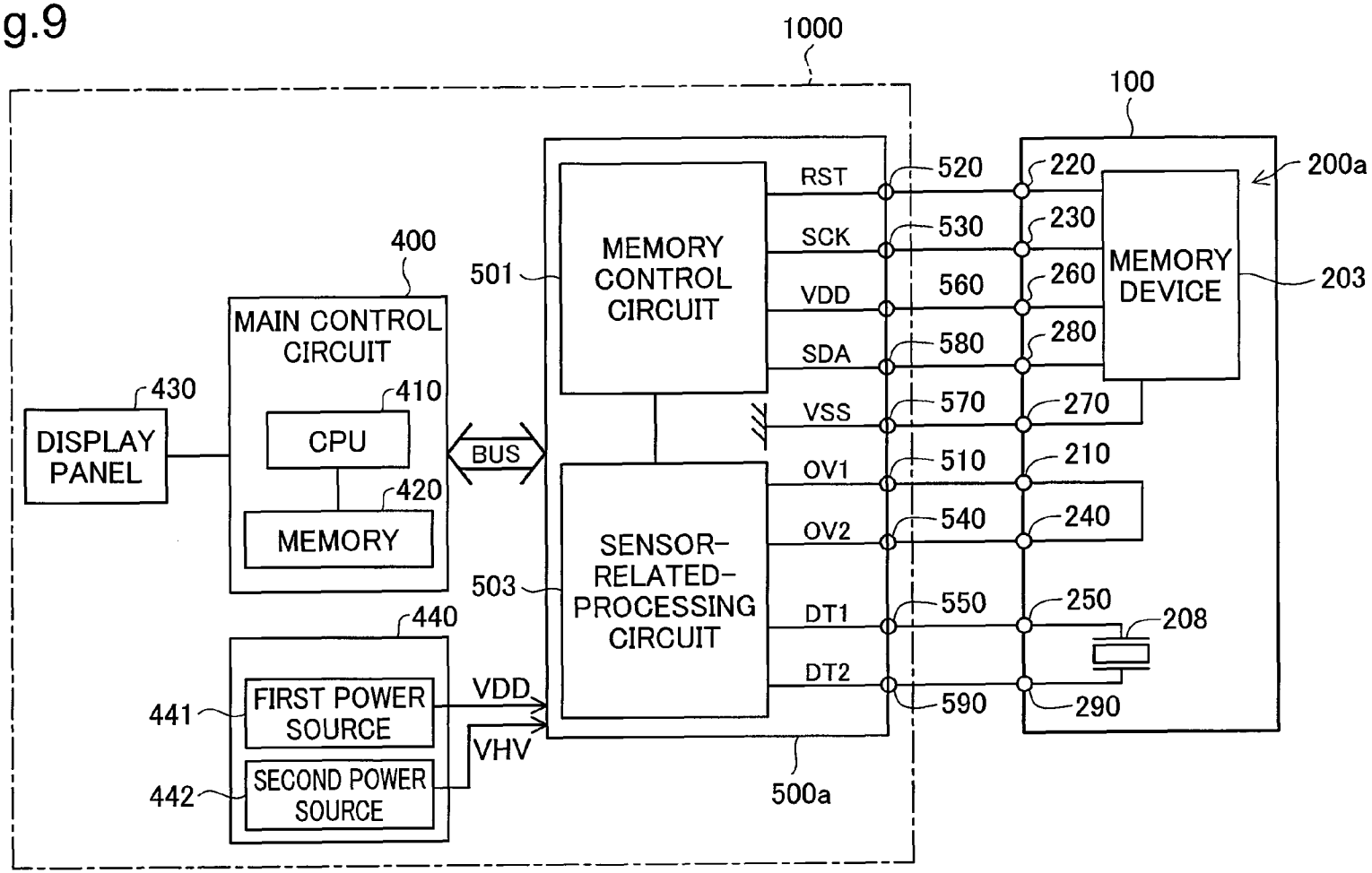
FIG. 9 is a block diagram showing an electrical configuration of the ink cartridge's circuit board and the printing apparatus according to the second embodiment.

FIG. 9 is a block diagram showing an electrical configuration of the ink cartridge's circuit board 200*a* and the printing apparatus 100 according to the second embodiment. The board 200*a* is provided with a sensor 208 used for detecting the remaining amount of ink in addition to the memory device 203 and nine terminals 210-290. As the sensor 208, a known sensor for the remaining amount of ink using piezoelectric elements may be used. A piezo-electric element electrically functions as a capacitative element.

The main control circuit 400 includes a CPU 410 and a memory 420 as in the first embodiment. The sub-control circuit 500*a* includes a memory control circuit 501 and a sensor-related-processing circuit 503. The sensor-related-processing circuit 503 is used for detecting attachment conditions of the cartridges in the cartridge attachment unit 1100 and detecting the remaining amount of ink using the sensor 208. Since the sensor-related-processing circuit 503 is used for detecting attachment conditions of the cartridge, it may also be called a "attachment detection circuit." The sensor-related-processing circuit is a high voltage circuit that applies or supplies a higher voltage to the cartridge sensor 208 than the power supply voltage VDD that is applied or supplied to the memory device 203. The high voltage applied to the sensor 208 may be the power supply voltage VHV (rated 42V) itself used for driving the print head or a slightly lower voltage (e.g. 36V) generated from the power supply voltage VHV used for driving the print head.

Figure 10:
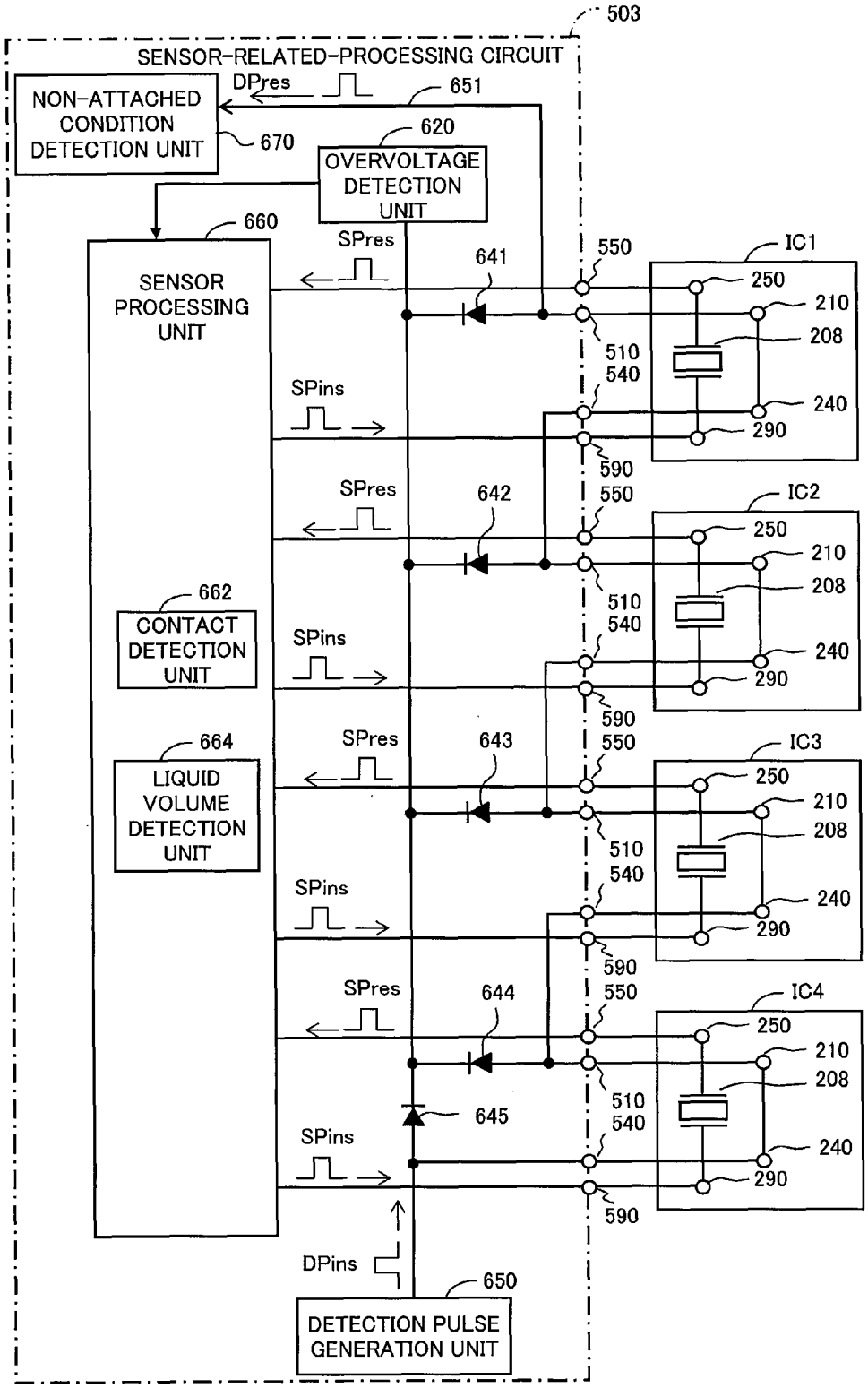
FIG. 10 shows the internal configuration of the sensor-related-processing circuit according to the second embodiment.

FIG. 10 is a diagram showing the internal configuration of a sensor-related-processing circuit 503 according to the second embodiment. Here, four cartridges are shown as attached in the cartridge attachment unit, and reference codes IC1-IC4 are used to identify each cartridge. The sensor-related-processing circuit 503 includes a non-attached condition detection unit 670, an overvoltage detection unit 620, a detection pulse generation unit 650 and a sensor processing unit 660. The sensor processing unit 660 includes a contact detection unit 662 and a liquid volume detection unit 664. The contact detection unit 662 detects the contact conditions of the sensor terminals 250 and 290 using the cartridge sensor 208. The liquid volume detection unit 664 detects the remaining amount of ink using the cartridge sensor 208. The detection pulse generation unit 650 and the non-attached condition detection unit 670 perform detection of whether all the cartridges are attached (detection process of non-attached conditions), and detection of any leak between terminals 210 and 250 as well as between terminals 240 and 290. The overvoltage detection unit 620 performs detection of whether any overvoltage is applied to the overvoltage detection terminal 210 or 240. The overvoltage detection may be also referred to as "short-circuit detection", and the overvoltage detection unit 620 may be also referred to as "short-circuit detection circuit 620."

In each cartridge, the first and second overvoltage detection terminals 210 and 240 are connected with each other via wiring. In the example of FIG. 10, the overvoltage detection terminals 210 and 240 are in short-circuit connection via wiring, but part of the wiring may be replaced with some resistance. The first overvoltage detection terminal 210 of the first cartridge IC1 is connected to the wiring 651 within the sensor-related-processing circuit 503 via the corresponding apparatus-side terminal 510, and the wiring 651 is in turn connected to the non-attached condition detection unit 670. The second overvoltage detection terminal 240 of the nth (n=1-3) cartridge and the first overvoltage detection terminal 210 of the (n+1)th cartridge are connected with each other via the corresponding apparatus-side terminals 540 and 510. Also, the second overvoltage detection terminal 240 of the fourth cartridge IC4 is connected to the detection pulse generation unit 650 via the corresponding apparatus-side terminal 540. If all of the cartridges IC1-IC4 are attached properly within the cartridge attachment unit, the detection pulse generation unit 650 and the non-attached condition detection unit 670 get connected with each other via the overvoltage detection terminals 240 and 210 on the cartridges in sequence. On the other hand, if any cartridge is not attached or improperly attached, non-contact or poor contact occurs at either of the apparatus-side terminals 510 and 540 or any of the terminals 210 and 240 of the cartridges IC1-IC4, resulting in a condition of non-contact between the detection pulse generation unit 650 and the non-attached condition detection unit 670. Therefore, the non-attached condition detection unit 670 is able to detect whether there is any non-contact or poor contact condition at either of the overvoltage detection terminals in the cartridges IC1-IC4 depending on whether it receives a response signal DPres that correspond to an inspection signal DPins sent from the detection pulse generation unit 650. Thus, in the second embodiment, since the overvoltage detection terminals 240 and 210 of the cartridges are series-connected in series when all the cartridges IC1-IC4 are attached in the cartridge attachment unit, it is possible to detect whether there is any non-contact or poor contact condition at any of the overvoltage detection terminals 210 and 240 in the cartridges IC1-IC4 by inspecting the contact conditions. A typical situation where such non-contact or poor contact condition occurs is when one or more cartridges are not attached. Therefore, the non-attached condition detection unit 670 is able to detect immediately whether one or more cartridges are not attached depending on whether it receives a response signal DPres corresponding to an inspection signal DPins. The inspection signal DPins may be generated based on the voltage supplied from the first power supply VDD.

The first overvoltage detection terminals 210 of the four cartridges IC1-IC4 are also connected to anode terminals of diodes 641-644 via the corresponding apparatus-side terminals 510. Also, the second overvoltage detection terminals 240 of the four cartridges IC1-IC4 are connected to anode terminals of diodes 642-645 via the corresponding apparatus-side terminals 540. Meanwhile, the anode terminal of the second diode 642 is connected in common to the second overvoltage detection terminal 240 of the first cartridge IC1 and the first overvoltage detection terminal 210 of the second cartridge IC2. Equally, the diodes 643 and 644 are each connected in common to the first overvoltage detection terminal 210 of a cartridge and to the second overvoltage detection terminal 240 of an adjacent cartridge. Cathode terminals of these diodes 641-645 are connected in parallel to the overvoltage detection unit 620. These diodes 641-645 are used to monitor any abnormally high voltage to the overvoltage detection terminals 210 and 240. Such an abnormally high voltage (called "overvoltage") occurs when unintended shorting occurs between either of the overvoltage detection terminals 210 and 240 in each cartridge and either of the sensor terminals 250 and 290. For example, if foreign matters such as ink droplets or dust are attached to the surface of the board 200 (FIG. 3A), unintended shorting may possibly occur between the first overvoltage detection terminal 210 and first sensor terminal 250, or between the second overvoltage detection terminal 240 and second sensor terminal 290. Once any such unintended shorting occurs, a current flows in the overvoltage detection unit 620 via one of the diodes 641-645 so that the overvoltage detection unit 620 can detect that a voltage higher than a predetermined value (overvoltage) is applied to an overvoltage terminal, and that the overvoltage detection unit 620 can detect any generation of overvoltage or unintended shorting. Also, foreign matters that cause unintended shorting generally tend to come from the top down of the board 200, and from the outside inward. Therefore, if the contact portions of the overvoltage detection terminals 210 and 240 are arranged at both ends of the contact portions aligned in the upper row R1 of the board 200 (FIG. 3A), the overvoltage detection terminals 210 and 240 are placed near the sensor terminals 250 and 290, which allows to reduce the risk that the high voltage applied to the sensor terminals 250 and 290 are also applied to the memory terminals 200, 230, 260, 270 or 280.

Figure 11:
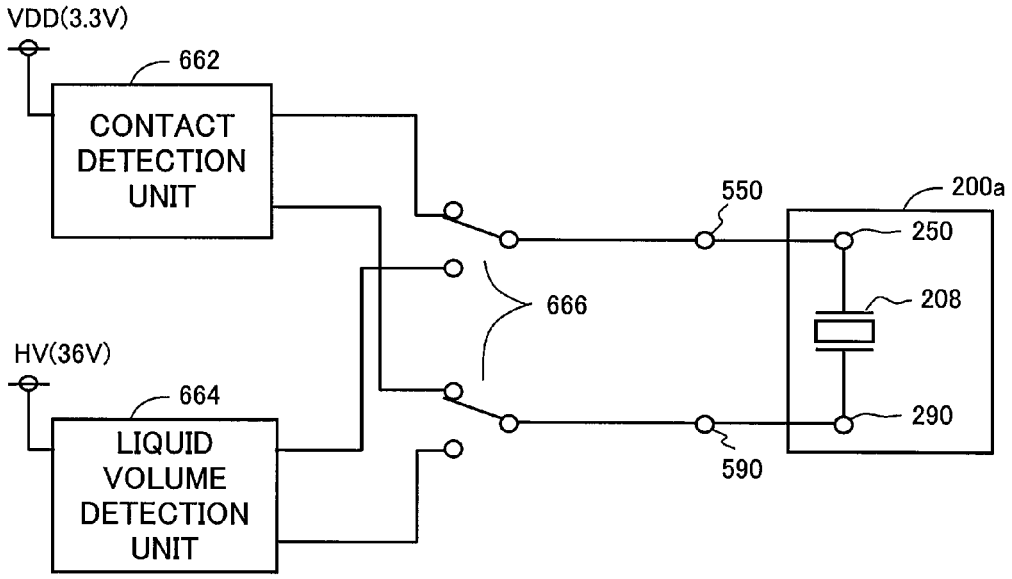
FIG. 11 is a block diagram showing the condition of contact between the contact detection unit as well as liquid volume detection unit and the cartridge sensor.

FIG. 11 is a block diagram showing the condition of contact between the cartridge sensor 208 and the contact detection unit 662 as well as the liquid volume detection unit 664. The sensor 208 is connected selectively either to the contact detection unit 662 or liquid volume detection unit 664 via a selector switch 666. In the situation where the sensor 208 is connected to the contact detection unit 662, the contact detection unit 662 detects a good or poor contact between the sensor terminals 250, 290 and the corresponding apparatus-side terminals 550, 590. On the other hand, in the situation where the sensor 208 is connected to the liquid volume detection unit 664, the liquid volume detection unit 664 detects the remaining amount of ink within the cartridge to find out if it is no less than a prescribed amount. The contact detection unit 662 operates under a comparatively low power supply voltage VDD (e.g. 3.3V). On the contrary, the liquid volume detection unit 664 operates under a comparatively high power voltage HV (e.g. 36V).

The contact detection unit 662 and liquid volume detection unit 664 may be provide individually per each cartridge, or a set of one contact detection unit 662 and one liquid volume detection unit 664 may be provided commonly in each set of plural cartridges. In the latter case, a selection switch is additionally provided to switch the connection between the sensor terminals 250 and 290 in each cartridge and the contact detection unit 662 as well as the liquid volume detection unit 664.

Figure 12:
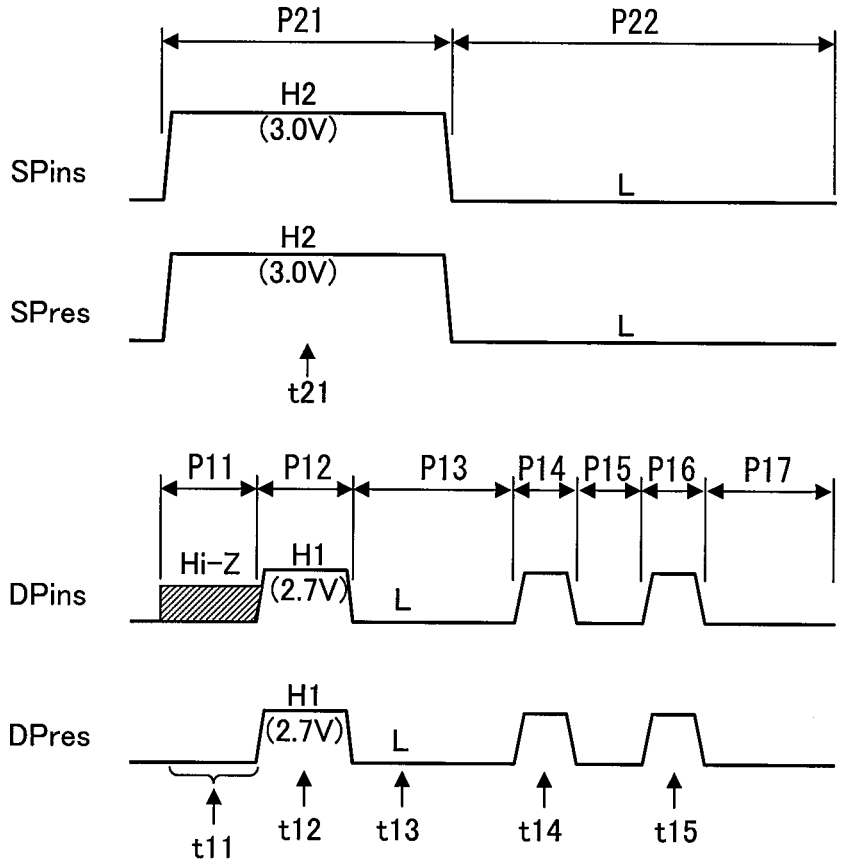
FIG. 12 is a timing chart showing various signals used for the attachment detection process.

FIG. 12 is a set of timing charts showing various signals used for the attachment detection process (also called "contact detection process") of the cartridge according to the second embodiment. In the attachment detection process of the cartridge, the first attachment detection signals DPins and DPres as well as the second attachment detection signals SPins and SPres are used. Here, the signals DPins and SPins with a suffix "ins" are signals outputted from the sensor-related-processing circuit 503 to the cartridge's board 200 and are called "attachment inspection signals." Also, the signals DPres and SPres with a suffix "res" are signals inputted to the sensor-related-processing circuit 503 from the cartridge's board 200 and are called "attachment response signals."

As described below, the following three kinds of attachment detection processes are performed in the second embodiment:

(1) First attachment detection process: Detection of non-attached conditions of one or more cartridges using the first attachment detection signals DPins and DPres (detection of contact conditions of the overvoltage detection terminals 210 and 240 of all cartridges).

(2) Second attachment detection process: Detection of contact conditions of the sensor terminals 250 and 290 in each cartridge using the second attachment detection signals SPins and SPres.

(3) Leak detection process: Detection of a leak between the terminals 210 and 250 as well as between the terminals 240 and 290 using the first attachment detection signals DPins and DPres.

Since contact conditions of the terminals are detected in the first and second attachment detection processes, it is possible to call these processes "contact detection processes." Also, the first and second attachment detection signals may be called "the first contact detection signals DPins, DPres" and "the second contact detection signals SPins, SPres."

The second attachment detection signals SPins and SPres are used by the contact detection unit 662 to detect contact conditions of the sensor terminals 250 and 290 in each cartridge. As shown in FIG. 10, the second attachment detection signal SPins is supplied from the contact detection unit 662 to one sensor terminal 290, whereas the second attachment response signal SPres returns to the contact detection unit 662 from the other sensor terminal 250. The second contact detection signal SPins turns to a high level H2 during the first period P21 in FIG. 12 and later turns to a low level during the second period P22. Here, the high level voltage H2 of the second attachment inspection signal SPins is set at 3.0V for example. When the terminals 250 and 290 are both in normal contact, the second attachment response signal SPres shows the same pattern of level changes as the second attachment inspection signal SPins.

As shown in FIG. 10, the first attachment inspection signal DPins is supplied from the detection pulse generation unit 650 to the overvoltage detection terminal 240 of the fourth cartridge IC4, whereas the first attachment response signal DPres is inputted to the non-attached condition detection unit 670 from the overvoltage detection terminal 210 of the first cartridge IC1. As shown in FIG. 12, the first attachment inspection signal DPins is divided into 7 periods P11-P17. That is, the first attachment inspection signal DPins goes into a high impedance condition during the period P11, and turns to a high level H1 during the periods P12, P14 and P16, and turns to a low level in other periods P13, P15 and P17. The high level voltage H1 of the first attachment inspection signal DPins is set at 2.7V, which is different from the high level H2 (3.0V) of the second attachment detection signal SPins. Meanwhile, The first and second periods P11 and P12 of the first attachment inspection signal DPins overlap part of the first period P21 of the second attachment inspection signal SPins. Also, the fourth to seventh periods P14-P17 of the first attachment inspection signal DPins overlap part of the second period P22 of the second attachment inspection signal SPins. When the terminals 210 and 240 of all cartridges are in normal contact, the first attachment response signal DPres turns to a low level during the first period P11 showing the same pattern of levels as the first attachment inspection signal DPins during the second period P12 and thereafter. The reason why the first attachment response signal DPres turns to a low level during the first period P11 is that the first attachment response signal DPres (i.e. the wiring 651 that inputs to the non-attached condition detection unit 670) is at a low level immediately prior to the first period P11.

The voltage of the high level H1 of the first attachment inspection signal DPins is preferably lower than the overvoltage (threshold value of overvoltage) which is applied to the overvoltage detection terminals 210 and 240, and which is detected by the overvoltage detection unit 620. This is for preventing any risk of erroneously judging the situation as overvoltage during the process of attachment detection using the first attachment inspection signal DPins. As the overvoltage value to be detected, 3.0V is used for example. In the circuit diagram of FIG. 10, the overvoltage applied to the terminal 210 of the first cartridge IC1, for example, is inputted to the overvoltage detection unit 620 via the diode 641. Therefore, the threshold value used by the overvoltage detection unit 620 is the overvoltage value to be detected (e.g. 3.0V) less a voltage drop of the diode 641 (e.g. 0.7V), resulting in 2.3V, for example. In this specification, the word "threshold value of overvoltage" may be used to denote the voltage applied to the terminal 210 or 240 when an overvoltage at either of them is detected by the overvoltage detection unit 620.

Figure 13A:
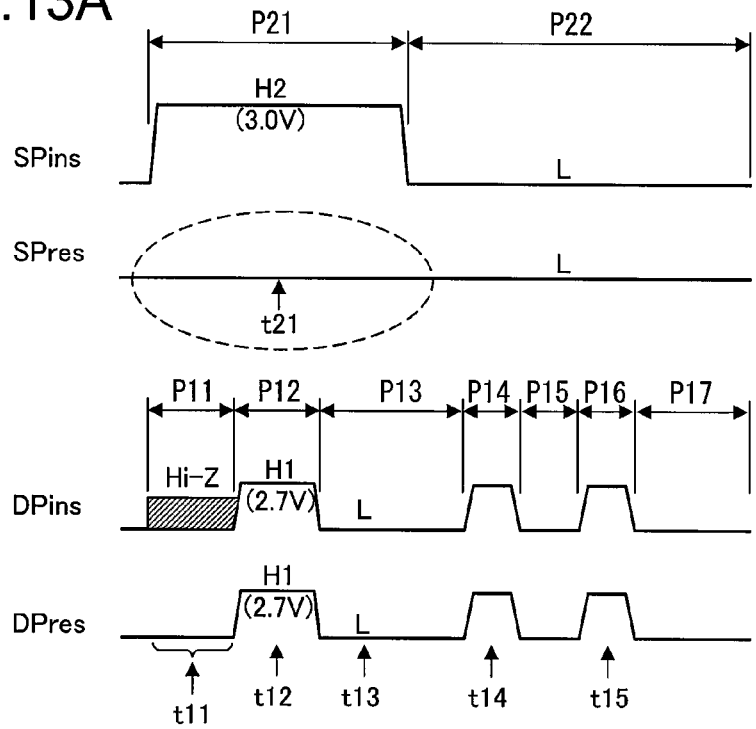
FIGS. 13A and 13B are timing charts showing typical signal waveforms in case of poor contact.

FIG. 13A shows signal waveforms when at least one of the terminals 250 and 290 is in poor contact. In this case, the second attachment response signal SPres turns to a low level throughout the periods P21 and P22. The contact detection unit 662 is able to detect the contact conditions of the terminals 250 and 290, whether they are good or poor, by examining the level of the attachment response signal SPres at a prescribed timing t21 during the period P21. If any cartridge with poor contact at the terminal 250 or 290 is detected, the main control circuit 400 may preferably display information (by words or images) on the display panel 430 to notify the user of a poor attachment condition of the cartridge.

Figure 13B:
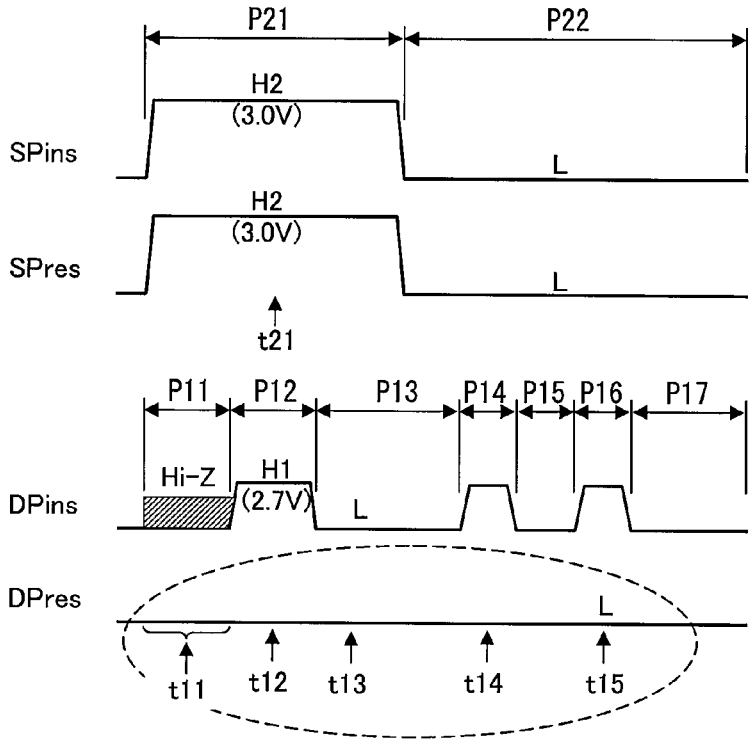

FIG. 13B shows waveforms when at least one of the terminals 210 and 249 in all cartridges is in poor contact. In this case, the first attachment response signal DPres turns to a low level throughout the periods P11-P17. Therefore, the non-attached condition detection unit 670 is able to detect conditions where one or more cartridges are not attached normally by examining the level of the first attachment response signal DPres at prescribed timings t12, t14 and t15 during the periods P12, P14 and P16 when the first attachment inspection signal DPins turns to a high level. By the way, it is enough to conduct this evaluation at one of the three timings t12, t14 and t15. When it is judged that one or more cartridges are not attached normally, the main control circuit 400 ma preferably display information (by words or images) on the display panel 430 to notify the user of a poor attachment condition of the cartridges.

The first attachment inspection signal DPins may be a simple pulse signal similar to the second attachment inspection signal Spins if the first attachment inspection signal DPins is used only for the purpose of the above non-attached condition detection process (first attachment detection process). The main reason why the first attachment inspection signal DPins has complicated waveforms as shown in FIG. 12 is due to the detection of a leaking condition (third attachment detection process) explained below.

Figure 14A:
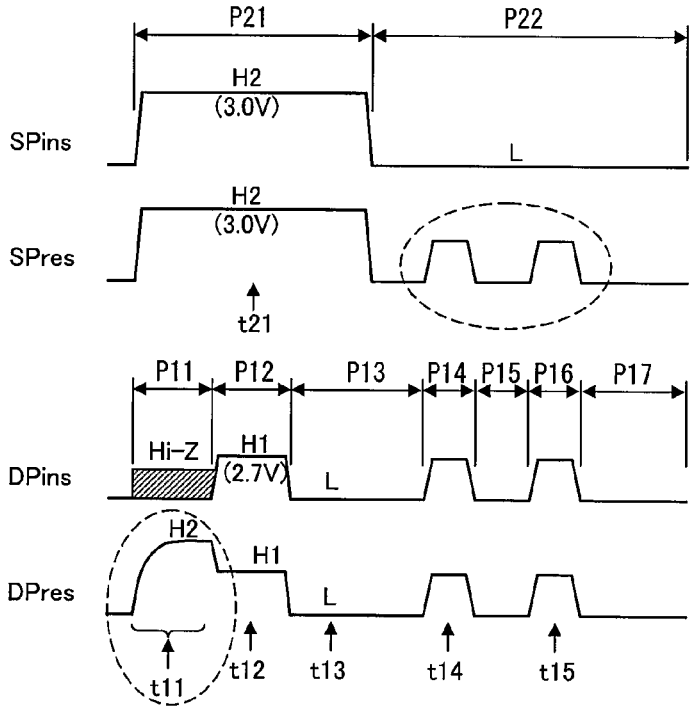
FIGS. 14A and 14B are timing charts showing typical signal waveforms when the overvoltage detection terminals and the sensor terminals are in a leaking condition.

FIG. 14A shows signal waveforms when there is a leaking condition between the overvoltage detection terminal 240 and sensor terminal 290. Here, the word "leaking condition" means a connected condition with a resistance value at some level or lower (e.g. 10 kΩ or less) but not at an extremely low level that may be seen as unintended shorting. In this case, the first attachment response signal DPres shows a particular signal waveform. In other words, the first attachment response signal DPres rises up from a low level to the second high level H2 during the first period P11, and then drops down to the first high level H1 during the second period P12. The second high level H2 is approximately the same voltage as the high level H2 of the second attachment inspection signal SPins. This kind of waveform is understandable in light of the equivalent circuit explained below.

Figure 15A:
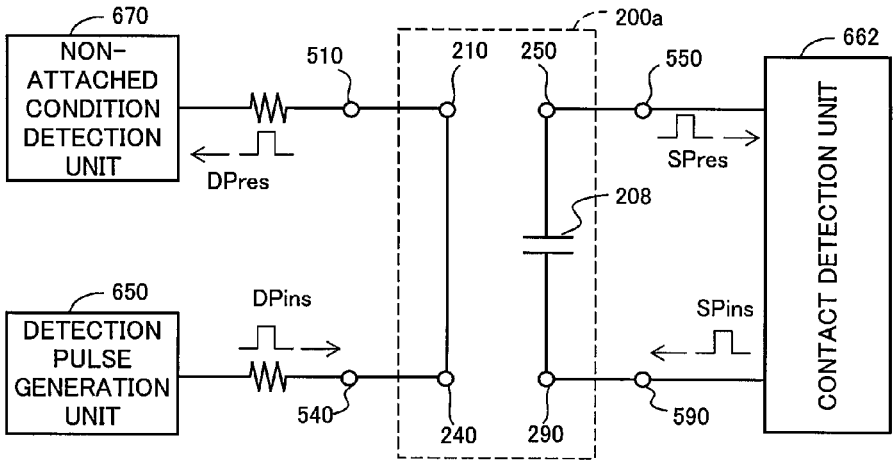
FIGS. 15A-15C show the conditions of contact among the circuit board, contact detection unit, detection pulse generator, and non-attached condition detection unit.
Figure 15B:
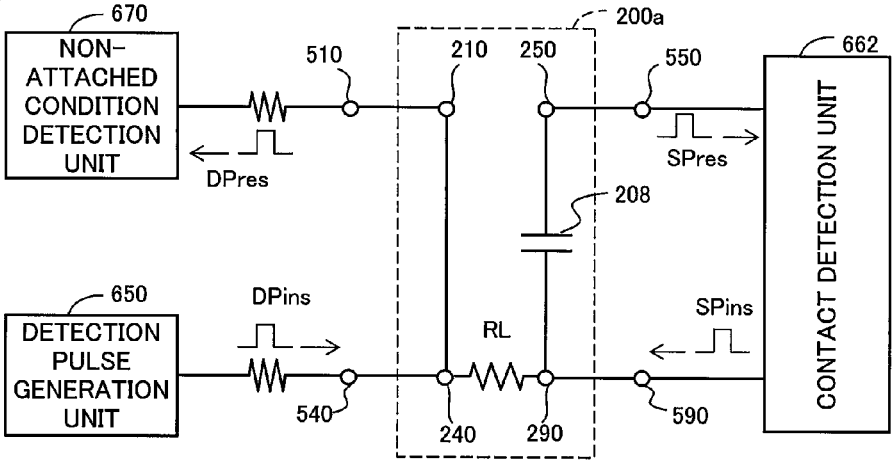

FIG. 15A shows connection relations among the board 200*a*, contact detection unit 662, detection pulse generation unit 650 and the non-attached condition detection unit 670. This situation is the one with no leak between adjacent terminals. FIG. 15B shows an equivalent circuit with a leak between the terminals 240 and 290. Here, the leaking condition between the terminals 240 and 290 is simulated by a resistance RL. The sensor 208 bears a function as a capacitative element. The circuit containing the capacitor of the sensor 208 in FIG. 15B and the resistance RL between the terminals 240 and 290 functions as a low-pass filter circuit (integrating circuit) against the second attachment inspection signal SPins. Therefore, the first attachment response signal DPres inputted to the non-attached condition detection unit 670 becomes a signal that gradually rises to the high level H2 (approx. 3V) of the second attachment inspection signal SPins, as shown in FIG. 14A. The non-attached condition detection unit 670 is able to identify a leak between the terminals 240 and 290 by examining the voltage of the first attachment response signal DPres at one or more (preferably plural) timings t11 during the period P11. Alternatively, it is possible to detect a leak between the terminals 240 and 290 from the difference of voltages at the high levels H1 and H2 of the first attachment response signal DPres during the periods P11 and P12.

The variation pattern of the first attachment response signal DPres during the first period P11 shown in FIG. 14A may be obtained when the voltage of the first attachment inspection signal DPins during the period P11 is set at a lower level than the second high level H2. Therefore, it may be possible to detect a condition of leak between the terminals 240 and 290, for example by maintaining the first attachment inspection signal DPins at a low level during the period 21. Also, the first attachment inspection signal DPins may be kept at a low level throughout the periods P11-P13.

When there is a leak between the terminals 240 and 290, the second attachment response signal SPres also shows a particular variation pattern. That is, the second attachment response signal SPres rises up in response to the rising of the first attachment inspection signal DPins to a high level during the periods P14 and P16. Therefore, occurrence of a leak may also be detected by examining the second attachment response signal SPres at given timings t14 and t15 during these periods P14 and P16.

Figure 14B:
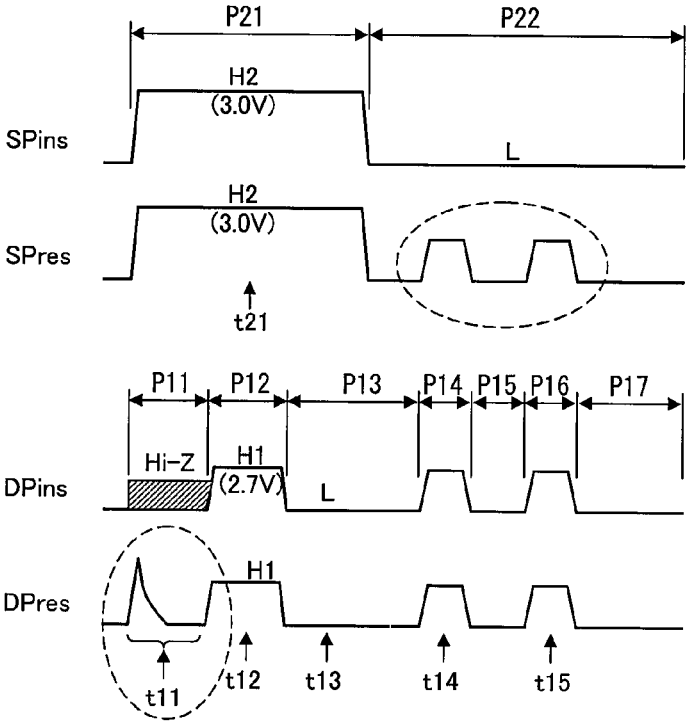

FIG. 14B shows signal waveforms when another overvoltage detection terminal 210 and the sensor terminal 250 are in a leaking condition. Also in this case, the first attachment response signal DPres shows a particular waveform. That is, the first attachment response signal DPres drops down rather gradually after rapidly rising up from a low level during the first period P11. The peak voltage level during this period is higher than the high level H1 of the first attachment inspection signal DPins, reaching near the high level H2 of the second attachment inspection signal SPins.

Figure 15C:
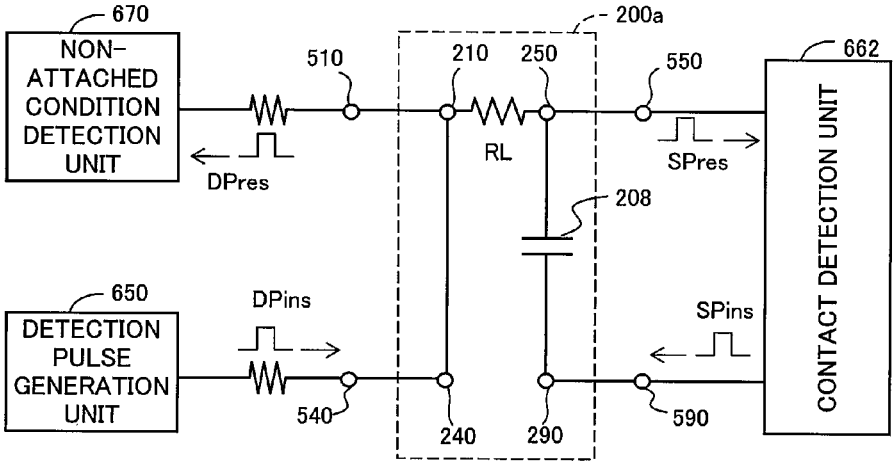

FIG. 15C shows an equivalent circuit with a leak between the terminals 210 and 250. Here, the leaking condition between the terminals 210 and 250 is simulated by a resistance RL. The circuit containing the capacitor of the sensor 208 and the resistance RL between the terminals 210 and 250 functions as a high-pass filter circuit (differentiating circuit) against the first attachment inspection signal SPins. Therefore, the first attachment response signal DPres becomes a signal that exhibits a peak during the first period P11 as shown in FIG. 14B. However, the first attachment response signal DPres shows the same variation pattern as the first attachment inspection signal DPins during the second period P12 and thereafter. The non-attached condition detection unit 670 is able to identify a leak between the terminals 210 and 250 by examining the voltage level of the first attachment response signal DPres at one or more timings t11 during the period P11. Meanwhile, comparing the circuit having a leak between the terminals 240 and 290 (FIG. 14A) and the one having a leak between the terminals 210 and 250 (FIG. 14B), the relation between the voltage level of the signal DPres at the timing during the latter half of the first period P11 and that of the signal DPres during the second period P12 is inverted. Therefore, it is possible to accurately identify whether the leak exists between the terminals 240 and 290 or between 210 and 250 by comparing the voltage levels of the signal DPres at these two timings.

The variation pattern of the first attachment response signal DPres as shown in FIG. 14B is obtained when the output terminal (i.e. output terminal of the detection pulse generation unit 650) of the first attachment inspection signal DPins is set in a high impedance condition during the period P11. Therefore, it is possible to detect a leaking condition between the terminals 210 and 250 even if the first attachment inspection signal DPins is set at a low level during the periods P12 and P13, as far as the first attachment inspection signal DPins is set in a high impedance condition during the period P11, for example.

The second attachment response signal SPres also shows a particular variation pattern when there is a leak between the terminals 210 and 250. That is, the second attachment response signal SPres rises up in response to the rise in the first attachment inspection signal DPins to a high level during the periods P14 and P16. Therefore, it is also possible to detect a leak by examining the second attachment response signal SPres at given timings t14 and t15 during these periods P14 and P16. However, the variation pattern of the second attachment response signal SPres is not much different between the circuit having a leak between the terminals 240 and 290 (FIG. 14A) and the one having a leak between the terminals 210 and 250 (FIG. 14B). Therefore, inspections of the second attachment response signal SPres at the timings t14 and t15 cannot identify which of those two pairs of terminals is experiencing a leak. However, if there is no need for such identification, inspections of the second attachment response signal SPres are good enough.

As seen from the above descriptions of FIGS. 12 through 14B, it is possible to detect any leaking condition between adjacent terminals by examining at least one of the two attachment response signals SPres and DPres.

Figure 16A:
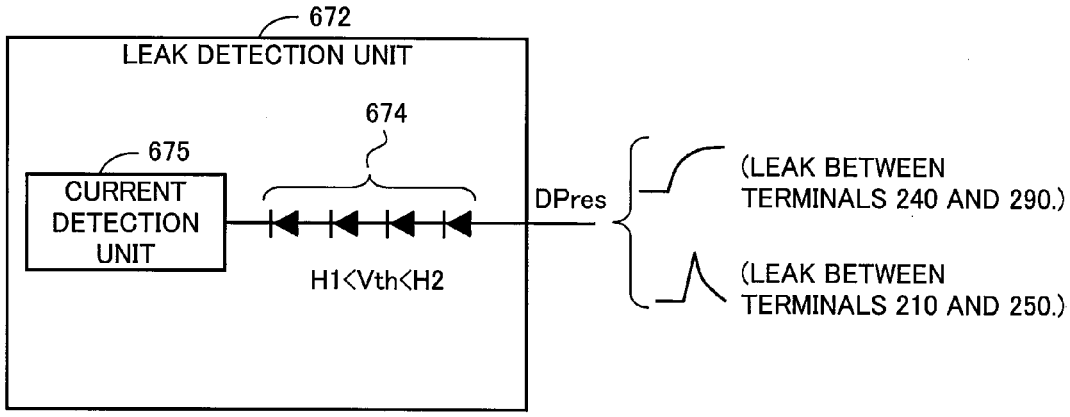
FIGS. 16A and 16B are block diagrams showing configuration examples of the leak detection unit placed within the non-attached condition detection unit.
Figure 16B:
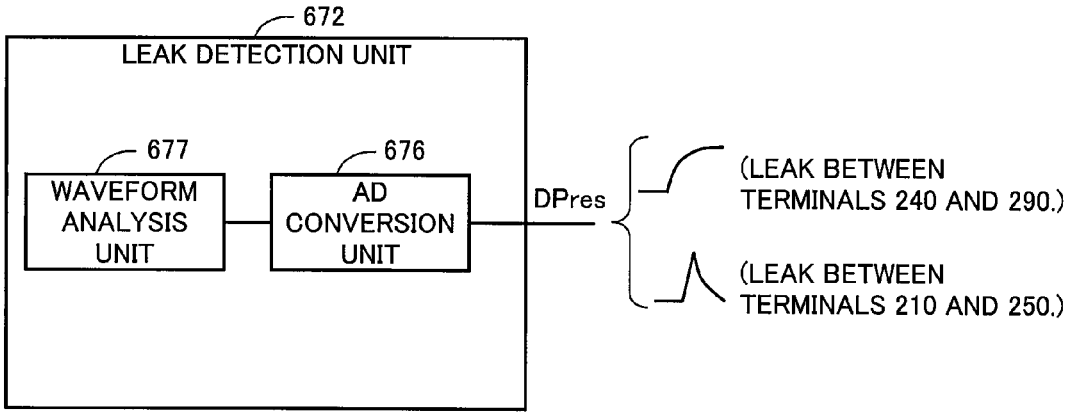

FIGS. 16A and 16B are block diagrams showing examples of leak detection unit configurations usable for evaluating the leaking conditions shown in FIGS. 15B and 15C. The leak detection unit may be installed within the non-attached condition detection unit 670. The leak detection unit 672 of FIG. 16A includes a voltage barrier 674 composed of series-connected plural diodes and a current detection unit 675. The threshold voltage Vth of the voltage barrier 674 is preferably set at a level lower than the high level H2 of the second attachment inspection signal SPins and higher than the high level H1 of the first attachment inspection signal DPins. Accordingly, when the voltage level of the first attachment response signal DPres reaches or exceeds the first high level H1, a current flows from the voltage barrier 674 to the current detection unit 675. Consequently, it is possible to detect a leak at least either between the terminals 240 and 290 or between 210 and 250 depending on whether or not a current is inputted from the voltage barrier 674 during the period P11 in FIGS. 14A and 14B. However, this circuit cannot identify whether the leak is occurring between the terminals 240 and 290 or between 210 and 250.

The leak detection unit 672 of FIG. 16B includes an AD conversion unit 676 and a waveform analysis unit 677. In this circuit, variations of the first attachment response signal DPres are digitized at the AD conversion unit 676 to be supplied to the waveform analysis unit 677. The waveform analysis unit 677 is able to evaluate a leak condition by analyzing waveforms. For example, if the first attachment response signal DPres during the period P11 in FIGS. 14A and 14B is the one that has been through the low-pass filter (a curve gradually rising in an upward convex), it may be evaluated that there is a leak between the terminals 240 and 290. On the other hand, if the first attachment response signal DPres is the one that has been through the high-pass filter (a signal showing an acute peak), it may be evaluated that there is a leak between the terminals 210 and 250. The operating clock frequency of the AD conversion unit 676 is set at a level high enough to facilitate such waveform analyses. The waveform analysis unit 677 further determines the time constant of the first attachment response signal DPres which allows calculation of resistance and capacitance values of the equivalent circuit under a leaking condition. For example, in the equivalent circuit of FIGS. 15B and 15C, the only unknown value is the one of the resistance RL between the terminals having a leak, while other resistance values and the capacitance value of the capacitative element 208 are known. Therefore, it is possible to calculate the resistance RL between the terminals having a leak based on the time constant of the variation in the first attachment response signal DPres. Also, for the leak detection unit, various other circuit configurations other than the above may be adopted.

As seen from the above descriptions of FIGS. 12 through 16B, it is possible to evaluate whether there is a leak between the terminals 250 and 290 or between 210 and 240 by examining at least one of the following: (i) whether the first attachment response signal DPres is affected by the second attachment inspection signal SPins (DPres of FIGS. 14A and 14B); and (ii) whether the second attachment response signal SPres is affected by the first attachment inspection signal DPins (SPres of FIGS. 14A and 14B). As the two attachment inspection signals SPins and DPins, it is preferable to use signals with mutually different waveforms with varying voltage levels, instead of signals with a fixed voltage level (e.g. signals with their voltage level always at a low or high level). Here, it should be noted that the signal waveforms are simplified in FIGS. 12-14B.

When a leak is detected in at least one of the two overvoltage detection terminals 210 and 240, the location of the leak may be recorded in a non-volatile memory storage, which is not shown in the figure. This way, it is possible to take measures, in the maintenance work, to reduce the leaking by examining the likely locations of leaks around the terminals and adjusting contact portions of terminals and springs in the contact mechanism 1400 (FIG. 4B) within the printing apparatus.

Figure 17:
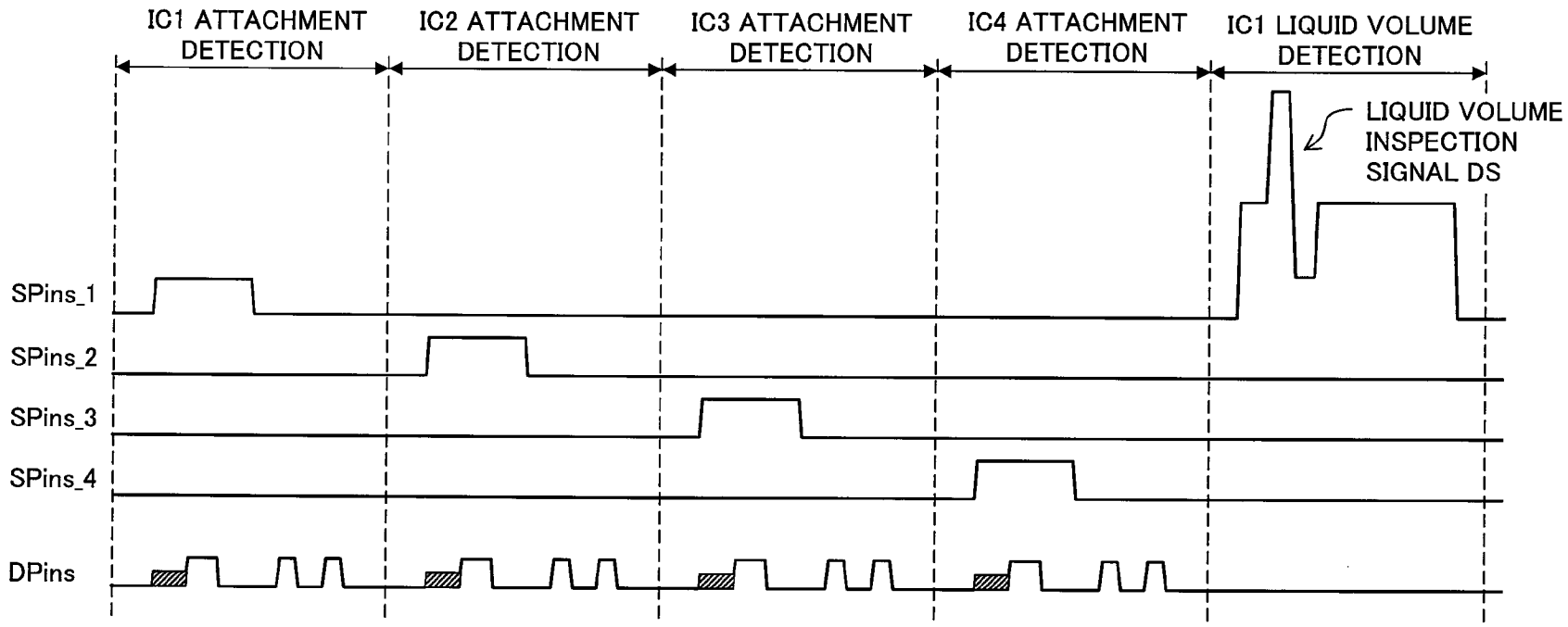
FIG. 17 is a timing chart showing attachment detection processes of four cartridges.

FIG. 17 is a timing chart showing attachment detection processes for the four cartridges IC1-IC4. The figure shows the second attachment inspection signal SPins_1-SPins_4 that are supplied individually to each cartridge and the first attachment inspection signal DPins that is supplied to the series-connected terminals 240 and 210 in all cartridges. Thus, attachment inspections on the four cartridges are conducted cartridge by cartridge in sequence, and as to each individual cartridge, the above-mentioned three kinds of attachment detection processes are carried out by having the first and second attachment inspection signals SPins and DPins supplied during the same period. In these inspections, if any attachment failure (contact failure) or leak is detected, it is preferable to advise the user to reattach the cartridge by indicating it on the display panel 430. On the contrary, if no attachment failure or leak is found as a result of attachment inspections, detection of the remaining amount of ink in each cartridge and data readings from the memory device 203 will follow.

Figure 18:
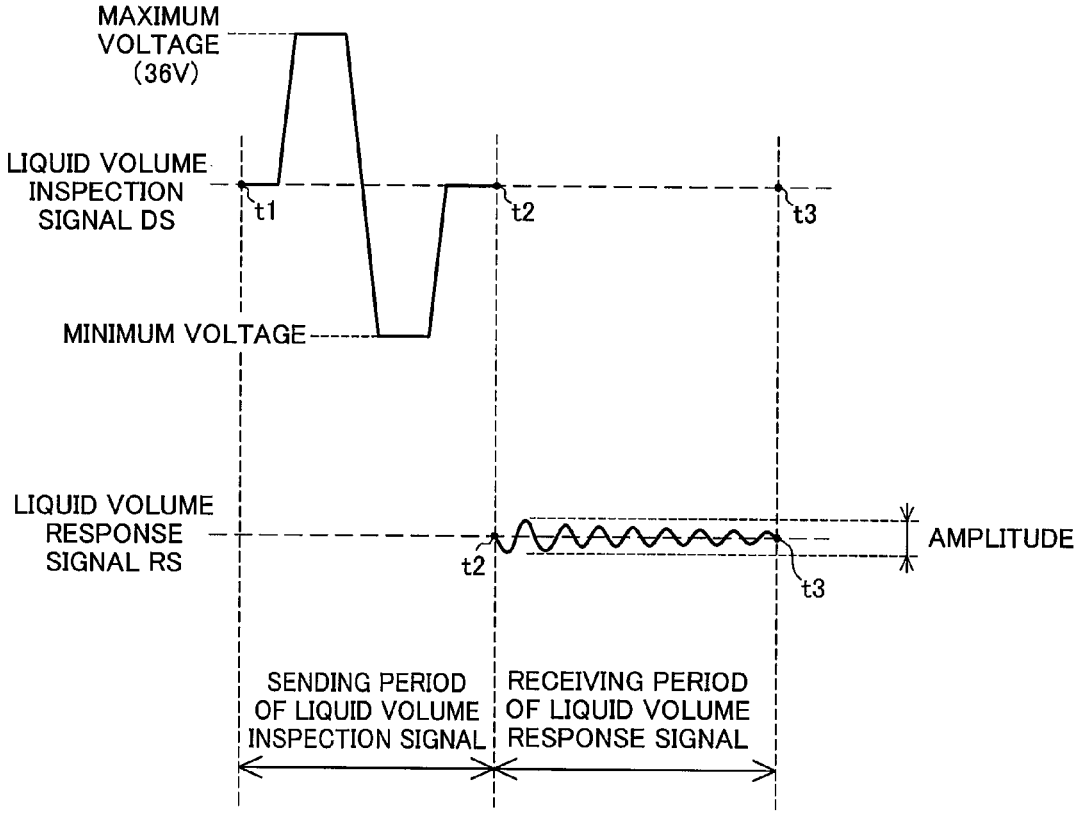
FIG. 18 is a timing chart of a liquid volume detection process.

FIG. 18 is a timing chart of a liquid volume detection process. In the liquid volume detection process, a liquid volume inspection signal is sent to one of the sensor terminals 290. This liquid volume inspection signal DS is in turn supplied to one of the electrodes of a piezo element composing the sensor 208. The liquid volume inspection signal DS is an analog signal generated by the liquid volume detection unit 664 (FIG. 10). The maximum voltage of this liquid volume inspection signal is approximately 36V for example, and the minimum voltage is approximately 4V. The piezo element of the sensor 208 oscillates in response to the remaining amount of ink within the cartridge 100, and the counter-electromotive voltage caused by the oscillation is sent as a liquid volume response signal RS from the piezo element to the liquid volume detection unit 664 via the other sensor terminal 250. The liquid volume response signal RS includes an oscillation component having a frequency that corresponds to the frequency of the piezo element. The liquid volume detection unit 664 is able to detect whether the remaining amount of ink is no less than a prescribed amount by measuring the frequency of the liquid volume response signal RS. This process of detecting the remaining amount of ink is a high-voltage process wherein a high-voltage signal DS is sent to the sensor 208 via the terminals 250 and 290 where the high-voltage signal DS has a higher voltage level than the first attachment inspection signal DPins used for the above-mentioned leak inspection (leak detection process) and the second attachment inspection signal SPins used for the individual attachment detection process.

Thus, during detection of the remaining amount of ink, a high-voltage liquid inspection signal DS is applied to the sensor terminals 250 and 290. Assuming that isolation between the sensor terminals 250, 290 and the overvoltage detection terminals 210, 240 is not sufficient, an abnormally high voltage (overvoltage) occurs at the terminals 210 and 240. In this case, since a current flows to the overvoltage detection unit 620 via the diodes 641-645 (FIG. 10), the overvoltage detection unit 620 is able to detect whether such an overvoltage occurred or not. Once an overvoltage is detected, a signal indicating the overvoltage generation is sent from the overvoltage detection unit 620 to the liquid volume detection unit 664, and in response to this, the liquid volume detection unit 664 immediately stops the output of the liquid volume inspection signal DS. The reason for this is to prevent any damage to the cartridge and printing apparatus that may be caused by overvoltage. In other words, if the isolation between the sensor terminal 250 (or 290) and the overvoltage detection terminal 210 (or 240) is insufficient, there is a risk of having insufficient isolation between the sensor terminal and the memory device terminal at the same time. In such a case, if an overvoltage occurs at the overvoltage detection terminal 210 or 240, the overvoltage is also applied to the memory device terminals, which may damage the circuitry of the memory device and printing apparatus connected to the memory device terminals. Therefore, it is possible to prevent such damages to the cartridge and printing apparatus caused by the overvoltage by immediately stopping the output of the liquid inspection signal DS upon detection of such an overvoltage.

As explained in FIGS. 12-17, plural kinds of attachment condition detection processes are carried out prior to the detection of the remaining amount of ink. Among others, in the leak detection process, a leaking condition with low resistance is detected between the terminals 240 and 290 or between 210 and 250, as explained in FIGS. 14A through 16B. That is, in these leak detection processes, it is possible to detect whether the connection between the terminals 240 and 290 or between 210 and 250 is in a low resistance not more than a certain value (e.g. 10 kΩ) by using the attachment inspection signals DPins and SPins at relatively low-voltage levels (approx. 3V). Also, if the detection process finds no leak between these terminals, the resistance value between the terminals 240 and 290 and that between 210 and 250 are ensured to be no less than the above-mentioned resistance value (approx. 10 kΩ). Accordingly, an overvoltage to the overvoltage detection terminals 210 or 240 would never take large values even if the process of detecting the remaining amount of ink is performed using a signal with higher voltage level (approx. 36V) after the process of detecting a leak condition. Thus, in the second embodiment, leak conditions between the terminals 240 and 290 or between 210 and 250 are inspected using signals with relatively low voltage levels, and as a result, signals with relatively high voltage levels are applied to the terminals 250 and 290 only when there is no leak. Therefore, it is possible to reduce the level of overvoltage that may occur in the printing apparatus and cartridge as compared to the situation where no inspection is conducted on leak conditions.

Figure 19A:
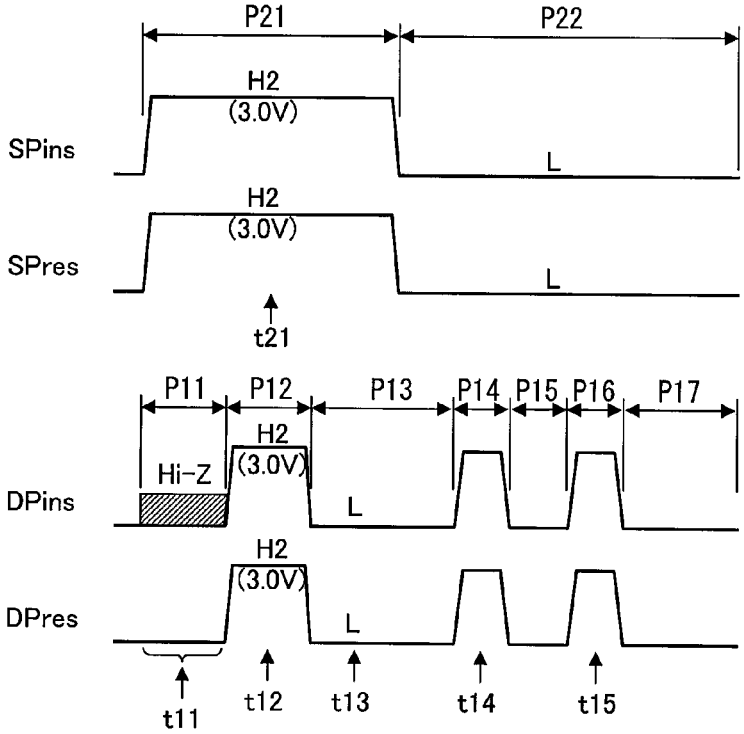
FIGS. 19A and 19B are timing charts showing other examples of signals used for the attachment detection processes.

FIG. 19A is a timing chart showing the first variation example of the signals to be used in the attachment detection process according to the second embodiment. The difference from FIG. 12 is that the high-level value of the first attachment inspection signal DPins is at the same level as the second attachment inspection signal SPins, and all the rest are the same as FIG. 12. Using these signals, it is possible to carry out various processes of attachment condition detection explained in FIGS. 13A through 16B in a similar manner. However, in this case, the level of the first attachment response signal DPres during the second period P12 in FIG. 14A becomes the same with the level H2 during the first period P11, and therefore, the level difference of the first attachment response signal DPres between the first and second periods P11 and P12 cannot conclude that there is a leak between the terminals 240 and 290. However, as shown in FIGS. 14A and 14B, it is still possible to identify whether the leak is occurring between the terminals 240 and 290 or between 210 and 250 judging from the level changes of the first attachment response signal DPres during the first period P11.

Figure 19B:
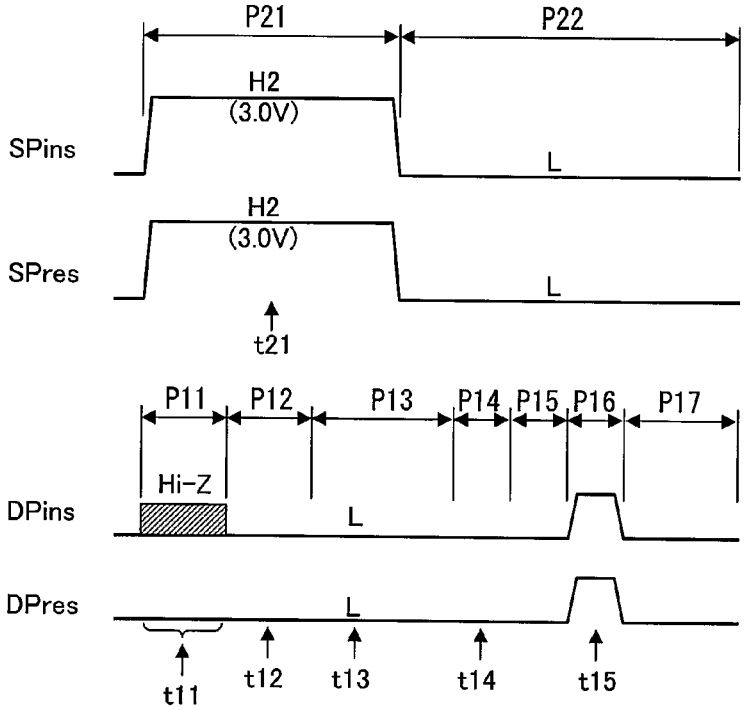

FIG. 19B is a timing chart showing the second variation example of the signals to be used in the attachment detection process according to the second embodiment. The difference from FIG. 12 is that the first attachment inspection signal DPins is set at a low level during the second and fourth periods P12 and P14, and accordingly, the first attachment response signal DPres is kept at a low level throughout the periods P11-P15, and all the rest is the same. Using these signals, it is possible to perform various attachment detections explained in FIGS. 13A through 16B in a similar way. In this case, no evaluation is available at the timings t12 and t14 of FIG. 13B, but evaluations at other timings explained in FIGS. 13A, 13B, 14A and 14B are still available.

As seen from various signals in FIGS. 12, 19A and 19B, the attachment inspection signals (contact detection signals) may have various voltage levels and waveforms. However, in order to detect a leak between the terminals 240 and 290 or between 210 and 250, the first attachment inspection signal DPins (or its signal line) is preferably shifted from a low level to a high-impedance state or kept at a low level when the second attachment detection signal SPins turns to a high level.

In the second embodiment, the attachment detection terminals 210 and 240 at both ends of the upper row R1 (and contact portions 210*cp* and 240*cp* thereof) on the board 200*a* (FIG. 8) constitute a first pair, whereas the attachment detection terminals 250 and 290 at both ends of the lower row R2 (and contact portions 250*cp* and 290*cp* thereof) constitute a second pair. The first attachment inspection signal DPins is inputted into one of the first pair of attachment detection terminals 210 and 240 from the control circuit of the printing apparatus, whereas the first attachment response signal DPres is outputted to the control circuit of the printing apparatus from the other terminal of the pair. The second attachment inspection signal SPins is inputted into one of the second pair of attachment detection terminals 240 and 290 from the control circuit of the printing apparatus, whereas the second attachment response signal SPres is outputted to the control circuit of the printing apparatus from the other terminal of the pair. Thus, two pairs of terminals (pairs of contact portions) are provided as attachment detection terminals, and at each terminal pair (contact portion pair), an attachment inspection signal is received via one of the pair from the printing apparatus, whereas an attachment response signal is outputted via the other terminal to the printing apparatus. Accordingly, since there is no need for using different terminals (or contact portions) other than these two pairs of terminals (pairs of contact portions) in order to perform attachment detection of the cartridge 100, it is possible to minimize the increase in the number of terminals on the board. Especially in this embodiment, the first pair of terminals 210 and 240 are used for detecting overvoltage (or shorting), while the second pair of terminals are used as sensor terminals (FIG. 8). Therefore, the effect of minimizing the increase in the number of terminals is noteworthy.

Also, in the second embodiment, the attachment inspection signal DPins used for the first pair of terminals 210 and 240 for attachment detection and the attachment inspection signal SPins used for the second pair of terminals 250 and 290 are pulse signals with timings different from each other. Here, a "pulse signal" denotes a binary signal that switches between a prescribed high level and a prescribed low level. However, a high-level and low-level voltages of pulse signals may be set at any values per each kind of pulse signal. In the example of FIG. 12, the first attachment inspection signal DPins and the second attachment inspection signal SPins are pulse signals that rise and drop in different timings from each other. By means of applying pulse signals different in timing from each other to the attachment inspection signals DPins and SPins used for the two pairs of terminals, it is possible to reduce a risk of erroneously judging a situation of poor attachment as good. For example, in a situation where the cartridge 100 is not fully attached, there is a possibility that the two leftmost attachment detection terminals 210 and 250 in FIG. 8 get connected with each other by an apparatus-side terminal, and the two rightmost attachment detection terminals 240 and 290 get connected with each other by another apparatus-side terminal. In that case, assuming that pulse signals with the same timings are used for the attachment inspection signals DPins and SPins for the two pairs of terminals, the attachment response signals DPres and SPres are generated in the right timings so that the system may erroneously judge the situation as having the cartridge properly attached. On the other hand, a risk of such misjudgment may be reduced, if pulse signals with different timings from each other are used as attachment inspection signals DPins and SPins for the two pairs of terminals, as in the second embodiment. Meanwhile, almost the same effects may be obtained by adopting pulse signals with different voltage levels instead of different timings from each other as the attachment inspection signals DPins and SPins used for the two pairs of terminals. Therefore, as attachment inspection signals DPins and SPins used for the two pairs of terminals, it is preferable to use pulse signals different from each other, at least in either the timings (especially the rise timings) or voltage levels.

As described above, in the second embodiment, as in the first embodiment, contact portions of the attachment detection terminals are provided at four corners around contact portions of the plural memory device terminals on the board, more specifically, they are provided outside an area within which plural memory device terminals of the board are placed, and at the same time, at four corners of the quadrangular area encompassing such area, which makes it possible to maintain good contact conditions concerning the memory device terminals by confirming good contact between these attachment detection terminals and the corresponding apparatus-side terminals. Also, in the second embodiment, the attachment detection process to detect whether all cartridges are attached and the leak detection process to detect whether there is any leak between the terminals may be performed simultaneously by examining at least either of the second attachment response signal SPres concerning a pair of terminals 250 and 290 on the board or the first attachment response signal DPres concerning another pair of terminals 210 and 240. Furthermore, in the second embodiment, the above leaking condition detection process is performed using a relatively low voltage (approx. 3V) prior to the high-voltage process that applies a high voltage (approx. 36V) against the terminals 250 and 290, which may prevent an extremely high overvoltage from leaking from the terminals 250 and 290 to inflict damages to the cartridge and printing apparatus.

Also, in the second embodiment, the four attachment detection terminals 210, 240, 250 and 290 and contact portions cp thereof are not directly connected to the ground voltage. This configuration has an advantage of avoiding the risk of lowering the reliability of the system that would otherwise erroneously identify a non-attached cartridge as attached, as explained in the section of Related Art. Here, in the second embodiment, the attachment detection may not be possible if the attachment detection terminals 210, 240, 250 and 290 are connected in short circuit with the ground terminal 270 due to dirt or dust. In order to prevent such a condition, the ground terminal 270 is preferably placed at a position farthest from the attachment detection terminals 210, 240, 250 and 290 (i.e. at the center of the lower row R2).

Especially in the second embodiment, as to the pair of attachment detection terminals 210 and 240 in the first row R1, attachment detection is performed by inputting the first attachment inspection signal DPins to one of the terminals 210 and 240 as a first pulse signal and then examining the first attachment response signal DPres that is outputted in response from the other terminal. Also, as to the pair of attachment detection terminals 250 and 290 in the second row R2, attachment detection is performed by inputting the second attachment inspection signal SPins to one of the terminals 250 and 290 as a second pulse signal and then examining the second attachment response signal SPres that is outputted in response from the other terminal. Thus, since attachment detection on each pair of attachment detection terminals is performed by the use of pulse signals, it is possible to reduce a risk of misjudging attachment conditions as compared to the situation where attachment conditions are detected according to voltage levels of the attachment detection terminals on the printing apparatus side.

Additionally, in the second embodiment, the attachment detection terminals 210, 240, 250 and 290 (and contact portions thereof) are not connected to the memory device 203, and the operation of the memory device 203 does not use any signal via the attachment detection terminal 210, 240, 250 or 290. Assuming that attachment detection is performed by the use of terminals that are also used for operating logic circuits such as the memory device 203, even a right attachment condition may be misjudged as poor attachment if any of those logic circuits fails to function properly. In the second embodiment, it is possible to prevent such misjudgment because the attachment detection terminals are not used for operating the memory device 203.

C. Third Embodiment

Figure 20:
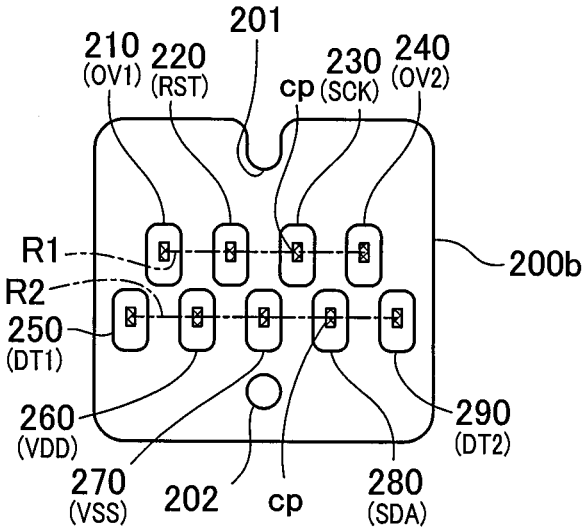
FIG. 20 shows a configuration of the circuit board according to the third embodiment.

FIG. 20 shows a configuration of the circuit board according to the third embodiment. The arrangement of the terminals 210-290 is the same as shown in FIG. 3A, except that functions or uses of various terminals are slightly different from those of the first and second embodiments as follows.

<Upper Row R1>

(1) Overvoltage detection terminal 210 (also used for attachment detection)

(2) Reset terminal 220

(3) Clock terminal 230

(4) Overvoltage detection terminal 240 (also used for attachment detection)

<Lower Row R1>

(5) Attachment detection terminal 250

(6) Power terminal 260

(7) Ground terminal 270

(8) Data terminal 280

(9) Attachment detection terminal 290

The functions and uses of the terminals 210-240 in the upper row R1 are more or less the same as those of the second embodiment. The difference from the second embodiment is that the terminals 250 and 290 of the lower row R2 are used to detect attachment conditions using a resistance element provided in the cartridge 100. As in the first and second embodiments, the contact portions of the terminals 210, 240 250 and 290 located at four corners of the contact area of the group of terminals 210-290 are used for attachment detection (contact detection). Moreover, in the third embodiment, the same voltage as the first power supply voltage VDD used for driving the memory device, or the voltage generated from the first power supply voltage VDD is applied to contact portions of the two terminals 210 and 240 placed at both ends of the upper row R1, whereas the same voltage as the second power supply voltage VHV used for driving the print head, or the voltage generated from the second power supply voltage VHV is applied to contact portions of the two terminals 250 and 290. As the "voltage generated from the first power supply voltage VDD," it is preferable to use a voltage that is lower than the first power supply voltage VDD (ordinarily 3.3V) but higher than the ground voltage, and more preferably, a voltage that is lower than an "overvoltage threshold value" which is applied to the terminal 210 or 240 when an overvoltage is detected by an overvoltage detection unit described later. As "the voltage generated by the second power supply voltage VHV," it is preferable to use a voltage higher than the first power supply voltage VDD and lower then the second power supply voltage VHV.

On the board 200*b* in FIG. 20, as is the case for the board 200 in FIG. 3A, contact portions of the four attachment detection terminals 210, 240, 250 and 290 are placed close at both ends of the upper base and bottom base of the trapezoidal area. Therefore, compared to the situation where those contact portions of the attachment detection terminals are placed at four corners of a rectangle, there is an advantage of a lower risk of misjudgments concerning the attachment conditions.

Figure 21:
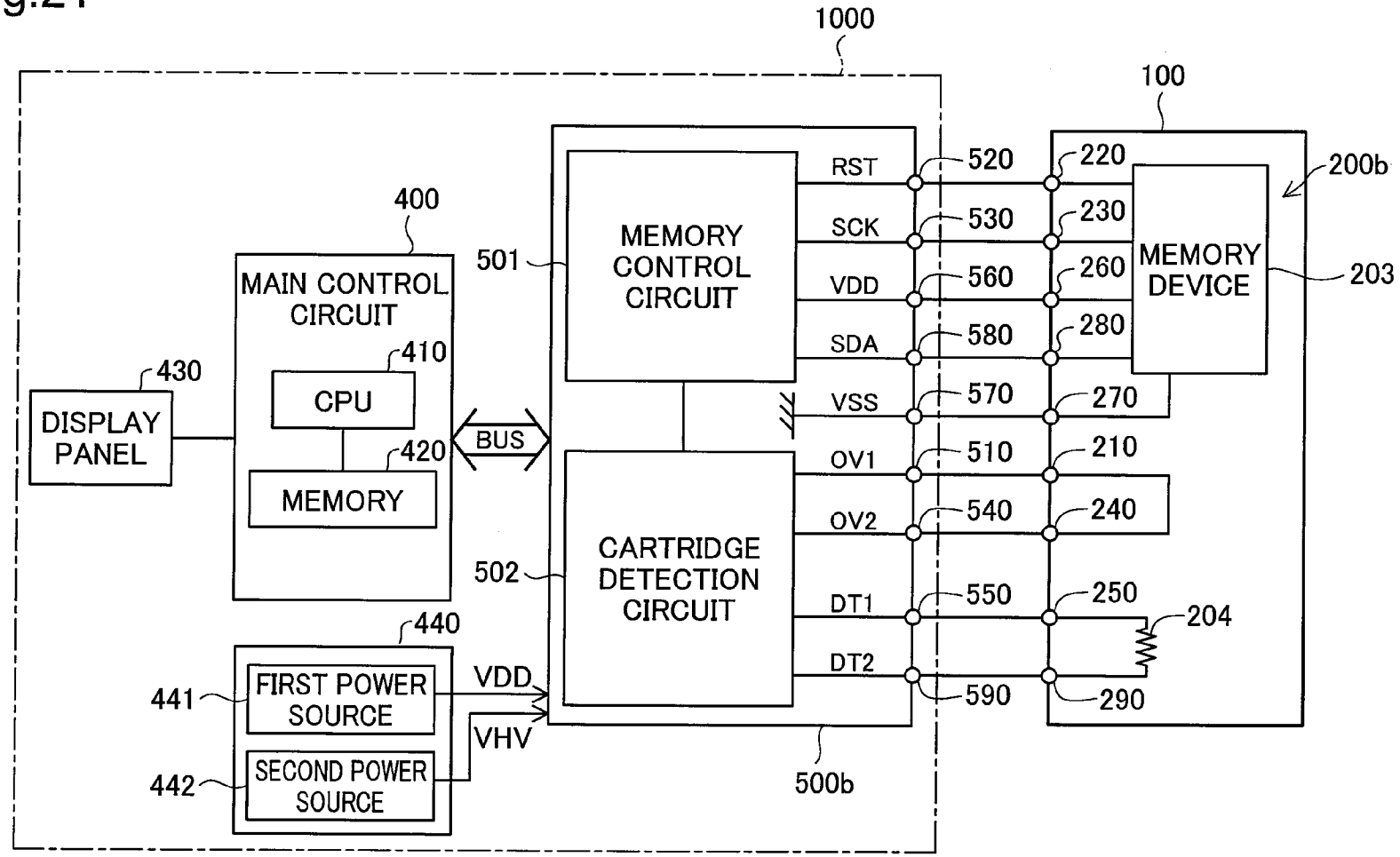
FIG. 21 is a block diagram showing an electrical configuration of the ink cartridge and printing apparatus according to the third embodiment.

FIG. 21 is a block diagram showing an electrical configuration of the board 200*b* of the ink cartridge and printing apparatus 1000 according to the third embodiment. The board 200*b* is equipped with a resistance element 204 used for attachment detection of individual cartridge in addition to a memory device 203 and nine terminals 210-290.

The main control circuit 400 includes, as in the first and second embodiments, a CPU 410 and a memory 420. The sub-control circuit 500*b* includes a memory control circuit 501 and a cartridge detection circuit 502.

The cartridge detection circuit 502 is used for detecting attachment conditions of each cartridge in the cartridge attachment unit 1100. Therefore, the cartridge detection circuit 502 may also be called an "attachment detection circuit." The cartridge detection circuit 502 and the resistance element 204 of the cartridge are high-voltage circuits that operate at a higher voltage (rated 42 V in this embodiment) than that of the memory device 203. The resistance element 204 is a device to which a high-voltage is applied from the cartridge detection circuit 502.

Figure 22:
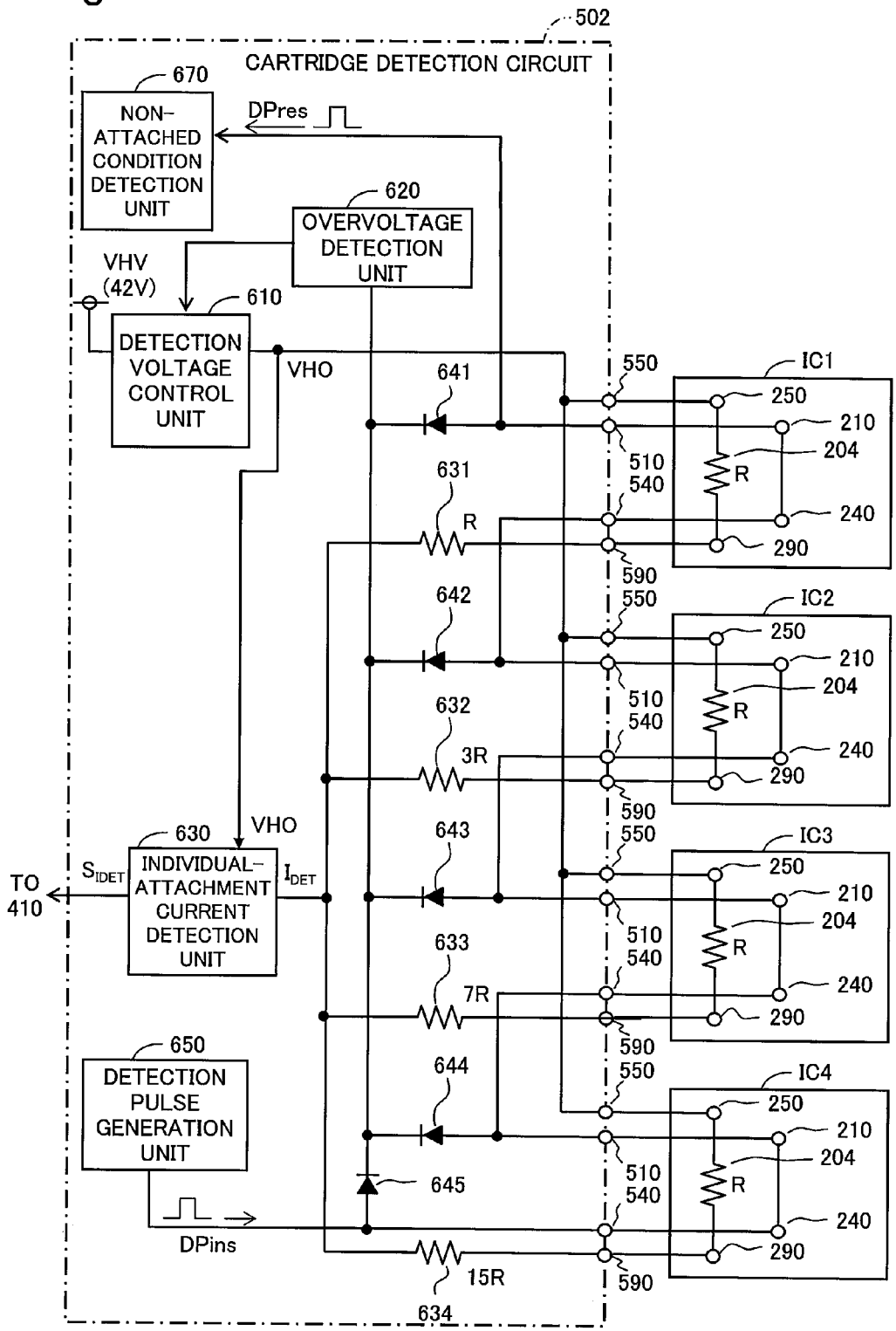
FIG. 22 shows an internal configuration of the cartridge detection circuit according to the third embodiment.

FIG. 22 is a diagram showing an internal configuration of the cartridge detection circuit 502 according to the third embodiment. The figure shows a situation where four cartridges 100 are attached to the cartridge attachment unit, and reference codes IC1-IC4 are used to identify each cartridge. The cartridge detection circuit 502 includes a detection voltage control unit 610, overvoltage detection unit 620, an individual-attachment current detection unit 630, a detection pulse generation unit 650, and a non-attached condition detection unit 670. Among these circuits, the overvoltage detection unit 620, detection pulse generation unit 650, and non-attached condition detection unit 670 have more or less the same configuration and functions as those circuits shown in FIG. 10. The detection voltage control unit 610 bears a function of controlling the voltage supplied to the cartridge terminal 250.

As waveforms of the attachment inspection signal DPins outputted from the detection pulse generation unit 650, any pulse signal other than those shown in FIG. 12, 19A or 19B may be used. However, the voltage of the high level H1 (e.g. 2.7V) of the attachment inspection signal DPins is preferably lower than the value of overvoltage applied to the overvoltage detection terminals 210 and 240 detected by the overvoltage detection unit 620 (or a threshold value for evaluating overvoltage, e.g. 3V). This is for preventing any instance of erroneously detecting overvoltage during an attachment detection process using the attachment inspection signal DPins.

A high power supply voltage VHV for attachment detection is supplied to the cartridge detection circuit 502. This high power supply voltage VHV is a voltage for driving the print head, and is supplied to the detection voltage control unit 610 from the second power source 442 (FIG. 21). The output terminal of the detection voltage control unit 610 is connected in parallel to the four apparatus-side terminals 550 provided at locations where the cartridges IC1-IC4 are to be attached. Here, the high power supply voltage VHV is also called "high voltage VHV." The voltage VHO of the output terminal of the detection voltage control unit 610 is also supplied to the individual-attachment current detection unit 630. This voltage VHO is substantially equal to the high power supply voltage VHV. Each apparatus-side terminal 550 is connected to the first attachment detection terminal 250 of the corresponding cartridge. Within each cartridge, a resistance element 204 is provided between the first and second attachment detection terminals 250 and 290. The resistance values of the resistance elements 204 of the four cartridges IC1-IC4 are set at the same value R. Within the cartridge detection circuit 502, resistance elements 631-634 that are connected in series with the resistance element 204 of each cartridge are provided.

Within each cartridge, the first and second overvoltage detection terminals 210 and 240 are in short-circuit connection by a wiring. Also, these overvoltage detection terminals 210 and 240 are connected to the overvoltage detection unit 620 via the diodes 641-645 provided in the cartridge detection circuit 502. The functions and the connection relation with the overvoltage detection unit 620 of these terminals 210, 240, 510, 540 and diodes 641-645 are the same as explained in the second embodiment (FIG. 10).

Figure 23A:
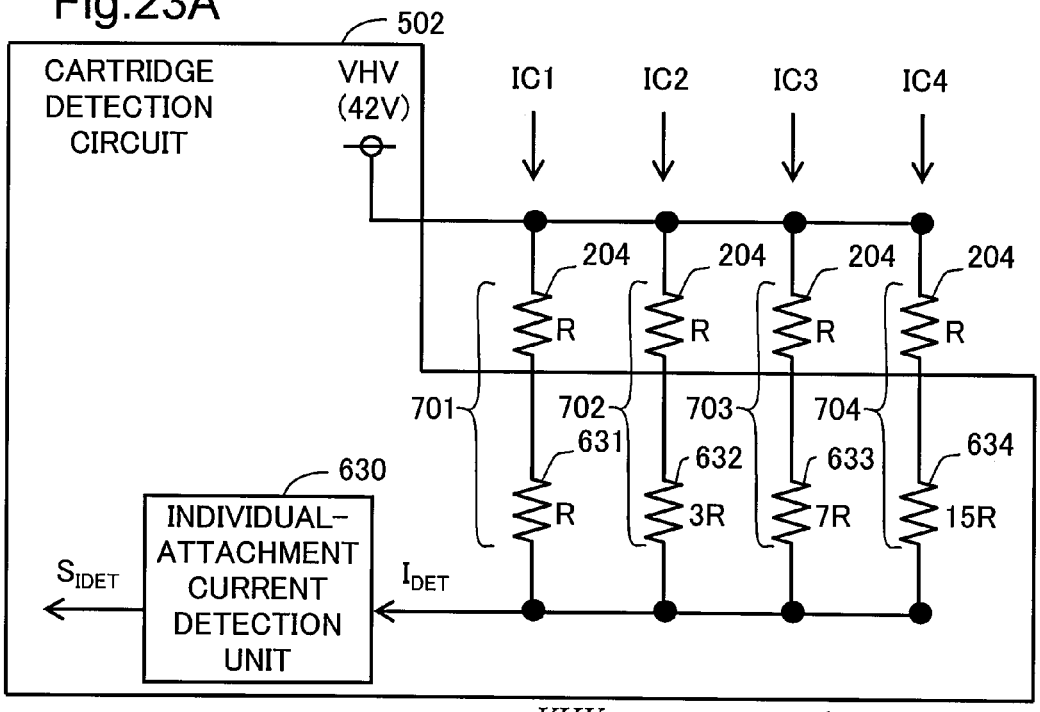
FIGS. 23A-23D show details of the cartridge's attachment detection process according to the third embodiment.
Figure 23B:
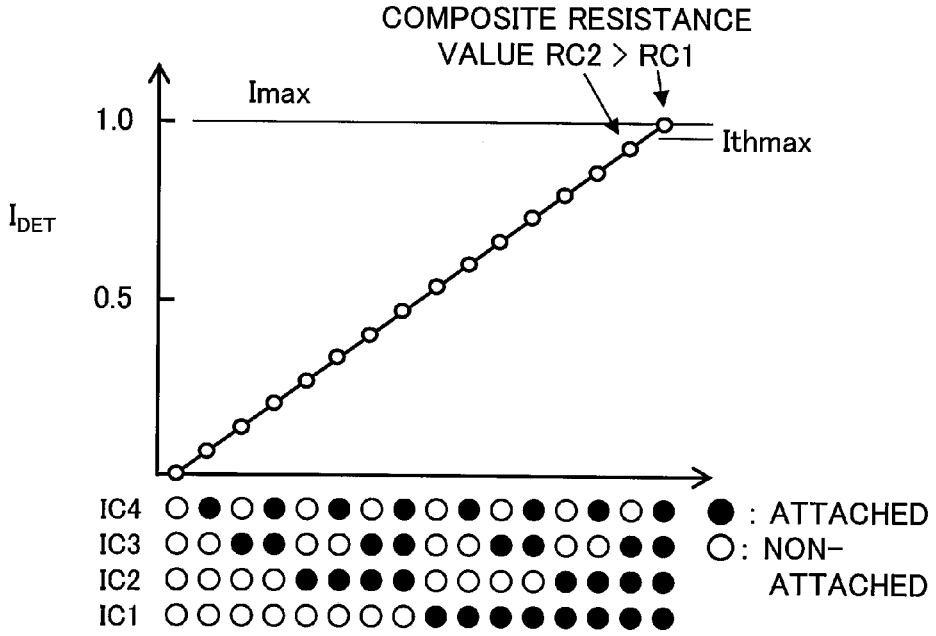

FIGS. 23A and 23B are explanatory diagrams showing details of the cartridge's attachment detection process according to the third embodiment. FIG. 23A shows a situation where all the attachable cartridges IC1-IC4 are attached to the cartridge attachment unit 1100 of the printing apparatus. The resistance values of the resistance element 204 of the four cartridges IC1-IC4 are set at the same value R. Within the cartridge detection circuit 502, resistance elements 631-634 that are connected in series with the resistance element 204 of each cartridge are provided. The resistance of each of these resistance elements 631-634 is set at a value different from each other. More specifically, among these resistance elements 631-634, the resistance value of a resistance element 63*n* corresponding to the nth cartridge ICn (n=1-4) is set at $(2^n-1)R$ where R is a constant. As a result, by a series connection of the resistance element 204 in the nth cartridge and the resistance element 63*n* in the cartridge detection circuit 502, a resistance of $2^nR$ is produced. The resistance $2^nR$ for the nth cartridge (n=1-N) is connected to the individual-attachment current detection unit 630 in parallel with each other. From here on, the series-connected resistances 701-704 are called "resistance for attachment detection" or simply "resistance." The detection current $I_{DET}$ detected at the individual-attachment current detection unit 630 is equal to VHV/Rc, which is a voltage value VHV divided by the composite resistance value Rc of these four resistances 701-704. Here, assuming the number of cartridges is N, and when all the N cartridges are attached, the detection current $I_{DET}$ is given by the following equations:

$$I_{DET} = \frac{VHV}{R_c} \tag{1}$$

$$R_c = R\frac{1}{\sum_{j=1}^{N}\frac{1}{2^j}} \tag{2}$$

If any one of the cartridges is not attached, the composite resistance value Rc rises up accordingly, while the detection current $I_{DET}$ drops down.

FIG. 23B shows a relation between attachment conditions of the cartridges IC1-IC4 and the detection current $I_{DET}$. The X-axis of the graph indicates 16 types of attachment conditions, and the Y-axis indicates the value of $I_{DET}$ in these attachment conditions. These 16 types of attachment conditions correspond to 16 combinations obtained by selecting any 1 to 4 from the four cartridges IC1-IC4. Here, each combination is also called a "subset." The detection current $I_{DET}$ turns out to be a current value that may uniquely identify these 16 attachment conditions. In other words, each resistance value of the four resistances 701-704 corresponding to the four cartridges IC1-IC4 is set in such a way that the 16 kinds of attachment conditions that may possibly be created by the four cartridges would give mutually different composite resistance values Rc.

If all the four cartridges IC1-IC4 are attached, the detection current $I_{DET}$ takes its maximum value of Imax. On the other hand, in the situation where only the cartridge IC4 corresponding to the resistance 704 with the largest value is not attached, $I_{DET}$ equals to 93% of the maximum value Imax. Therefore, it is possible to detect attachment or non-attachment of all the four cartridges IC1-IC4 by examining whether the detection current $I_{DET}$ is no less than a threshold current value Ithmax, which is preset to be within these two current values. By the way, the reason for using a higher voltage VHV for the individual attachment detection than a power voltage for the common logic circuit is to enhance the detection precision by setting a wider dynamic range of the detection current $I_{DET}$.

Also, the voltage VHV (e.g. 42V) used for the individual attachment detection process is significantly higher than the voltage H1 (e.g. 2.7V) used for the non-attached condition detection or the power supply voltage VDD (e.g. 3.3V) for memory devices. If a voltage used for the individual attachment detection process is at the same level as H1 used for the non-attached condition detection or as the power supply voltage VDD for memory devices, the so called "noise margin" is so small, and the detection accuracy is significantly reduced even by a small noise. When the contact between the board-side terminals and the apparatus-side terminals is a sliding contact wherein the contact portions cp slide, dirt or dust may accumulate between the board-side terminals and the apparatus-side terminals, which results in generation of noise. Considering such noise caused by dirt or dust, the voltage used for attachment detection is preferably as high as possible.

Figure 23C:
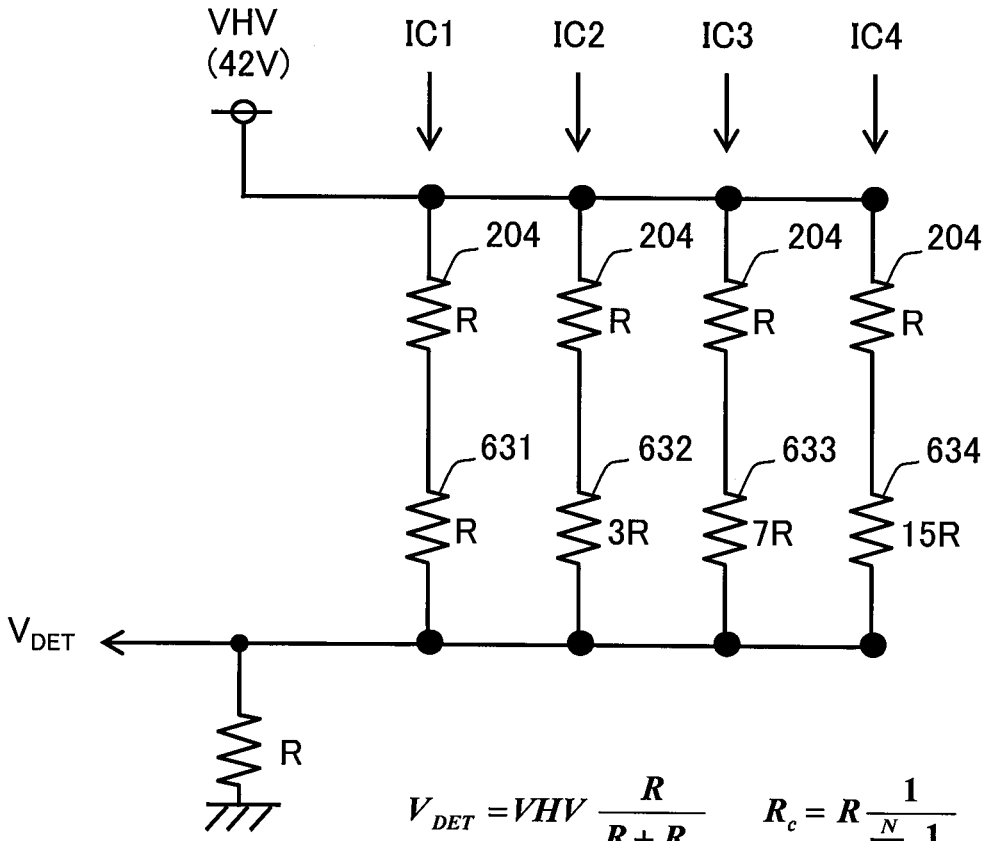
Figure 23D:
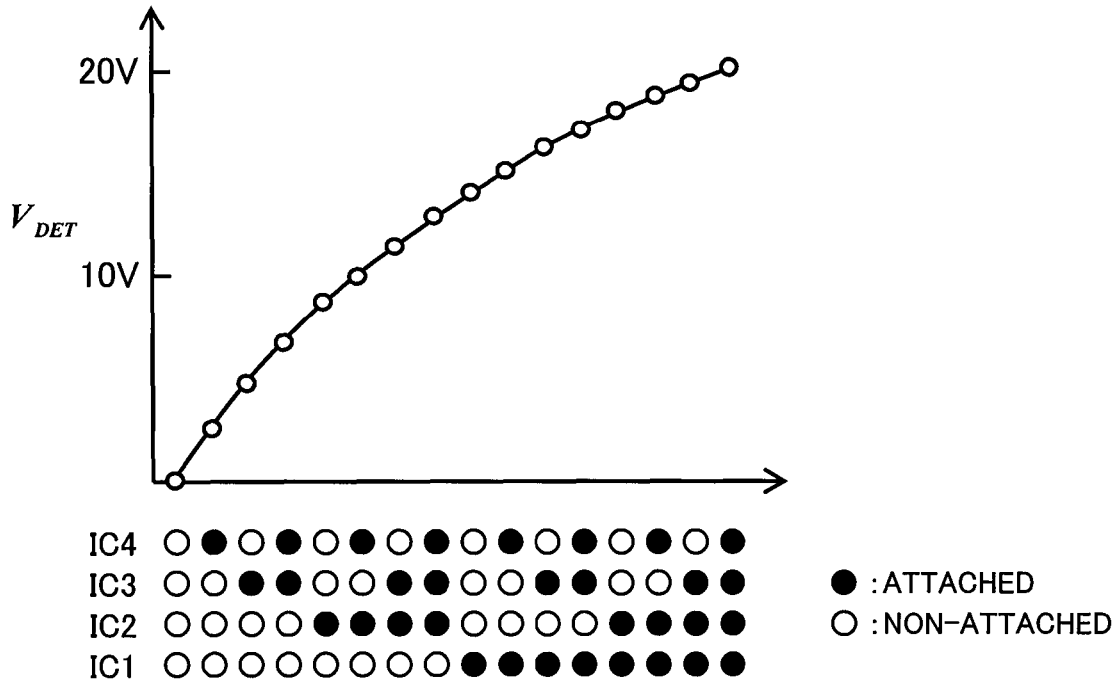

FIG. 23C shows a configuration of an attachment detection circuit as a reference example. This attachment detection circuit detects the condition of attachment of the cartridge by detecting a voltage $V_{DET}$ instead of a current. The detection voltage $V_{DET}$ has a value obtained by dividing the power supply voltage VHV with a composite resistance Rc and another resistance R. The value of the latter resistance R may be set at the same value as that of the resistance element 204 of the cartridge or any other resistance value. FIG. 23D shows a relation between the attachment conditions of the cartridges IC1-IC4 in this reference example and the detection voltage $V_{DET}$. The detection voltage $V_{DET}$ takes various values corresponding to the 16 different attachment conditions of the cartridges, which is similar, in that point, to the attachment detection circuit shown in FIG. 23A. Here, along the horizontal axes in FIGS. 23B and 23D, the 16 kinds of attachment conditions are aligned in such an order that the composite resistance value Rc gets smaller as it moves to the right.

The graph of the detection current $I_{DET}$ shown in FIG. 23B exhibits nearly a linear relation with the 16 kinds of attachment conditions, and its value increases linearly as it moves toward the right (as the composite resistance value Rc is reduced) in FIG. 23B. On the other hand, in the graph of the detection voltage $V_{DET}$ shown in FIG. 23D, the voltage value increases along the upward convex curve and the difference in values of the detection voltages $V_{DET}$ adjacent to each other gets smaller. As evident from this reference example, since the voltage difference in the two rightmost attachment conditions in FIG. 23D is too small in case of detecting attachment conditions using the detection voltage $V_{DET}$ corresponding to the composite resistance value Rc, there is a good possibility that the two attachment conditions may not be accurately discerned. Also, being always able to discern these two attachment conditions accurately requires the use of a resistance with higher precision (with a smaller manufacturing margin of error), which will cause higher cost. On the contrary, in the third embodiment shown in FIGS. 23A and 23B, the attachment conditions are detected using the detection current $I_{DET}$ corresponding to the composite resistance value Rc while keeping constant the voltage difference between the high power supply voltage VHV and the individual-attachment current value detection unit 630, so that the difference between two detection currents $I_{DET}$ in any two attachment conditions adjacent to each other is always nearly constant. Therefore, in the third embodiment, evaluation of attachment conditions is easier than that in the reference example, which makes it possible to use a resistance with less precision. Based on these comparisons, it is understandably preferable to have a configuration where attachment conditions are detected using the detection current $I_{DET}$ that corresponds to the composite resistance value Rc rather than using the detection voltage $V_{DET}$ that corresponds to the same value Rc.

The individual-attachment current detection unit 630 converts the detection current $I_{DET}$ into a digital detection signal $S_{IDET}$ and send it to the CPU 410 (FIG. 21). The CPU 410 is able to evaluate which of the 16 kinds of attachment conditions is taking place based on the value of this digital detection signal $S_{IDET}$. When one or more non-attached cartridges are detected, the CPU 410 displays information (by words or images) on the display panel 430 to notify the user of the non-attached condition.

The above-mentioned process of attachment detection of cartridges utilizes the fact that the composite resistance value Rc is uniquely determined corresponding to the $2^N$ kinds of attachment conditions concerning N number of cartridges, and the detection current $I_{DET}$ is uniquely determined accordingly. Here, let us assume that the tolerance of the resistances 701-704 equals to E. Also, assuming that the first composite resistance value is Rc1 under the condition where all the cartridges IC1-IC4 are attached, and the second composite resistance value is Rc2 under the condition where only the fourth cartridge IC4 is not attached, an inequation Rc1<Rc2 is satisfied. (FIG. 23B). It is preferable that this relation Rc1<Rc2 is true even when values of the resistances 701-704 fluctuate within the range of the tolerance±ϵ. In this case, if the condition of tolerance±ϵ is considered, the worst condition is where the first composite resistance value Rc1 takes its maximum value Rc1max, and the second composite resistance value Rc2 takes its minimum value Rc2min. Identification of these two composite resistance values Rc1 and Rc2 only requires that the condition of Rc1max<Rc2min be met. This condition of Rc1max<Rc2min leads to the following inequation:

$$\varepsilon < \frac{1}{4(2^{N-1}-1)} \tag{3}$$

In other words, when tolerance±ϵ satisfies the formula (3), the composite resistance value Rc is always uniquely determined in response to the attachment conditions of N cartridges, which ensures that the detection current $I_{DET}$ be uniquely determined accordingly. However, the actual design tolerance of the resistance value is preferably set at a smaller value than the one on the right side value of the formula (3). Also, the tolerance of the values of resistances 701-704 may be set small enough (e.g. 1% or less) regardless of the above considerations.

Figure 24:
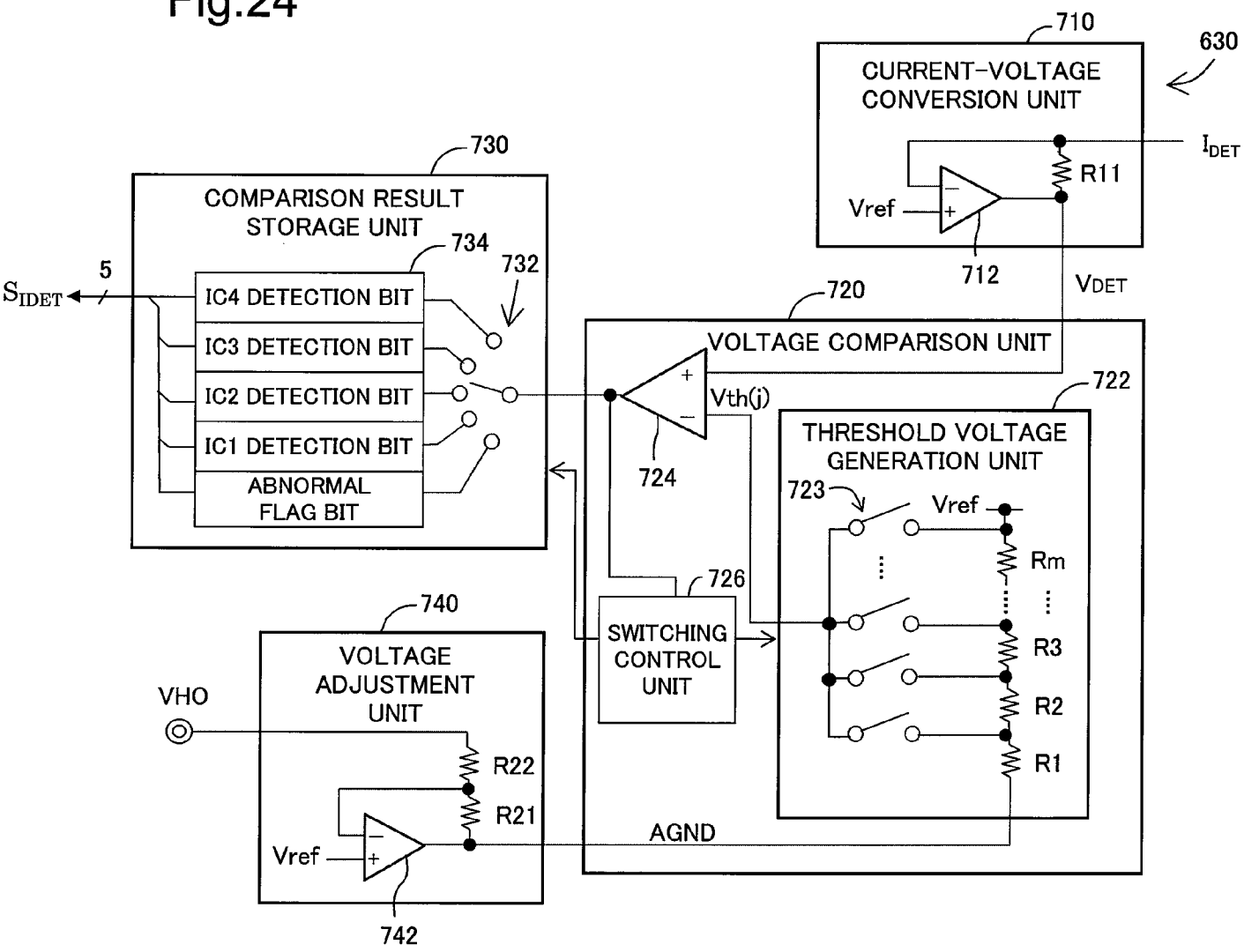
FIG. 24 shows an internal configuration of the individual-attachment current detection unit according to the third embodiment.

FIG. 24 is a block diagram showing the internal configuration of the individual-attachment current detection unit 630. The individual-attachment current detection unit 630 includes a current-voltage conversion unit 710, a voltage comparison unit 720, a comparison result storage unit 730, and a voltage adjustment unit 740.

The current-voltage conversion unit 710 is an inverting amplifier circuit composed of an operational amplifier 712 and a feedback resistance R11. The output voltage $V_{DET}$ is given by the following equation:

$$\begin{aligned} V_{DET} &= Vref - I_{DET} \cdot R11 \\ &= Vref - (VHO - Vref)\frac{R11}{Rc} \end{aligned} \tag{4}$$

Here, VHO denotes an output voltage of the detection voltage control unit 610 (FIG. 22), and Rc denotes a composite resistance value of the four resistances 701-704 (FIG. 23A). The output voltage $V_{DET}$ has a voltage value indicating the detection current $I_{DET}$.

The voltage $V_{DET}$ given by the formula (4) represents a inverted value of the voltage ($I_{DET}$·R11) deriving from the detection current $I_{DET}$. Accordingly, an inverting amplifier may be added to the current-voltage conversion unit 710 in order to output a voltage, which is inverted from the voltage $V_{DET}$ using the added inverting amplifier, as an output voltage of the current-voltage conversion unit 710. The absolute value of the amplification factor of the added inverting amplifier is preferably 1.

The voltage comparison unit 720 includes a threshold voltage generation unit 722, a comparator 724 (operational amplifier), and a switching control unit 726. The threshold voltage generation unit 722 selects one of plural threshold voltages Vth(j), which are obtained by dividing the reference voltage Vref with plural resistances R1-Rm, by the use of a selection switch 723 to output it. These plural threshold voltages Vth(j) are used to identify the value of detection current $I_{DET}$ under the 16 kinds of attachment conditions shown in FIG. 23B. The comparator 724 compares the output voltage $V_{DET}$ of the current-voltage conversion unit 710 with the threshold voltage Vth(j) outputted from the threshold voltage generation unit 722, and outputs the result of comparison between the two values. This result of comparison indicates whether each of the cartridges IC1-IC4 is attached. In other words, the voltage comparison unit 720 examines attachment or non-attachment of each of the cartridges IC1-IC4 and outputs the result. In a typical example, the voltage comparison unit 720 first examines whether the first cartridge IC1 corresponding to the largest resistance 701 (FIG. 23A) is attached or not and outputs a bit value indicating the comparison result. Then, the voltage comparison unit 720 examines whether each of the second through fourth cartridges IC2-IC4 is attached or not in sequence, and outputs the comparison results. The switching control unit 726 performs a control by switching the voltage Vth(j) to be outputted from the threshold voltage generation unit 722 for detecting the attachment or non-attachment of the next cartridge based on the comparison result concerning each cartridge.

The comparison result storage unit 730 stores binary comparison results outputted from the voltage comparison unit 720 at appropriate bit locations within a bit register 734 by switching connections with a selection switch 732. The switching timing of this selection switch 732 is commanded by the switching control unit 726. The bit register 734 includes N number (N=4 in this case) of cartridge detection bits that indicate attachment or non-attachment of each cartridge that is attachable to the printing apparatus, and an abnormal flag bit that indicates detection of an abnormal current value. The abnormal flag bits turn to the H level when there is a flow of current significantly larger than the current value Imax (FIG. 23B), which is the one under the condition of having all cartridges attached. However, the abnormal flag bits may be omitted. Plural bit values stored in the bit register 734 are sent to the CPU 410 (FIG. 21) of the main control circuit 400 as a digital detection signal $S_{IDET}$ (detection current signal). The CPU 410 evaluate whether each cartridge is attached or not judging from these bit values of the digital detection signal $S_{IDET}$. As mentioned above, in the third embodiment, the four bit values of the digital detection signal $S_{IDET}$ indicate attachment or non-attachment of each cartridge. Therefore, it is possible for the CPU 410 to immediately evaluate whether each cartridge is attached or not from each bit value of the digital detection signal $S_{IDET}$.

The combination of the voltage comparison unit 720 and the comparison result storage unit 730 make up a so-called A-D conversion unit. As an A-D conversion unit, it is possible to adopt various other known configurations instead of the voltage comparison unit 720 and the comparison result storage unit 730 shown in FIG. 24.

The voltage adjustment unit 740 is used for adjusting plural threshold voltages Vth(j) generated by the threshold voltage generation unit 722 in accordance with the variation of the high voltage VHV used for attachment detection (FIG. 22). The voltage adjustment unit 740 is configured as an inverting amplifier circuit comprising an operational amplifier 742 and two resistances R21 and R22. Output terminal voltage VHO of the detection voltage control unit 610 in FIG. 22 is inputted to the inverting input terminal of the operational amplifier 742 via the input resistance R22, while the reference voltage Vref is inputted to the non-inverting input terminal. In this case, the output voltage AGND of the operational amplifier 742 is given by the following equation:

$$AGND = Vref - (VHO - Vref)\frac{R21}{R22} \tag{5}$$

The voltage AGND is used as a reference voltage AGND on the low voltage side of the threshold voltage generation unit 722. For example, assuming Vref=2.4V, VHO=42V, R21=20 kΩ, R22=400 kΩ, then AGND=0.42V. As seen by comparing the above formulae (4) and (5), the reference voltage AGND on the low-voltage side of the threshold voltage generation unit 722 varies, as does the attachment detection voltage $V_{DET}$, in response to the values of the output voltage VHO of the detection voltage control unit 610 (i.e. high-voltage power VHV for attachment detection). The difference of these two voltages AGND and $V_{DET}$ comes from the difference between the resistance ratios R21/R22 and R11/Rc. Using this voltage adjustment unit 740, plural threshold voltages Vth(j) generated at the threshold voltage generation unit 722 vary in accordance with the changes in the power supply voltage VHV for attachment detection even if it fluctuates from any cause. As a result, both detection voltage $V_{DET}$ and plural threshold voltages Vth(j) vary in accordance with the fluctuation of the power supply voltage VHV, which makes it possible to obtain accurate comparison results regarding attachment conditions at the voltage comparison unit 720. Especially if the values of the resistance ratios R21/R22 and R11/Rc1, where Rc1 is a composite resistance value when all cartridges are attached, are set equal to each other, it is possible to have the detection voltage $V_{DET}$ and plural threshold voltages Vth(j) vary in substantially the same way in accordance with the power supply voltage VHV. However, the voltage adjustment unit 740 may be omitted.

Figure 25:
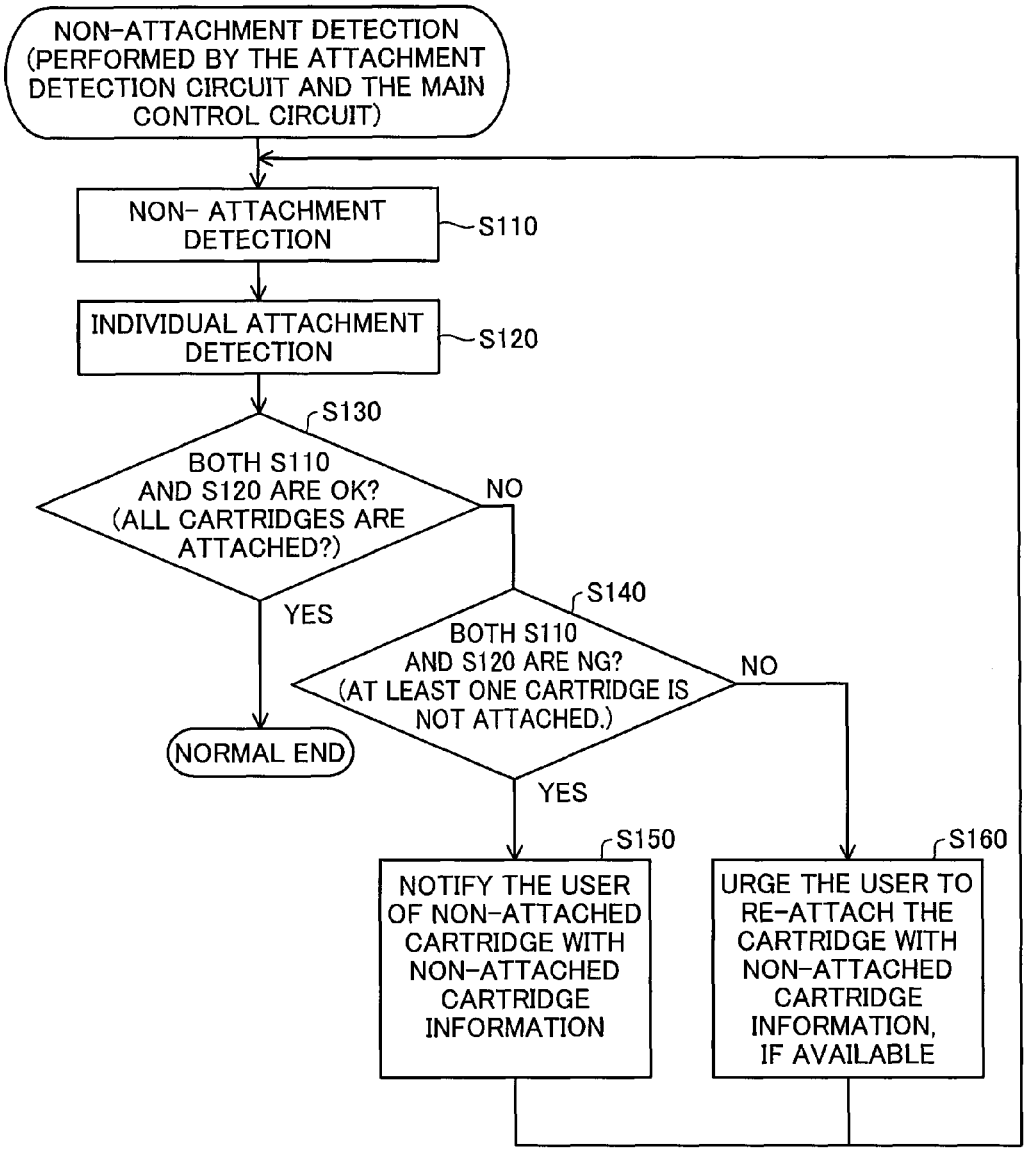
FIG. 25 is a flow chart showing an overall procedure of the attachment detection process according to the third embodiment.

FIG. 25 is a flow chart showing an overall procedure of the attachment detection process performed by the cartridge detection circuit 502. This attachment detection process starts when the cover 1200 of the cartridge attachment unit 1100 (FIG. 1) is opened. In this process, the memory device 203 of each cartridge is maintained under a non-conductive state (no supply of the power supply voltage VDD).

In Step S110, the non-attached condition detection unit 670 (FIG. 22) detects whether all the cartridges are attached to the cartridge attachment unit 1100 (this process may simply be called "non-attached condition detection process"). Then, in Step S120, the circuit including the individual-attachment current value detection unit 630 (FIG. 23A) carries out the individual attachment detection process for the cartridges.

In the individual attachment detection process, CPU 410 (FIG. 21) compares a digital detection signal $S_{IDET}$ supplied from the individual-attachment current value detection unit 630 (FIG. 23A) with a first threshold value. This first threshold value is a predetermined value which is equivalent to the current value existing between an detection current value $I_{DET}$ when all cartridges are non-attached and another detection current value $I_{DET}$ when only the cartridge IC4 corresponding to the largest resistance 704 is attached. If the detection current value $I_{DET}$ is no more than the first threshold value, the individual attachment detection process is completed since all cartridges are non-attached. In the same way, the system detects which of those $2^N$ attachment conditions (attachment patterns) shown at the bottom of FIG. 23B exists by comparing each of predetermined threshold values with the detection current value $I_{DET}$. Since N equals 4 in the third embodiment, 15 threshold values are being used. However, any integral equal to or greater than 2, typically 3, 4 or 6 may be used as N.

Once the individual attachment detection process is completed in a way described above, it is determined, in Step S130 of FIG. 25, whether the non-attached condition detection process of Step S110 and the individual attachment detection process of Step S120 are both OK (or passed); in other words, there is no overall non-attached condition and no individual non-attached condition. If both are passed, the process is completed normally. On the contrary, if both Steps S110 and S120 are NG (indicating that there exist an overall non-attached condition and an individual non-attached condition), Step S140 proceeds to S150, and the user is notified of the existence of cartridges yet to be attached as well as the non-attached cartridge information. Here, "the non-attached cartridge information" denotes information on the cartridge that is yet to be attached (at least one of the attributes including the ink color, the position of the cartridge within the cartridge attachment unit and the like). Meanwhile, in the event only one of S110 and S120 is NG (indicating that there exists either one a overall non-attached condition or an individual non-attached condition), Step S140 proceeds to S160, and the user is urged to re-attach the cartridge properly within the cartridge attachment unit. At this time, if there is any information on the non-attached cartridge (if detected by the individual-attachment detection process), it is preferable to notify the user of the non-attached cartridge information.

If the non-attached condition detection process of Step S110 turns out to be NG (failed) and the individual-attachment detection process of Step S120 turns out to be OK (passed), it is preferable to perform a memory access to the memory device 203 of each cartridge using the memory control circuit 501 (FIG. 21). If this memory access to the memory device 203 of any cartridge cannot be performed normally, there is a good possibility that the cartridge is not attached properly, and therefore, it is preferable to urge the user to re-attach the cartridge at issue. On the contrary, if a memory access to the memory device 203 of each cartridge is performed normally, it is likely that all the cartridge are incompletely attached. Therefore, it is preferable to urge the user to re-attach all the cartridges in this case.

Meanwhile, the non-attached condition detection process using the attachment detection signal DPins is preferably carried out periodically while the printing apparatus is turned on. It is also preferable to conduct the individual-attachment detection process periodically while the printing apparatus is turned on. However, it is preferable not to perform the individual-attachment detection process while a memory access to the memory device 203 of any one of the cartridges is being performed. The reason for this is that the individual-attachment detection process is performed using a voltage VHV higher than the power supply voltage VDD for the memory, so that it is desired to reduce the risk of damages to the memory device 203 which is possibly inflicted by the voltage VHV used for the individual-attachment detection process.

As described above, in the third embodiment, as in the first and second embodiments, contact portions of the attachment detection terminals are provided at four corners around contact portions of the plural memory device terminals on the board, more specifically, they are provided outside an area within which plural memory device terminals of the board are placed, and at the same time, at four corners of the quadrangular area encompassing such area, which makes it possible to maintain good contact conditions concerning the memory device terminals by confirming good contact between these attachment detection terminals and the corresponding apparatus-side terminals.

Additionally, in the third embodiment, since a non-attached condition of each cartridge is notified to the user during cartridge replacement, the user is able to work on the cartridge replacement while looking at this display. Especially, since the display shows a status change from non-attached to attached during the cartridge replacement, even users unfamiliar with the cartridge replacement may proceed to the next operation with ease. Also, in the third embodiment, the cartridge attachment detection can be performed with the memory device 203 of the cartridge being under a non-conductive state, which prevents bit errors from occurring caused by so called "hot swap" (an operation wherein the memory control circuit of the printing apparatus accesses the cartridge's memory device regardless of whether the cartridge's memory device is connected to the apparatus-side terminal of the printing apparatus, and during that access, the cartridge is either attached or non-attached).

Also, in the third embodiment, the four attachment detection terminals 210, 240, 250 and 290 and contact portions thereof are not directly connected to the ground voltage. Therefore, it has an advantage of avoiding the risk of lowering the reliability of the system that may otherwise erroneously identify a non-attached cartridge as attached, as explained in the section of Related Art. Here, in the third embodiment, the attachment detection may not be able to be performed if the attachment detection terminals 210, 240, 250 and 290 are connected in short circuit with the ground terminal 270 due to dirt or dust. In order to prevent such a condition, the ground terminal 270 is preferably placed at a position farthest from the attachment detection terminals 210, 240, 250 and 290 (i.e. at the center of the lower row R2).

Also, in the third embodiment, as to the pair of attachment detection terminals 210 and 240 in the first row R1, attachment detection is performed by inputting the first attachment inspection signal DPins to one of the terminals 210 and 240 as a first pulse signal and then examining the first attachment response signal DPres that is outputted in response from the other terminal. Since the attachment detection with respect to the pair of attachment detection terminals is performed by the use of pulse signals, it is possible to reduce a risk of misjudging attachment conditions as compared to the situation where attachment conditions are detected according to voltage levels of the attachment detection terminals on the printing apparatus side.

In addition, in the third embodiment, as to the pair of attachment detection terminals 250 and 290 in the second row R2, attachment detection is performed by the use of higher voltage VHV than the power supply voltage VDD for a memory so that the noise margin is larger than when performing the attachment detection using the power supply voltage VDD, which makes it possible to reduce the risk of misjudgment on the attachment conditions.

On the other hand, the high level H1 of the attachment inspection signal DPins as a pulse signal used for the attachment detection terminals 210 and 240 in the first row R1 is set at a lower level (e.g. 2.7V) than the power supply voltage VDD (e.g. 3.3V) (see FIG. 12). In the attachment detection process using pulse signals, the attachment conditions are evaluated based on whether they are high or low, according to the voltage level of the attachment response signal DPres received by the non-attached condition detection unit 670 on the printing apparatus side. If a higher voltage (e.g. 42V) is used for the pulse signal, recharging and discharging the wires take a long time, resulting in longer time required for the detection of attachment conditions. In that sense, it is preferable to set the pulse signal's high level voltage at a voltage no more than the power supply voltage VDD in performing the attachment detection using pulse signals. Also, the high level H1 of the attachment inspection signal DPins is set at a voltage (e.g. 2.7V) lower than the overvoltage value (e.g. 3V) at the terminals 210 and 240 detected by the overvoltage detection unit 620 (FIG. 22). This way, it is possible to prevent overvoltage from being applied to the terminals 210 and 240 in the attachment detection process even if the terminal 250 or 290 and the terminal 210 or 240 are connected in short circuit with each other due to dirt or dust.

Furthermore, in the third embodiment, the attachment detection terminals 210, 240, 250 and 290 (and contact portions thereof) are not connected to the memory device 203, and the operation of the memory device 203 does not use any signal via the attachment detection terminal 210, 240, 250 or 290. If attachment detection is performed using terminals that are also used for operating logic circuits such as the memory device 203, even a proper attachment condition may be misjudged as poor attachment if any of those logic circuits fails to function properly. In the third embodiment, it is possible to prevent such misjudgment because the attachment detection terminals are not used for operating the memory device 203.

D. Fourth Embodiment

Figure 26A:
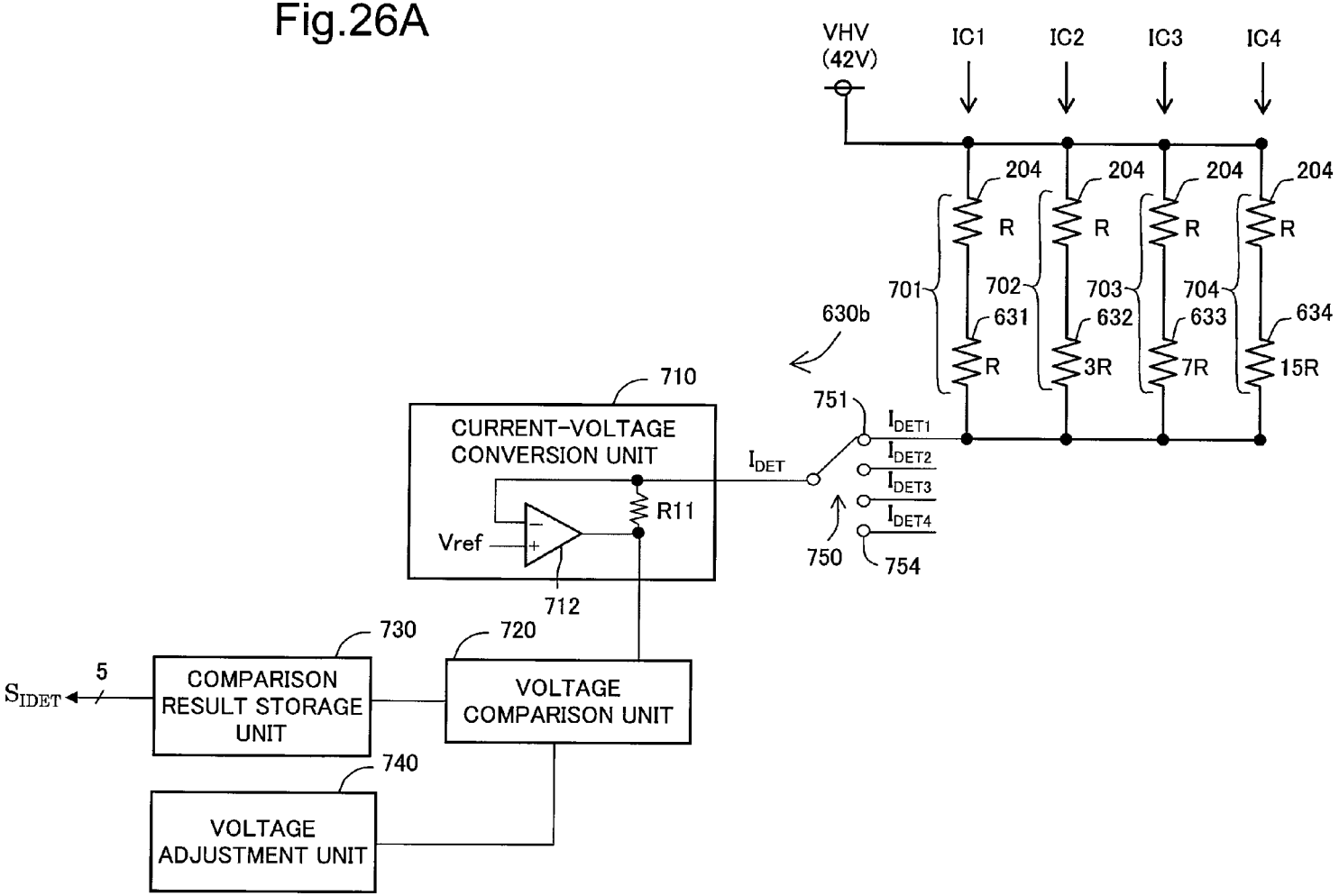
FIGS. 26A and 26B show a configuration of the individual-attachment current detection unit according to the fourth embodiment.

FIG. 26A shows a diagram showing a configuration of the individual-attachment current detection unit 630*b* according to the fourth embodiment. The individual-attachment current detection unit 630*b* is changed from the individual-attachment current detection unit 630 according to the third embodiment in FIG. 24 by adding an input selection switch 750. The input selection switch 750 is used for selecting one of detection currents $I_{DET1}$-$I_{DET4}$ inputted from plural input terminals 751-754 to input it to the current-voltage conversion unit 710. The detection current $I_{DET4}$ that flows through parallel connection of resistances 701-704, which are the same as those shown in FIG. 23A, are inputted to the first input terminal 751. Likewise, detection currents $I_{DET2}$-$I_{DET4}$ that flow through parallel connection of resistances corresponding to four or less cartridges are inputted respectively to other input terminals 752-754. Here, internal configurations of other circuit elements 710-740 are omitted in FIG. 26A since they are the same as in FIG. 24.

By installing the input selection switch 750, it is possible to perform an attachment detection of each cartridge in a printing apparatus with much more cartridges attached, in the same manner as described above.

In general, the input selection switch 750 having m number of selectable input terminals, where m is an integer of no less than 2, may be installed in the individual attachment detection unit 630*b*. Also, as a configuration of the individual attachment detection unit 630*b*, it is possible to adopt a configuration where n number of boards 200, where n is an integer of no less than 2, are connectable to each terminal of the input selection switch 750. In this case, the individual attachment detection unit 630*b* is able to individually detect attachment conditions of up to m×n cartridges. In the circuit of FIG. 26A, since m=n=4, attachment conditions may be detected individually for up to 16 cartridges. However, in a printing apparatus having such a unit like the individual attachment detection unit 630*b*, if m or less number of cartridges is held in its cartridge attachment unit, it is preferable to adopt a configuration where only one board 200 is connected to each of the input terminals of the input selection switch 750. This way, there is no need for performing the individual-attachment detection process using current values as described above, and it is possible to determine if the board 200 is properly connected (if the cartridge is properly attached or not) by detecting whether a current is flowing through the input terminal of the input selection switch 750. In the situation where only four cartridges are attached to the cartridge attachment unit of the printing apparatus with the circuit shown in FIG. 26A, one cartridge board 200 is connected to each of the four input terminals 751-754.

Figure 26B:
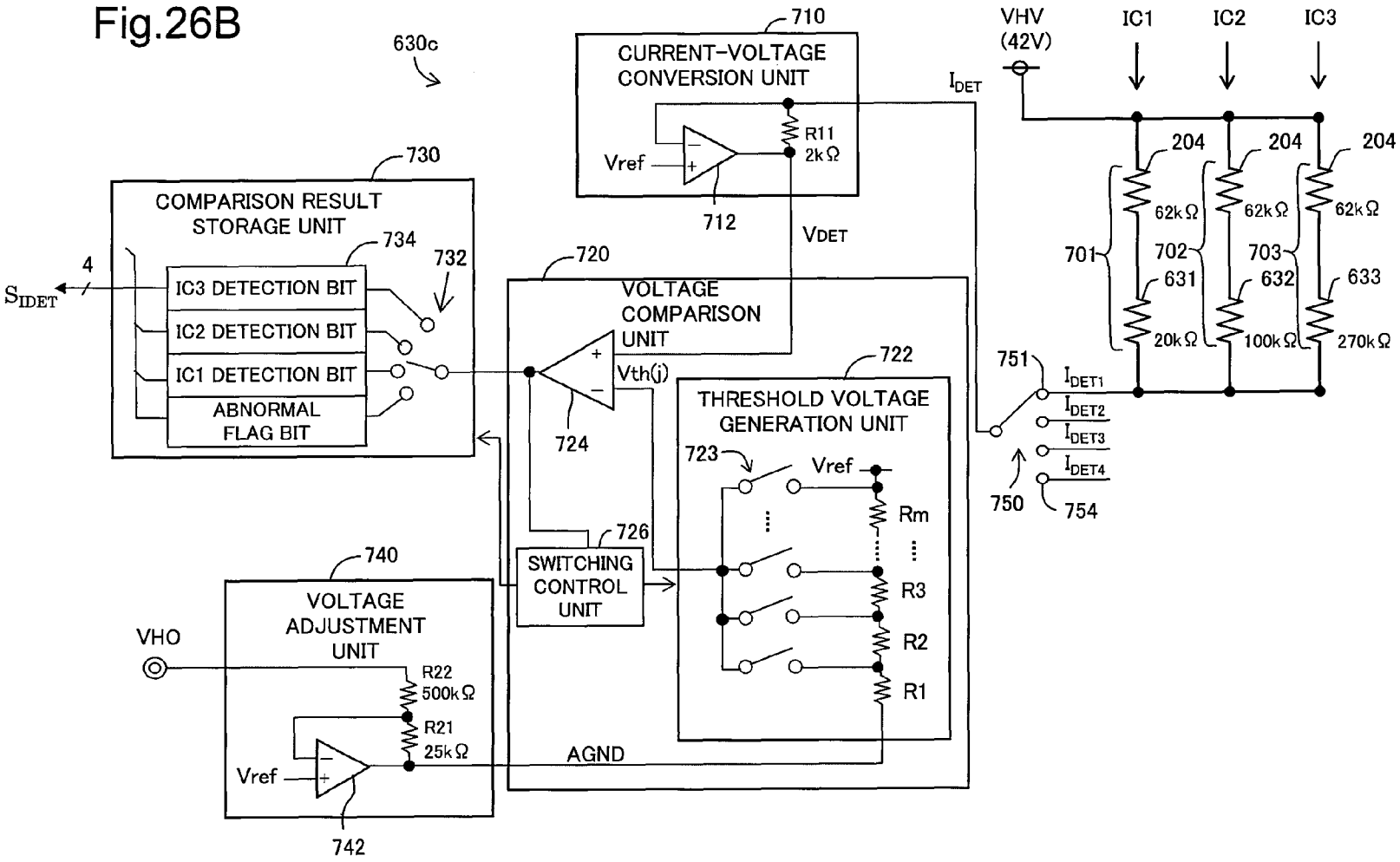

FIG. 26B is a diagram showing a configuration of an individual attachment detection unit 630*c* as a variation example of the fourth embodiment. This individual attachment detection unit 630*c* has almost the same configuration as the individual attachment detection unit 630*b* of the fourth embodiment shown in FIG. 26A, and the internal structure of each of the circuits 710, 720, 730 and 740 is illustrated according to FIG. 24. However, a detection current $I_{DET1}$ that flows through a parallel connection of the attachment detection resistances 701-703 for three ink cartridges IC1-IC3 is inputted to the first input terminal 751 of the input selection switch 750. Similarly, detection currents $I_{DET1}$-$I_{DET4}$ flowing through a parallel connection of the attachment detection resistances 701-703 corresponding respectively to the three cartridges are each inputted to other input terminals 752-754. That is, in the circuit of FIG. 26B, up to three attachment detection resistances 701-703 for three ink cartridges may be parallelly connected to each of the four input terminals 751-754, which makes it possible to individually evaluate attachment conditions of up to 12 ink cartridges.

In FIG. 26B, the resistance value of the resistance element 204 within each cartridge is set at 62 kΩ. Also, the resistance values of the resistance elements 631-633 on the printing apparatus side are set at 20 kΩ, 100 kΩ and 270 kΩ. Therefore, the resistance values of the attachment detection resistances 701-703 for the three cartridges IC1-IC3 are 82 kΩ, 162 kΩ and 332 kΩ, respectively. The resistance values of these attachment detection resistances 701-703 turn out to be close enough to 2R, 4R and 8R when R is 41 kΩ. In other words, the resistance values of these attachment detection resistances 701-703 are almost the same as the resistance values 2R, 4R and 8R of the attachment detection resistances 701-703 shown in FIGS. 23A and 26A. Strictly speaking, if R=41 kΩ, then 82 kΩ=2R, 162 kΩ=4R×(1-0.012), and 332 kΩ=8R×(1+0.012). However, this much difference of design values (±1.2%) is well within the range of tolerance for the individual cartridge detection even considering the margin of manufacturing error in the resistance values as well as temperature dependency of the resistance values.

In FIG. 26B, the resistance values of the resistance elements 204, 631-633 comprising the attachment detection resistances 701-703 are set under the following conditions:

(1) The resistance value of each resistance element is set at 20 kΩ or greater.

By setting this condition, even if the highest voltage VHV among those used in the attachment detection circuit is applied to the resistance element of 20 kΩ, the current flowing through the resistance element can be limited to no more than about 2.1 mA as follows:

$$(44.1V-2.4V)/20k\Omega=2.085\ mA<2.1\ mA$$

Here, 44.1V is the maximum value of the voltage VHV (absolute maximum voltage=42V+5%) assuming that its rated value is 42V and margin of error is ±5%. Then, 2.4V is a value of a reference voltage Vref to be used in the current-voltage conversion unit 710. The value (44.1V-2.4V)=41.7V represents the maximum voltage applied to both ends of the resistance element. Thus, assuming that the resistance value of each resistance element is 20 kΩ or more, the maximum current can be limited to about 2.1 mA or less, which makes it possible to protect the ASIC that constitutes the attachment detection circuit.

(2) The resistance value of the resistance element 204 installed on the ink cartridge is set greater than the minimum value among those of the resistance elements 631-633 within the attachment detection circuit.

By setting this condition, just in case the resistance element 204 installed on the ink cartridge is short-circuited from any cause, it is easier to detect the abnormality. Meanwhile, the resistance element 204 is typically attached externally onto the rear face of the board 200 (FIG. 20). Since the distance between the terminals of the externally attached resistance element 204 is as small as about 1 mm, there is a possibility that those terminals of the resistance element 204 may get short-circuited for some reasons during the manufacturing process of the board 200, but it is also easy to detect any such abnormality.

(3) The minimum value of the detection current $I_{DET}$ is set at 100 μA or greater.

By setting this condition, it is easier to properly detect the attachment conditions of the cartridges based on the detection current $I_{DET}$ despite any impact of external disturbances. In the circuit configuration of FIG. 26B, assuming that three cartridges IC1-IC3 are all attached, the manufacturing error margin of the resistance value is ±1%, and the margin of error for the resistance value associated with temperature dependency is 0.7%, the minimum value of the detection current $I_{DET}$ turns out to be about 117 μA, which fully meets the above condition.

Although the above conditions (1)-(3) are preferable ones, it is not required to meet any of them, and other conditions may be set instead. It should be noted that the reasons why the attachment detection resistances 701-704 each is formed as a composite resistance of an apparatus-side resistance and a cartridge-side resistance but not just simply as an apparatus-side resistance are as follows. One reason is that if the resistance is provided only on the apparatus side, an unintended short-circuit between the resistance element may cause an unintended high voltage to be applied to the individual attachment detection unit. Another reason is that if the resistance is provided only on the cartridge side, it is necessary to prepare various circuit boards 200 having different resistance values according to the types of the cartridges, thus increasing their fabrication costs.

In FIG. 26B, the resistances R11, R21 and R22 in the individual attachment detection unit 630*c* are set at 2 kΩ, 25 kΩ and 500 kΩ, respectively. As explained with reference to FIG. 24, these resistance values are set so as to roughly equalize the resistance ratio R21/R22 and R11/Rc1 where Rc1 is a composite resistance value when all cartridges are attached. Therefore, in the circuit of FIG. 26B, it is possible to have the detection voltage $V_{DET}$ and plural threshold voltages Vth(j) vary in substantially the same way in accordance with the power supply voltage VHV.

In the circuit of FIG. 26B, assume that the reference voltage Vref at the current-voltage conversion unit 710 is 2.4V. Meanwhile, in the three cartridges IC1-IC3, among the terminals 250 and 290 (FIG. 22) at both ends of the resistance 204, the terminal 250 is applied with a voltage VHO (=VHV=approx. 42V) higher than the power supply voltage VDD for the memory device 203. At this time, the voltages outputted from the other terminal 290 are about 10V in the first cartridge IC1, about 24V in the second cartridge IC2, and about 32V in the third cartridge IC3. Thus, the terminals 250 and 290 at both ends of the resistance 204 in each cartridge are applied with voltages higher enough than the power supply voltage VDD (usually 3.3V) supplied from the power supply terminal 260 to the memory device 203. Therefore, by detecting overvoltage at the terminals 210 and 240 that are closest to the terminals 250 and 290, it is possible to detect generation of overvoltage (short circuit) right away to prevent any damage to the memory device 203 or the circuitry on the printing apparatus side.

Meanwhile, in the embodiment shown in FIG. 26A and variation example shown in FIG. 26B, a cartridge set is composed of some of the cartridges among those attached to the cartridge attachment unit of the printing apparatus, and attachment conditions of each cartridge set is detected by the attachment detection circuit. For example, in the circuit of FIG. 26A, the four cartridges IC1-IC4 constitute a cartridge set, and a cartridge attachment unit having a maximum capacity of 16 cartridges is usable. In the circuit in FIG. 26B, the three cartridges IC1-IC3 constitute a cartridge set, and a cartridge attachment unit having maximum capacity of 12 cartridges is usable. As understandable from these descriptions, an attachment detection circuit preferably has a circuit configuration that is capable of detecting 2N different attachment conditions of each cartridge set composed of N number of cartridges where N is an integer of no less than 2. Here, the word "cartridge set" refers not only to a set composed of all the cartridges attached to the cartridge attachment unit of the printing apparatus but also to a set of plural cartridges composed of some of them.

E. Other Embodiments

Figure 27:
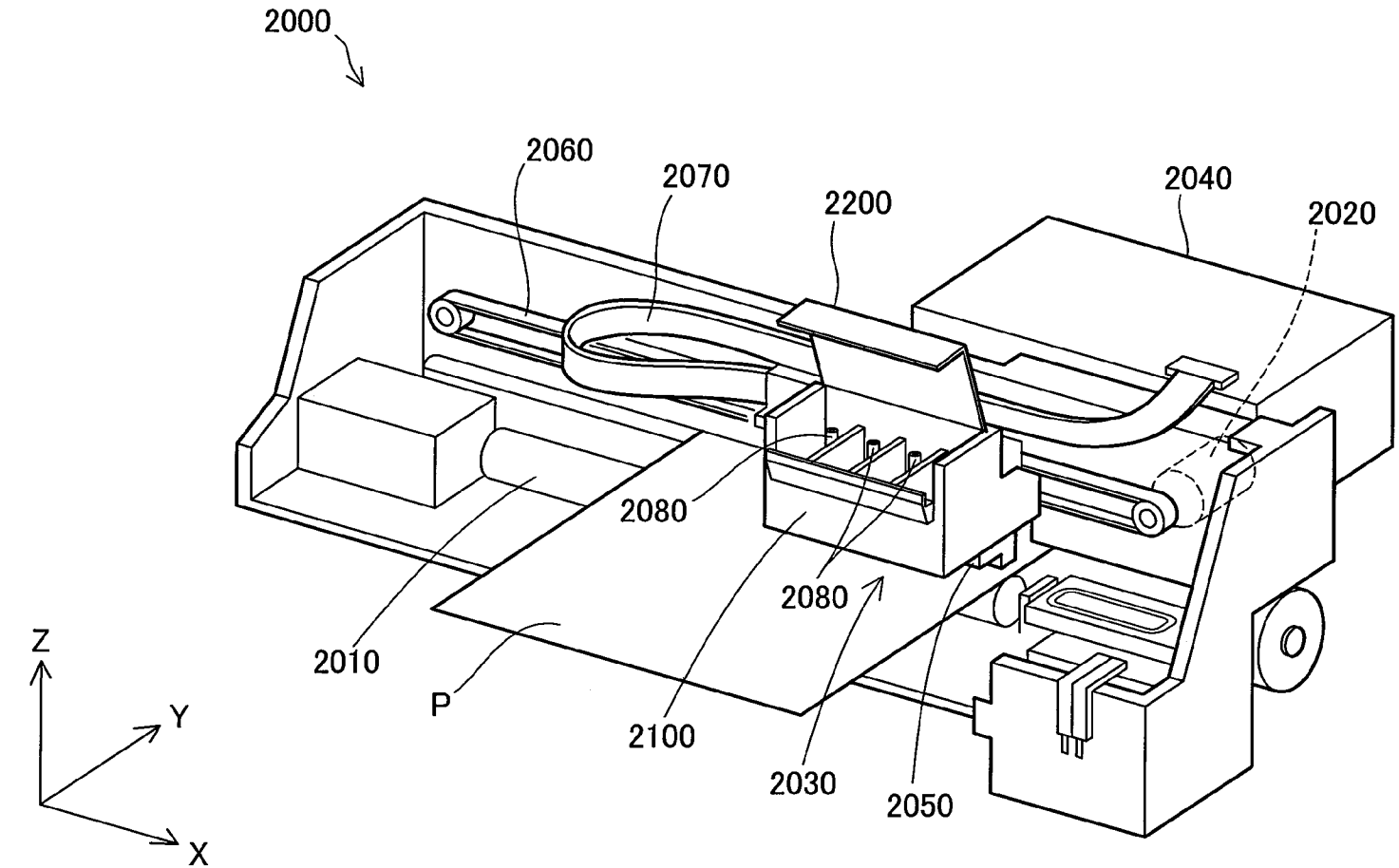
FIG. 27 is a perspective view showing a configuration of the printing apparatus according to another embodiment.

FIG. 27 is a perspective view showing a configuration of a printing apparatus according to another embodiment of this invention. FIG. 27 shows X, Y and Z axes that are at right angles to each other for the convenience of illustration. The printing apparatus 2000 is a small format inkjet printer, mainly for individual use, for printing on an A4 or A3 size medium, and comprises main and sub-scanning drive mechanisms and a head drive mechanism. The sub-scanning drive mechanism feeds printing paper P in the direction of sub-scanning using a paper feeding roller 2010 powered by a feeding motor, which is not shown in the figure. The main scanning drive mechanism reciprocates a carriage 2030 connected to a drive belt 2060 using the power of a carriage motor 2020. The head driving mechanism performs the ink ejection and dot formation by driving the print head 2050 provided in the carriage 2030. The printing apparatus 2000 is further provided with a control circuit 2040 for controlling each mechanism mentioned above. The control circuit 2040 includes the above-mentioned main control circuit 400 and sub-control circuit 500 according to the first through third embodiments.

The carriage 2030 includes a cartridge attachment unit 2100 and a print head 2050. The cartridge attachment unit 2100 is configured to accommodate plural cartridges and is placed on the upper side of the print head 2050. The cartridge attachment unit 2100 is also called a "holder." In the example of FIG. 27, four cartridges may be attached independently in the cartridge attachment unit 2100, and for example, four kinds of cartridges of black, yellow, magenta and cyan are individually attached. The cartridge attachment direction is in the −Z direction (downward vertical). Also, as the cartridge attachment unit 2100, other types that accommodate any other plural types of ink cartridges may be used. The cartridge attachment unit 2100 is equipped with a cover 2200 in an open-close manner. The cover 2200 may be omitted. In the upper portion of the print head 2050, an ink supply pipe 2080 for supplying ink from the cartridge to the print head is disposed. This type of printing apparatus like the printing apparatus 2000 where cartridges are attached in the cartridge attachment unit on the print head carriage and replaced by the user is called an "on-carriage type."

Figure 28:
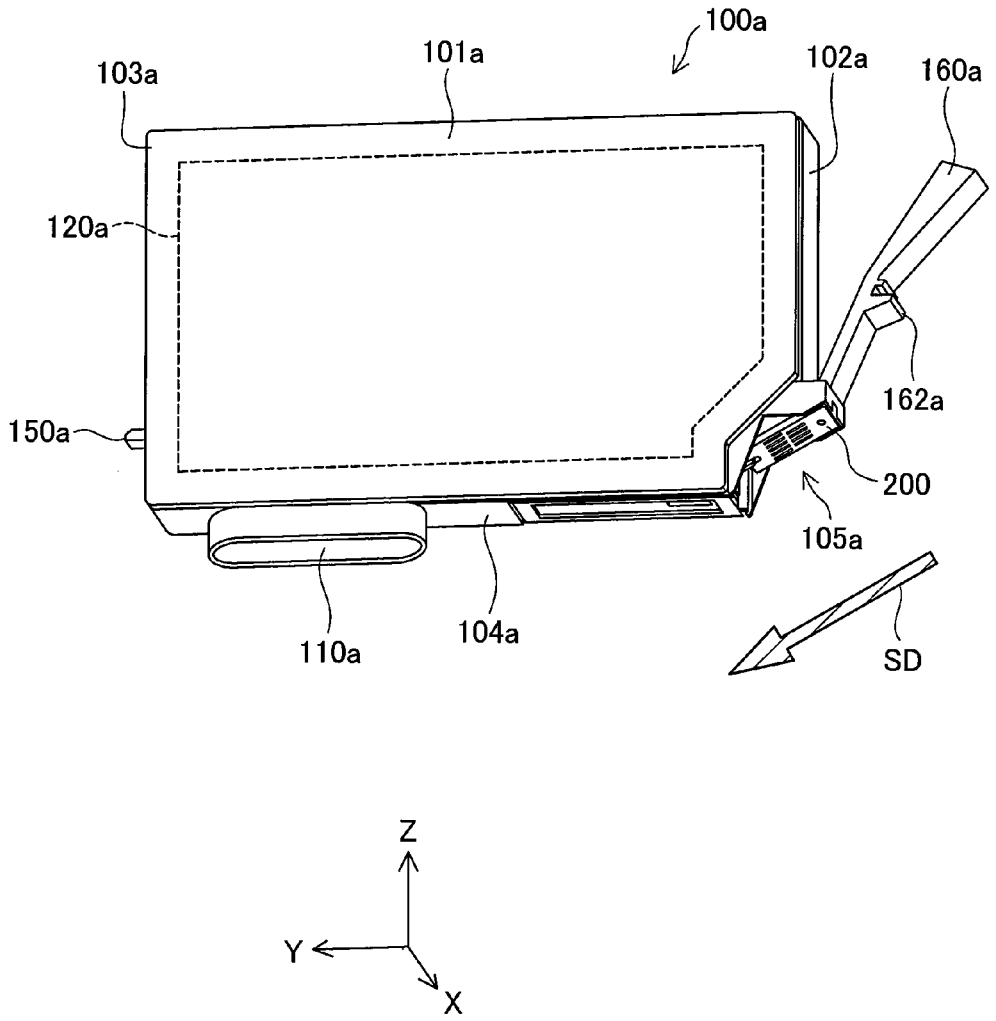
FIG. 28 is a perspective view showing a configuration of the ink cartridge according to another embodiment.

FIG. 28 is a perspective view showing a configuration of the cartridge 100*a* for the printer 2000. The X, Y and X axes of FIG. 28 correspond to those of FIG. 27. The cartridge 100*a* is equipped with a case 101*a* that stores ink and a board 200 (also called "circuit board"). As the board 200, those shown in FIGS. 3A, 8 and 20 described above may be used. Within the case 101*a*, an ink chamber 120*a* for storing ink is formed. The case 101*a* is in an approximate shape of a cuboid as a whole. On a first side surface 102*a* of the case 101*a*, a lever 160*a* is provided. The lever 160*a* is used for attachment and detachment of the cartridge 100*a* to and from the cartridge attachment unit 2100. In other words, the user may mechanically engage or disengage the cartridge 100*a* with the cartridge attachment unit 2100 by pushing the lever 160*a*. The lever 160*a* is provided with an engaging projection 162*a*. On the bottom surface 104*a* of the case 101*a*, an ink supply outlet 110*a* is formed to be connected to the ink supply pipe 2080 of the printing apparatus when the cartridge is attached to the cartridge attachment unit 2100. The opening of the ink supply outlet 110*a* may be sealed with a film before use. At the intersection of the first side surface 102*a* and the bottom surface 104*a* (i.e. the bottom corner of the case 101*a*), a slanted board holder 105*a* is formed, in which the board 200 is fixed. Here, it is possible to conceive that the board holder

105*a* is made near the bottom end of the first side surface 102*a*. On the second side surface 103*a* opposing the first side surface 102*a*, an engaging projection 150*a* is provided. Now, the cartridge 100*a* and the cartridge attachment unit 2100 are preferably provided with a sensor mechanism to detect, either electrically or optically, the remaining amount of ink within the cartridge 100*a*, but the sensor mechanism is omitted in the illustration. The first side surface 102*a* is a plane that faces toward the front (−Y direction) when attached to the printing apparatus 2000 (FIG. 27). Therefore, the first side surface 102*a* is also called the "frontend surface" or "front surface." And the second side surface 103*a* is also called the "backend surface" or "back surface."

When the cartridge 100*a* is attached to the cartridge attachment unit 2100, the direction perpendicular to the opening plane of its ink supply inlet 101*a* (parallel to Y-axis) coincides with Z-axis (vertical direction). Here, regarding the circuit board 200 installed on the slanted plane, the direction parallel to the surface of the circuit board 200 and directed toward the ink supply inlet 101*a* is named a slant surface direction SD. Regarding the circuit board 200, when viewing the circuit board 200 and the ink supply outlet 101*a* from the side surface 102*a* side, the ink supply outlet 101*a* is placed down in the −Z direction than circuit board 200. Thus, the slant surface direction SD regarding the circuit board 200 can be deemed the same as the attachment direction SD in FIG. 3A, and the distinction between a group of terminals and contact portions in the upper row and a group of terminals and contact portions in the lower row based on the attachment direction SD for FIG. 3A may be applied to the board 200 of the ink cartridge 100*a* in FIG. 28 for the understanding thereof. Therefore, the farther row of the circuit board 200 in the slant surface direction SD, that is, the row closer to the ink supply inlet 101*a*, is made of a group of lower row terminals 250-290 and a group of lower row contact portions. The row of the circuit board 200 toward the front in the slant surface direction SD, that is, the row farther from the ink supply inlet 101*a*, is a group of upper row terminals 210-240 and a group of upper row contact portions.

Figure 29:
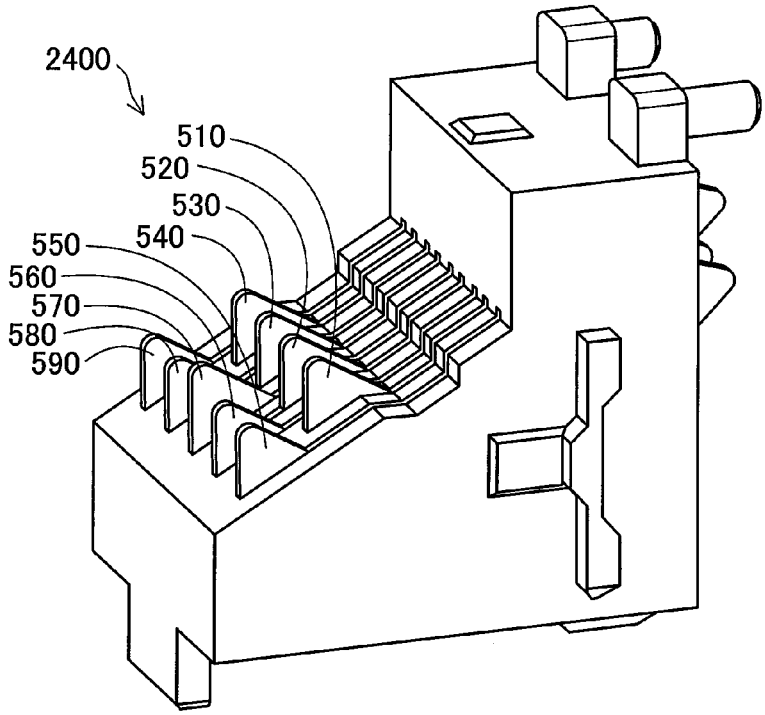
FIG. 29 is a perspective view of the contact mechanism installed within the cartridge attachment unit.

FIG. 29 is a perspective view of a contact mechanism 2400 installed within the cartridge attachment unit 2100. A plurality of electrical contact members 510-590 are provided in the contact mechanism 2400. These plural electric contact members 510-590 are equivalent to the apparatus-side terminals corresponding to the terminals 210-290 of the board 200. Each of the apparatus-side terminals 510-590 is formed with an elastically deformable material (elastic member), and biases the circuit board 200 upward when cartridge is attached. Here, the central terminal 570 in the lower row protrudes higher than other terminals. Therefore, in attachment the cartridge 100*a* to the cartridge attachment unit 2100, the central terminal 570 gets in contact with a terminal on the board prior to the other apparatus-side terminals. In other words, among the terminals 210-290 of the board 200 (FIG. 3A), the ground terminal 270 gets in contact first with the apparatus-side terminal before the others do.

Figure 30:
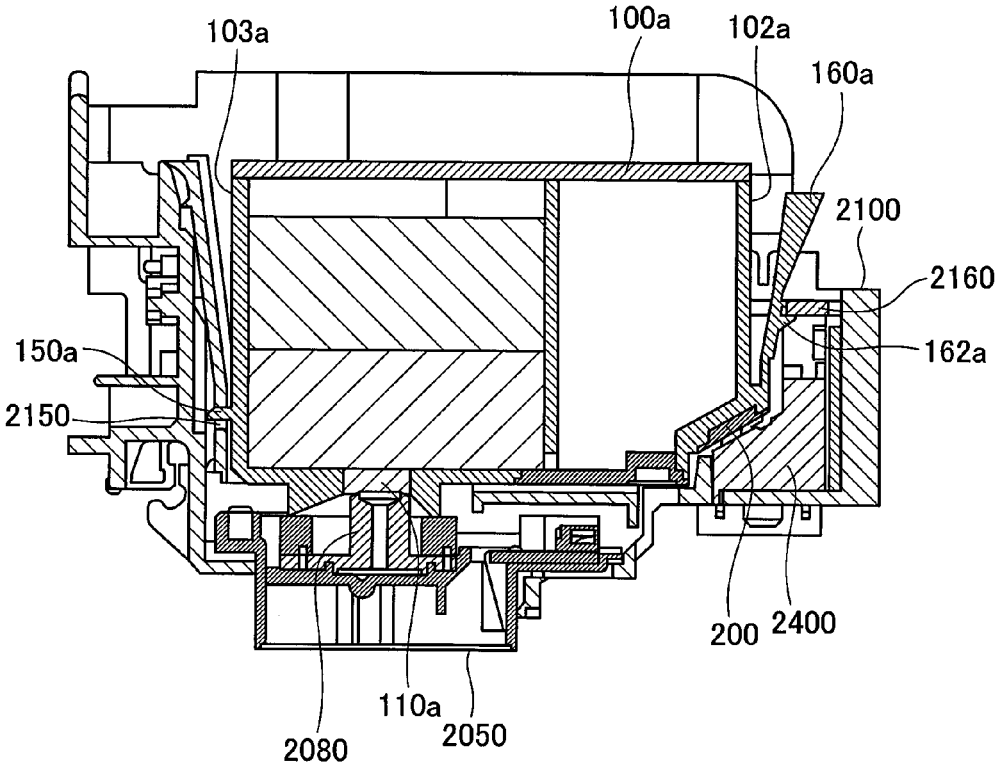
FIG. 30 is a section of a main portion to which the ink cartridge is attached within the cartridge attachment unit.

FIG. 30 shows a situation where the cartridge 100*a* is attached within the cartridge attachment unit 2100. In this situation, the apparatus-side terminals 510-590 of the contact mechanism 2400 (FIG. 29) are pushed downward by the board 200 of the cartridge 100*a*, and the entire set of apparatus-side terminals 510-590 is biasing the cartridge 100*a* upward. Also, the engaging projection 150*a* provided on the second side surface 103*a* of the cartridge 100*a* is inserted into an engaging hole 2150 of the cartridge attachment unit 2100. Moreover, the engaging projection 162*a* of the lever 160*a* provided on the first side surface 102*a* is engaged with the bottom surface of an engaging member 2160 of the cartridge attachment unit 2100. By the way, the lever 160*a* is formed with an elastic material and a bending stress is generated toward the right in FIG. 30 as if to push back the lever 160*a*. Because of this engagement between the engaging projection 162*a* and engaging member 2160, the cartridge 100*a* is prevented from being pushed upward. In normal insertion, the engaging projection 150*a* provided on the first surface 102*a* of the cartridge 100*a* is inserted into the engaging hole 2150 of the cartridge attachment unit 2100. Thereafter, when the front side (the side of the frontend surface 102*a*) of the cartridge 100*a* is pushed downward pivoting around the engaging projection 150*a*, the engaging projection 162*a* of the lever 160*a* provided on the front surface 102*a* of the cartridge 100*a* is engaged with the bottom surface of the engaging member 2160 of the cartridge attachment unit 2100 to complete the insertion.

The terminals 510-590 on the printing apparatus side get in contact with the terminals 210-290 on the board 200 at the contact portions cp thereof (FIG. 3A). The contact portions cp are smaller enough than the area of each terminal, and are in an approximate shape of a point. When the cartridge 100 is to be attached to the cartridge attachment unit 2100, the contact portions of the terminals 510-590 on the printing apparatus side move upward in the SD direction sliding over the terminals 210-290 of the board 200 from around the bottom edges of the terminals 210-290, and stop at the positions where the respective cartridge-side terminals are in contact with all the corresponding apparatus-side terminals when the attachment is completed. In the printing apparatus using the contact mechanism 2400 shown in FIG. 29, the sliding distance of the contact portions cp is shorter than that of the first embodiment. However, since the sliding of the contact portions cp makes a better electrical contact by eliminating oxide film as well as dirt or dust on the terminals, it is preferable to take a sliding distance long enough.

In the situation where the cartridge 100*a* is properly attached, the apparatus-side terminals 510-590 of the contact mechanism 2400 (FIG. 29) and the terminals 210-290 of the board 200 in the cartridge 100*a* are in good contact. Also, the ink supply outlet 110*a* of the cartridge 100*a* gets connected to the ink supply pipe 2080 of the print head 2050. However, the cartridge attachment unit 2100 has a small allowance within it to accommodate for an easy attachment of the cartridge 100*a* so that the cartridge 100*a* may often be inserted in a slightly slanted position. Slanted cartridge may result in poor contact at some terminals.

Figure 31A:
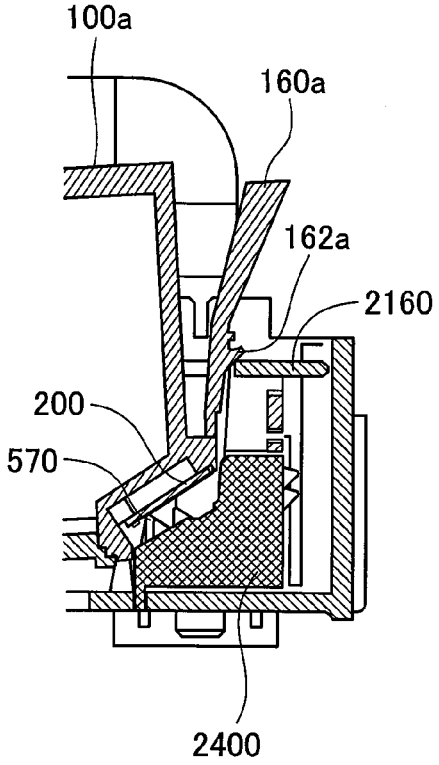
FIGS. 31A-31C show how the apparatus-side terminals get in contact with the circuit board terminals when the cartridge is attached.
Figure 31B:
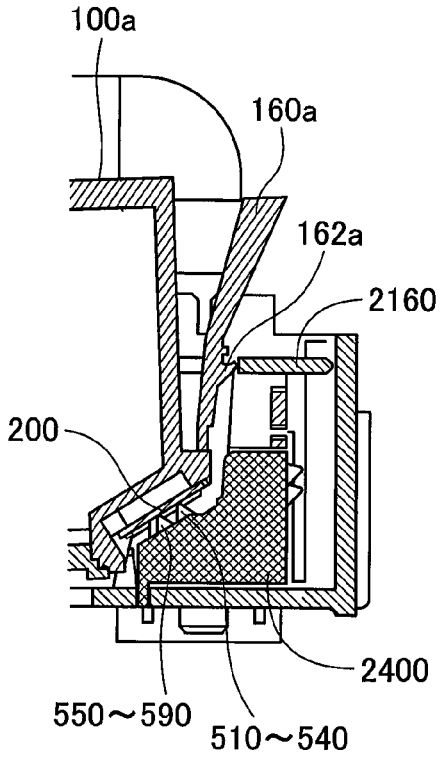
Figure 31C:
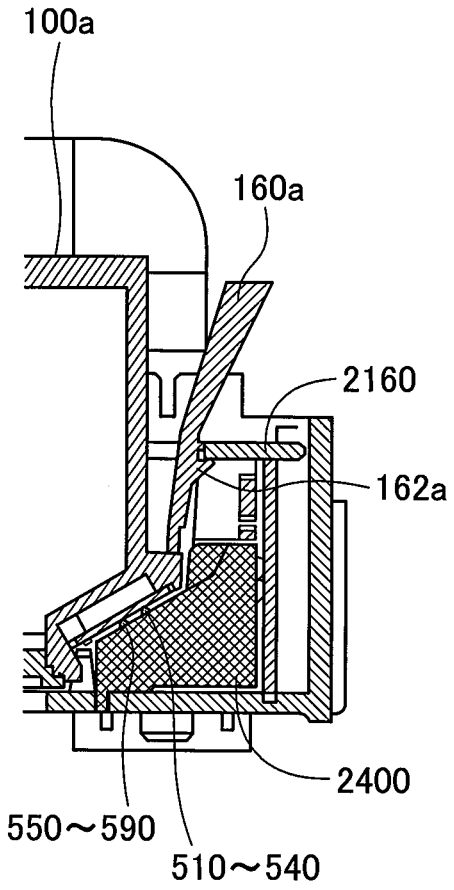

FIGS. 31A-31C show how the apparatus-side terminals 510-590 of the contact mechanism 2400 get in contact with the terminals of the board 200 when the cartridge 100*a* is attached. Meanwhile, prior to the situations shown in FIGS. 31A-31C, the engaging projection 150*a* (FIG. 30) provided on the rear surface (left end in the figure) of the cartridge 100*a* is inserted into the engaging hole 2150 of the cartridge attachment unit, which is omitted in FIGS. 31A-31C. FIG. 31A shows a situation where only one terminal 570 among the apparatus-side terminals 510-590 gets in contact with the ground terminal of the board 200. As mentioned above, since this apparatus-side terminal 570 protrudes higher than the other terminals 510-560, 580 and 590, the other apparatus-side terminals are not in contact with the terminals of the board 200 when only the apparatus-side terminal 570 is in contact with the terminal of the board 200. Thereafter, when the user pushes further down the cartridge 100*a*, the other apparatus-side terminals 510-560, 580 and 590 also get in contact with the terminals of the board 200 as shown in FIG. 31B. Then, as the user pushes down the cartridge 100*a* further, the cartridge is attached completely as shown in FIG. 31C. At this time, the engaging projection 162*a* of the lever 160*a* is engaged with the bottom surface of the engaging member 2160 of the cartridge attachment unit 2100 to prevent cartridge 100*a* from moving upward.

Meanwhile, in the situation between what are shown in FIGS. 31A and 31B, among the nine apparatus-side terminals 510-590, the only terminal that exerts an upward force on the cartridge 100*a* is the terminal 570. The terminal 570 is to get in contact with the central terminal 270 (FIG. 3A) of the board 200, and the contact occurs near the center of the board 200 in the direction of the board's width (a dimension in the direction perpendicular to the slant surface direction SD). However, due to a slight allowance between the holder (cartridge attachment unit) and the cartridge to accommodate for an easy attachment of the cartridge, the apparatus-side terminal 570 located at the center gets in contact with the board 200 rarely at the center in its width direction but usually at a slightly off-centered location. In case the apparatus-side terminal 570 is off-centered, even slightly, to the right or left from the width center of the board 200, the upward biasing force of the apparatus-side terminal 570 would work unevenly in the axial direction of the board 200 and cartridge 100*a* (perpendicular to the slant surface direction SD in FIG. 28 and parallel to the row of terminals) in the situation between what are shown in FIGS. 31A and 31B. As a result, the cartridge 100*a* and its board 200 end up being tilted in their width direction. Also, in the situation between what are shown in FIGS. 31B and 31C, since displacement of the apparatus-side terminal 570 is larger than those of other apparatus-side terminals, the apparatus-side terminal 570 may exert a larger biasing force on the cartridge 100*a* than the other apparatus-side terminals. As a result, for the same reason as above, the cartridge 100*a* and its board 200 end up being tilted in their width direction. Thus, cartridge 100*a* and its board 200 are likely to tilt, too, in case of the printing apparatus 2000 and cartridge 100*a* shown in FIGS. 27 and 28. Therefore, it is significant to carry out the process of detecting poor contact of the terminals as explained in each of the above embodiments.

Figure 32A:
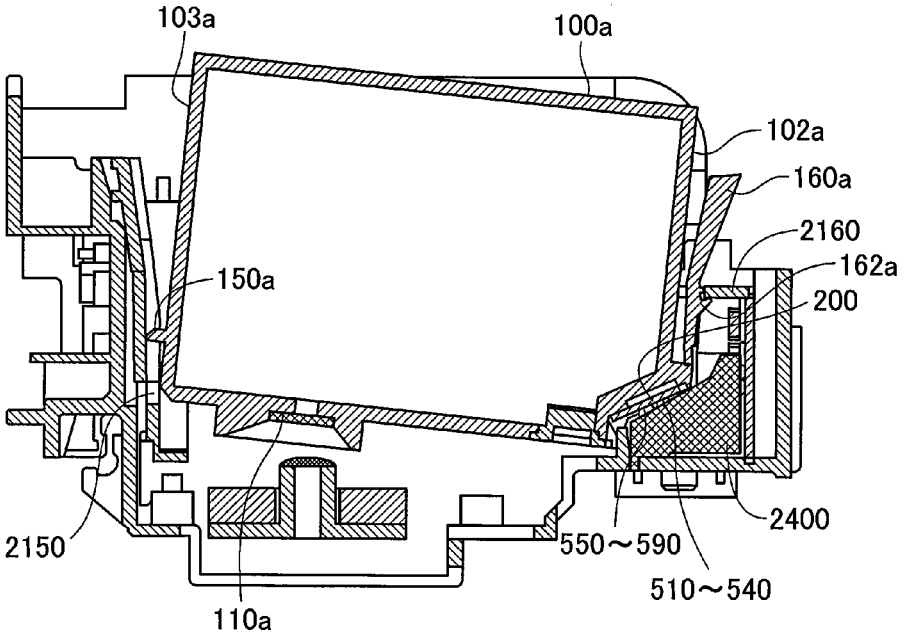
FIGS. 32A and 32B show how the front end of the cartridge is engaged followed by the rear end.
Figure 32B:
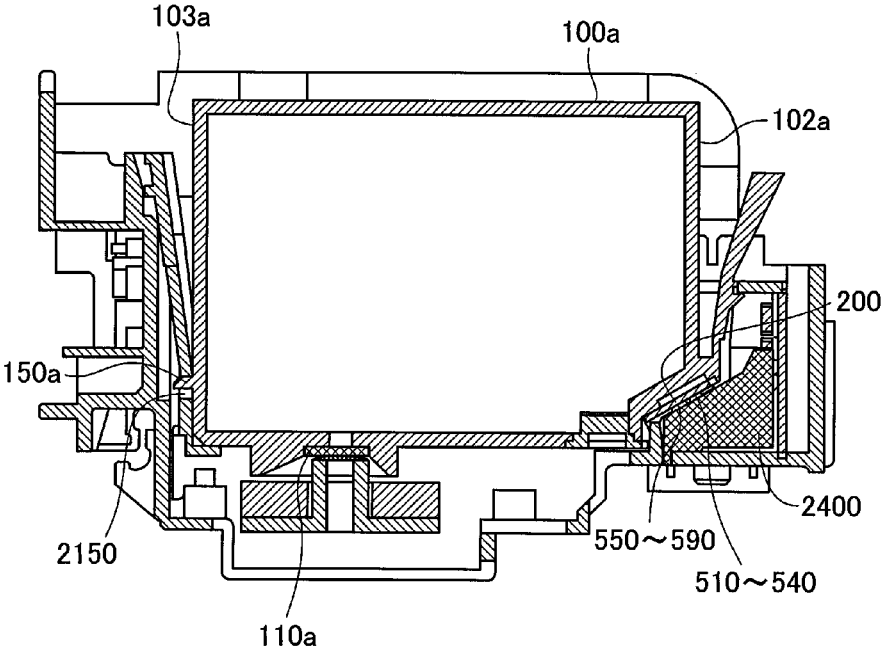

FIGS. 32A and 32B show a procedure where the cartridge's rear end is engaged after the front end is engaged. In FIG. 32A, the front end of the cartridge 100*a* (right side in the figure) is first pushed down so that the engaging projection 162*a* of the lever 160*a* gets engaged with the bottom surface of the engaging member 2160 of the cartridge 2100. Then, the rear end of the cartridge 100*a* is pushed down so that the engaging projection 150*a* provided on the rear surface 103*a* is inserted into the engaging hole 2150 of the cartridge attachment unit 2100 as shown in FIG. 32B. Depending on the configuration of the cartridge 100*a* and cartridge attachment unit 2100, the front end and rear end of the cartridge may possibly be inserted in a reverse order to those shown in FIGS. 31A-31C. In that case, since the biasing force exerted by the apparatus-side terminals 510-590 on the board of the cartridge 100*a* is uneven, the cartridge 100*a* and its board 200 are likely to tilt, as is the case with the attachment procedures shown in FIGS. 31A-31C. Therefore, in this case, too, it is significant to carry out the process of detecting poor contact of the terminals as explained in each of the above embodiments.

Figure 33A:
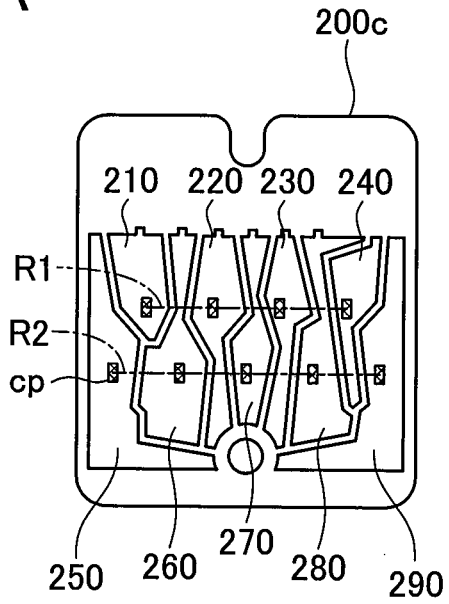
FIGS. 33A-33G show the circuit board configurations according to another embodiment.
Figure 33B:
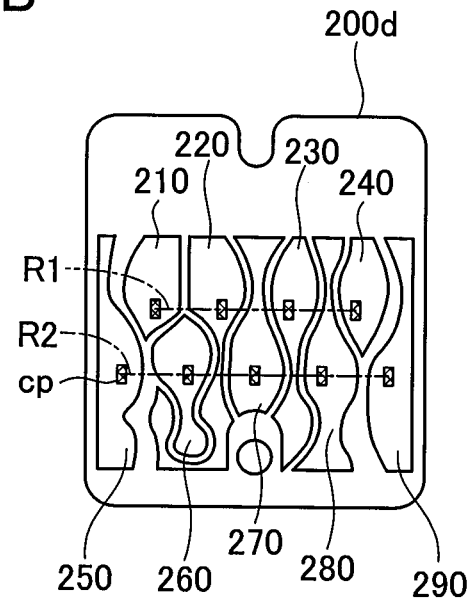
Figure 33C:
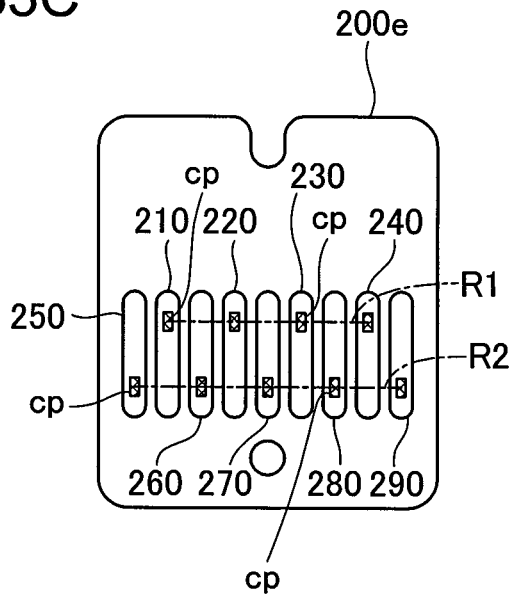
Figure 33D:
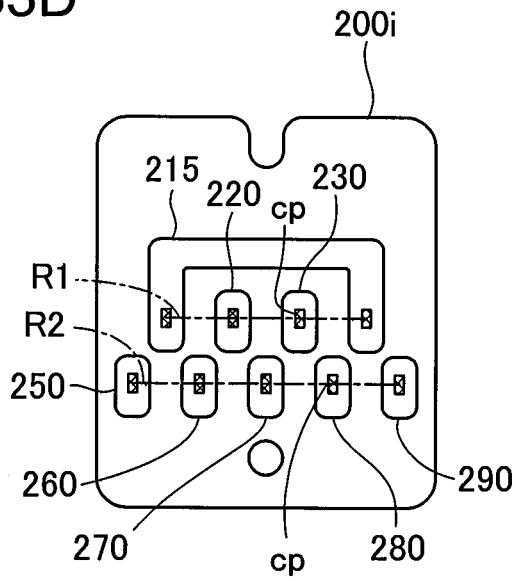
Figure 33E:
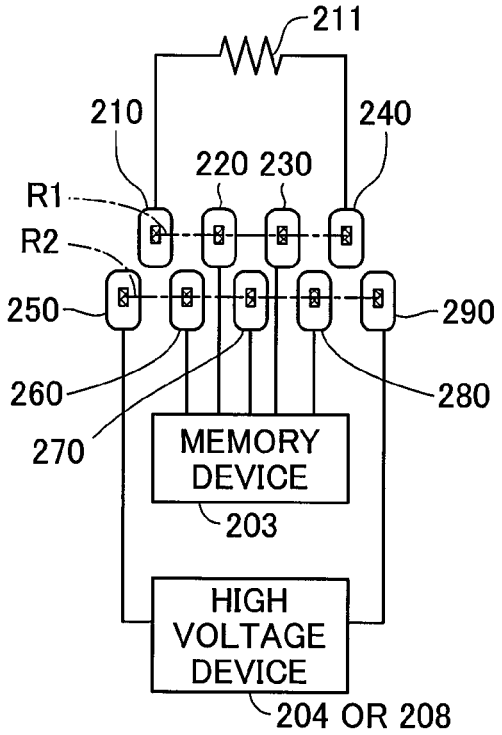

FIGS. 33A-33D show configurations of the boards according to other embodiments. These boards 200*c*-200*e*, 200*i* have differences in the surface shape from the board 200 and terminals 210-290 shown in FIG. 3A. Each of the boards 200*c* and 200*d* of FIGS. 33A and 33B has terminals, not in an approximate shape of a quadrangle but an irregular shape. The board 200*e* of FIG. 33C has nine terminals 210-290 aligned in one row, where the first set of attachment detection terminals 250-290 (terminals that are supplied with a high voltage in the second and third embodiment) are placed at both ends. Also, the second set of attachment detection terminals 210 and 240 are placed between the memory terminals 260 and 280. These boards 200*c*-200*e* have the same arrangement of contact portions cp as the board 200 in FIG. 3A concerning the contact with the apparatus-side terminals corresponding to each of the terminals 210-290. The board 200*i* of FIG. 33E has one combined terminal 215 corresponding to the two terminals 210 and 240 in FIG. 3A, but the shapes of the other terminals of FIG. 33E are the same with those of FIG. 3A. Since the two terminals 210 and 240 are in short-circuit connection on the board 200 of FIG. 3A, these terminals 210 and 240 may be combined into the single terminal 215 while maintaining their functions. Thus, the surface shape of each terminal may be varied in different ways as long as the arrangement of contact portions remains the same. Meanwhile, the roles (functions) of the terminals 210-290 are not limited to the ones in FIG. 3A (first embodiment) but are also applicable to those explained in FIG. 8 (second embodiment) and FIG. 20 (third embodiment). Moreover, it is possible to achieve nearly the same effect as in the first, second and/or third embodiment by applying them to these various boards. The same holds true for other boards explained below.

On the boards 200*c*-200*e*, 200*i* in FIGS. 33A-33D, as is the case for the board 200 in FIG. 3A, the contact portions cp of the four attachment detection terminals 210, 240, 250 and 290 are placed at both ends of the upper and lower bases of the trapezoidal area. Therefore, it has an advantage of lowering the risk of misjudgment on the attachment conditions compared to the situation where the contact portions of the attachment detection terminals are placed at four corners of a rectangular area.

Figure 33F:
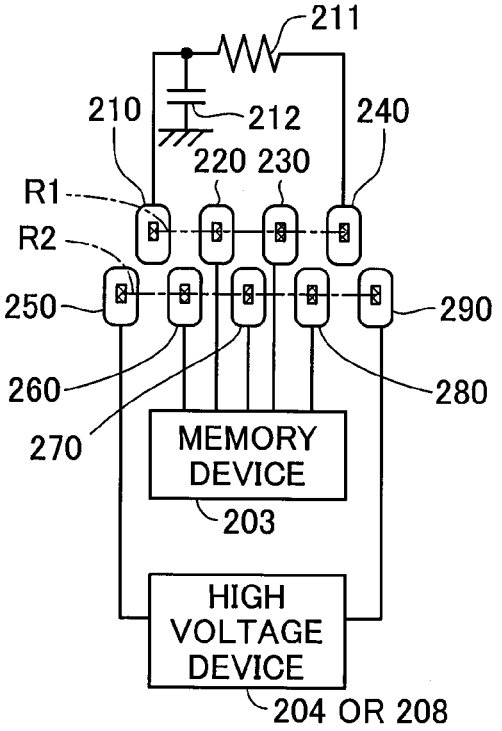
Figure 33G:
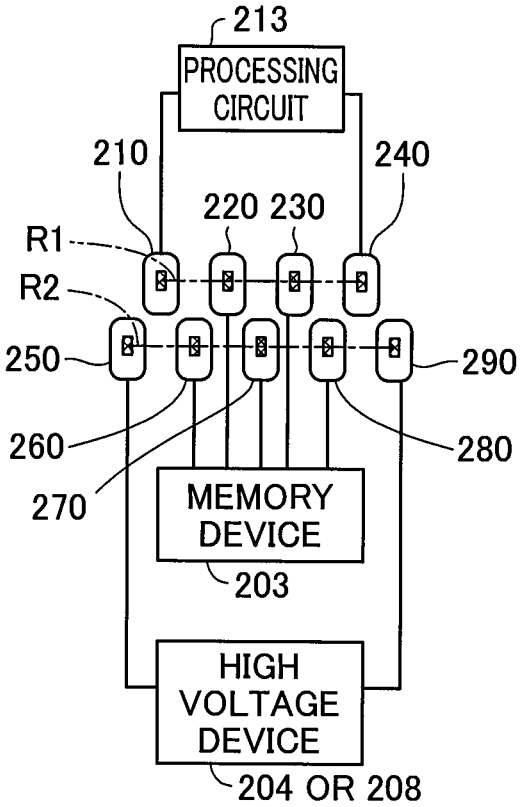

FIGS. 33E-33G show variation examples of connection between the two terminals 210 and 240. FIGS. 33E-33G also show, for reference, the connection relation between the memory terminals 220, 230, 260-280 and the memory device 203, and the connection relation between the terminals 250, 290 and a high voltage device. In FIG. 33E, a resistance 211 is connected in between the terminals 210 and 240. In addition to the configuration of FIG. 33E, FIG. 33F shows a configuration where the wiring between the resistance 211 and the terminal 210 is grounded via a condenser 212. FIG. 33G shows a configuration where a processing circuit (logic circuit) 213, instead of the resistance 211 and condenser 212, is connected in between the terminals 210 and 240. Also in the circuits of FIG. 33E-33G, the circuit configuration is selected in such a way that, once the attachment inspection signal DPins is inputted to one of the terminals 210 and 240, the attachment response signal DPres at an appropriate level is outputted from the other terminal. Therefore, on those boards with circuit configurations as shown in FIG. 33E-33G, it is possible to perform the non-attached condition detection process described in the second embodiment (FIG. 10) and the third embodiment (FIG. 22) using the terminals 210 and 240. Thus, the terminals 210 and 240 do not have to be in short-circuit connection with each other, and they may be connected via certain circuits or circuit elements. However, if at least one of the two terminals 210 and 240 is directly connected to the ground terminal, the non-attached condition detection unit 670 cannot receive the proper attachment response signal DPres, which prevents the non-attached condition detection from being performed properly. This holds true for a situation where at least one of the two terminals 210 and 240 is connected to a fixed voltage (e.g. VDD) other than the ground voltage. As understandable from the above descriptions, it is preferable to have the terminals 210 and 240 connected with each other and not to have either of them connected to a fixed voltage in order to perform the non-attached condition detection process properly. Here, the phrase "to have the terminals 210 and 240 connected with each other and not to have either of them connected to a fixed voltage" means that the connection relation allows an attachment detection using the attachment inspection signals DPins and Dpres. Such a connection relation is, for example in FIG. 10, the one that produces the waveforms of the first attachment response signal DPres, which is received by the non-attached condition detection unit 670 in response to the first attachment inspection signal DPins from the detection pulse generation unit 650, allows proper evaluation of attached and non-attached conditions (e.g. waveforms that allows proper distinction between high and low levels).

In the configurations of FIGS. 33E and 33F, the four attachment detection terminals 210, 240, 250 and 290 and contact portions cp thereof are not directly connected to the ground voltage. Therefore, it has an advantage of avoiding the risk of lowering the reliability of the system that may otherwise erroneously identify a non-attached cartridge as attached, as explained in the section of Related Art. Also, in the configurations of FIGS. 33E and 33F, the attachment detection terminals 210, 240, 250 and 290 may not be able to perform attachment detection if they are short-circuited with the ground terminal 270 due to dirt or dust. In order to prevent such a condition, the ground terminal 270 is preferably placed at a position farthest from the attachment detection terminals 210, 240, 250 and 290 (i.e. at the center of the lower row R2).

Figure 34A:
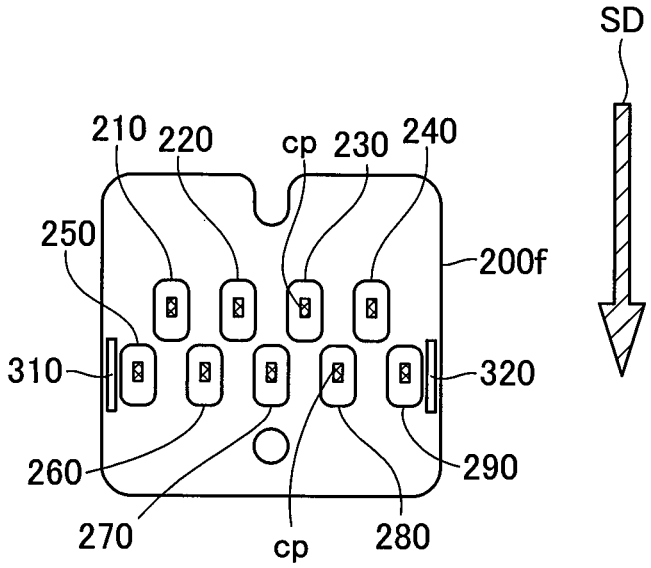
FIGS. 34A-34C show the circuit board configurations according to another embodiment.
Figure 34B:
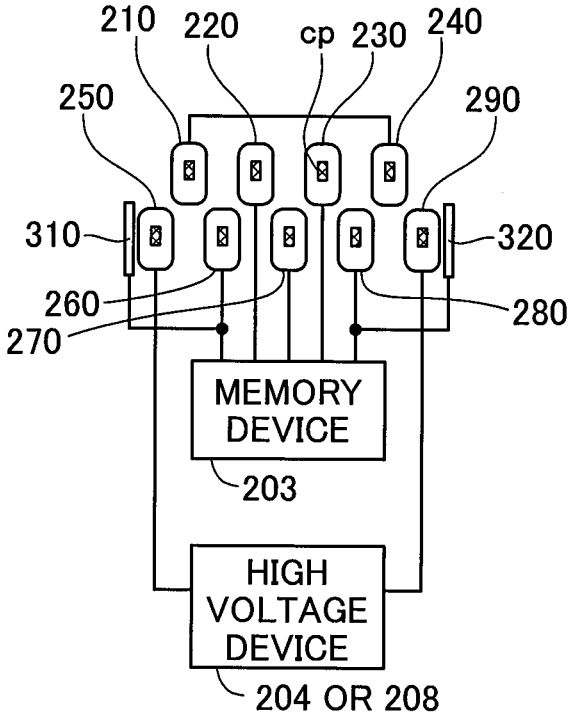
Figure 34C:
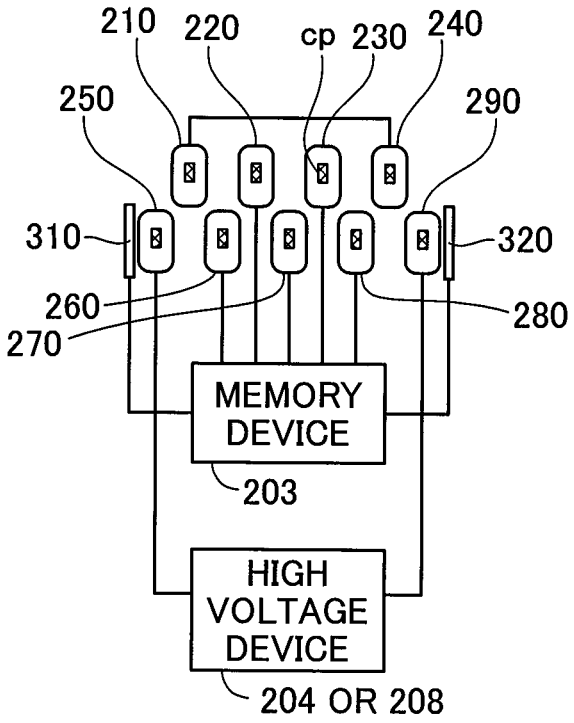

FIG. 34A is a diagram showing the circuit board configurations according to still another embodiment. This board 200*f* has the same arrangement of contact portions cp as the board 200 of FIG. 3A concerning the contact with nine terminals 210-290, but is different from the board 200 of FIG. 3A in that two extra terminals 310 and 320 are provided in addition to the nine terminals 210-290. The two extra terminals 310 and 320 are placed further out from the terminals 250 and 290 at both ends of the terminals 250-290 in the lower row with each contact portion cp. FIG. 34B shows an example of connections when this board 200*f* is used in the second or third embodiment. In FIG. 34B, the extra terminals 310 and 320 are connected to the memory terminals with each contact portion cp (e.g. terminals 260, 280). In FIG. 34C, the extra terminals 310 and 320 are directly connected to the memory device 203. Since these extra terminals 310 and 320 do not have contact portions with the apparatus-side terminals, they have no function when attached to a printing apparatus. However, extra terminals 310 and 320 may be used for inspecting the board 200*f* under a condition where the cartridge is not attached (or in a single form of the board 200*f*). Also, the extra terminals 310 and 320 may be provided as dummy terminals with no function. The same holds true for other boards explained below as to the functions of these extra terminals.

Figure 35A:
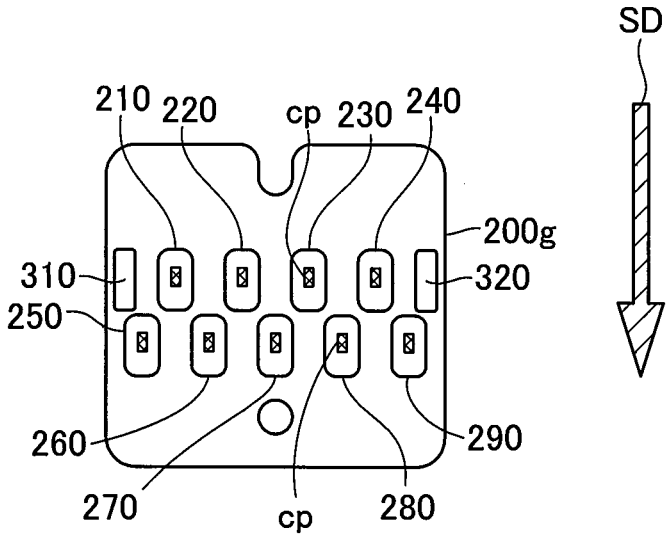
FIGS. 35A-35C show the circuit board configurations according to another embodiment.
Figure 35B:
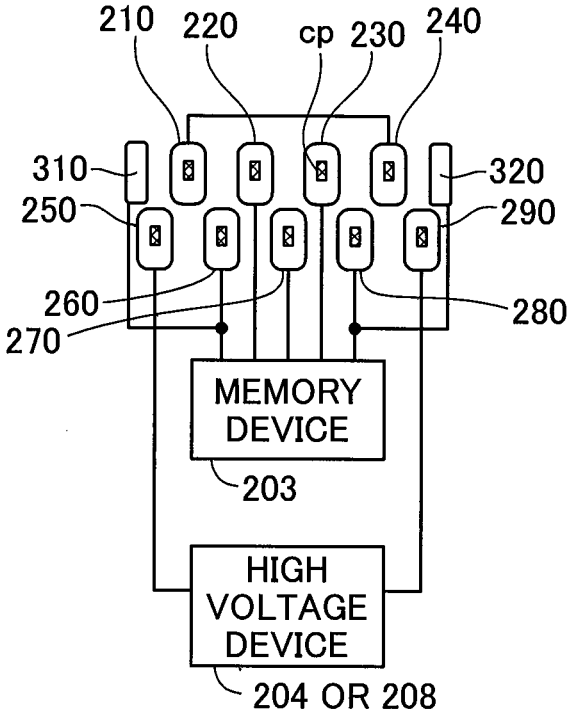
Figure 35C:
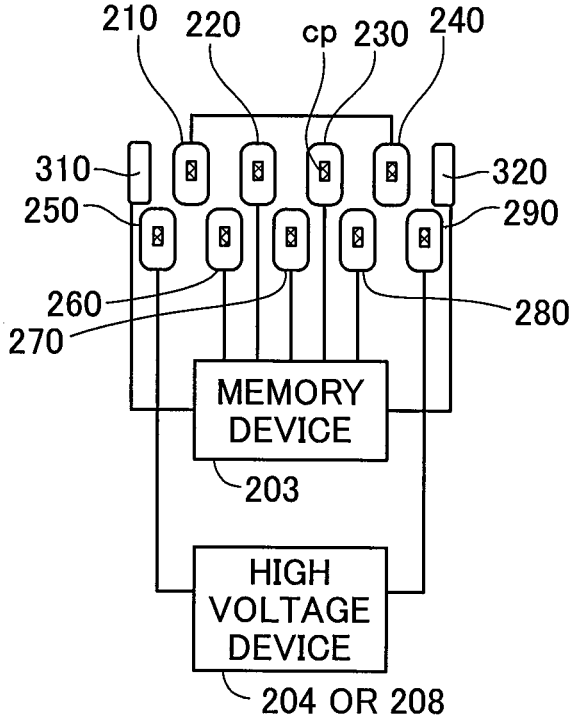

FIG. 35A is a diagram showing the circuit board configurations according to still another embodiment. This board 200*g* has the same arrangement of contact portions cp as the board 200 of FIG. 3A concerning the contact with nine terminals 210-290, but is different from the board 200 of FIG. 3A in that two extra terminals 310 and 320 are provided in addition to the nine terminals 210-290. The two extra terminals 310 and 320 are placed further out from the terminals 210 and 240 at both ends of the terminals 210-240 in the upper row with each contact portion cp. FIGS. 35B and 35C show examples of connections when this board 200*g* is used in the second or third embodiment. In FIG. 35B, the extra terminals 310 and 320 are connected to the memory terminals with each contact portion cp (e.g. terminals 260, 280). In FIG. 35C, the extra terminals 310 and 320 are directly connected to the memory device 203.

Figure 36A:
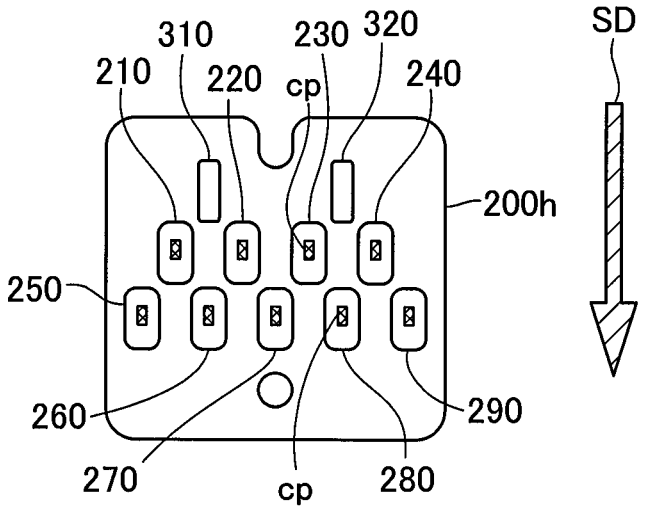
FIGS. 36A-36C show the circuit board configurations according to another embodiment.
Figure 36B:
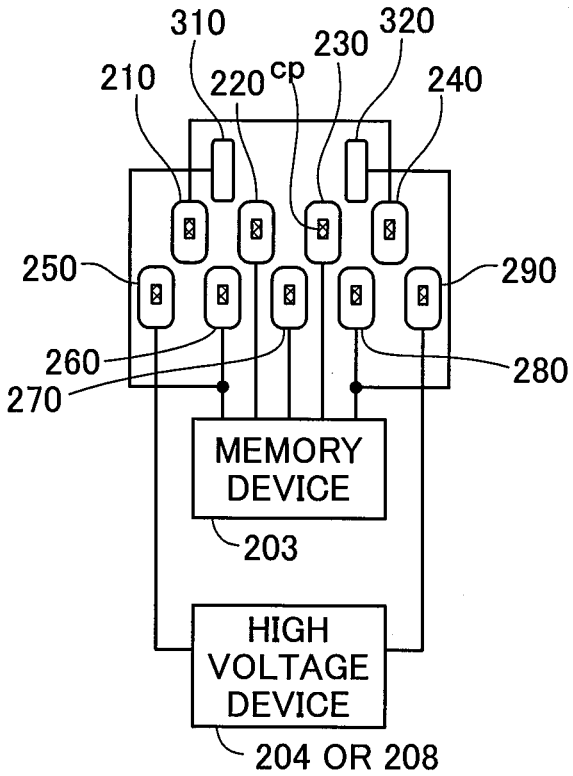
Figure 36C:
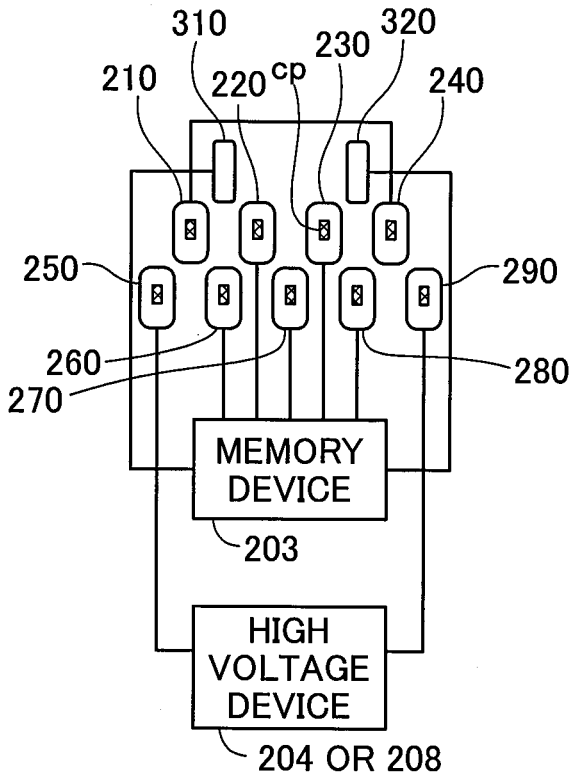

FIG. 36A is a diagram showing the circuit board configurations according to still another embodiment. This board 200*h* has the same arrangement of contact portions cp as the board 200 of FIG. 3A concerning the contact with nine terminals 210-290, but is different from the board 200 of FIG. 3A in that two extra terminals 310 and 320 are provided in addition to the nine terminals 210-290. The two extra terminals 310 and 320 are placed further up (on the front side of the attachment direction or slant surface direction SD) from the terminals 210-240 in the upper row with each contact portion cp. FIGS. 36B and 36C show examples of connections when this board 200*h* is used in the second or third embodiment. In FIG. 36B, the extra terminals 310 and 320 are connected to the memory terminals (e.g. terminals 260, 280) with each contact portion cp. In FIG. 36C, the extra terminals 310 and 320 are directly connected to the memory device 203.

Figure 37:
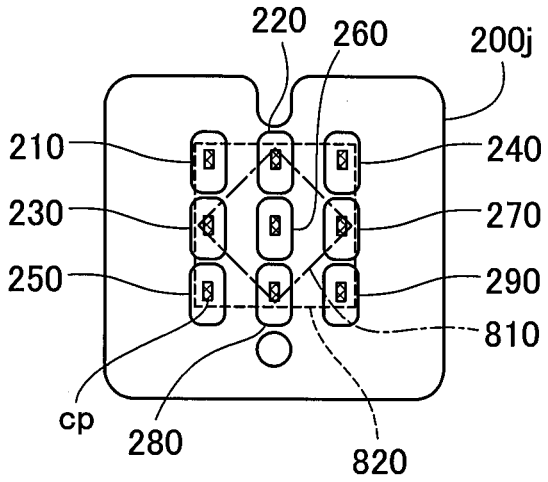
FIG. 37 shows the circuit board configuration according to another embodiment.

FIG. 37 is a diagram showing the circuit board configurations according to still another embodiment. This board 200*j* with no extra terminal has only nine terminals 210-290 with each contact portion cp. However, it is different from the board 200 in FIG. 3A in that the nine terminals 210-290 are arranged in three rows. That is, three terminals 210, 220 and 240 are placed in the top row (on the foremost side in the attachment direction or slant surface direction SD), and three terminals 230, 260 and 270 are placed in the center row, while three terminals 250, 280 and 290 are placed in the bottom row. In this example, nine terminals are arranged in 3×3 matrix, although other arrangement may be adopted. As is the case with the board 200 in FIG. 3A, plural contact portions cp for the memory device are placed in the first area 810 within an area where all nine contact portions are placed. Contact portions of the four attachment detection terminals 210, 240, 250 and 290 are placed outside the first area 810. Also, these contact portions of the four attachment detection terminals 210, 240, 250 and 290 are placed at four corners of the second area 820 in a quadrangular shape that encompasses the first area 810. The shape of the first area 810 is preferably a quadrangle with a minimum area encompassing contact portions of the four attachment terminals 210, 240, 250 and 290. Alternatively, the shape of the first area 810 may be a quadrangle that circumscribes contact portions of the attachment detection terminals 210, 240, 250 and 290. The shape of the second area 820 is preferably a small quadrangle with a minimum area that encompasses all contact portions.

Concerning the various boards shown in FIGS. 33A-37 described above, contact portions of the two attachment detection terminals 210 and 240 in the upper row R1 are respectively placed at both ends of the upper row R1, that is at the outermost positions of the upper row R1, whereas contact portions of the two attachment detection terminals 250 and 290 in the lower row R2 are respectively placed at both ends of the lower row R2, that is at the outermost positions of the lower row R2. For this reason, it is possible to obtain more or less the same effect as described in each embodiment for these various boards by applying the process of detecting poor contact, unintended shorting and leak and the like explained in the first through third embodiments.

Figure 38A:
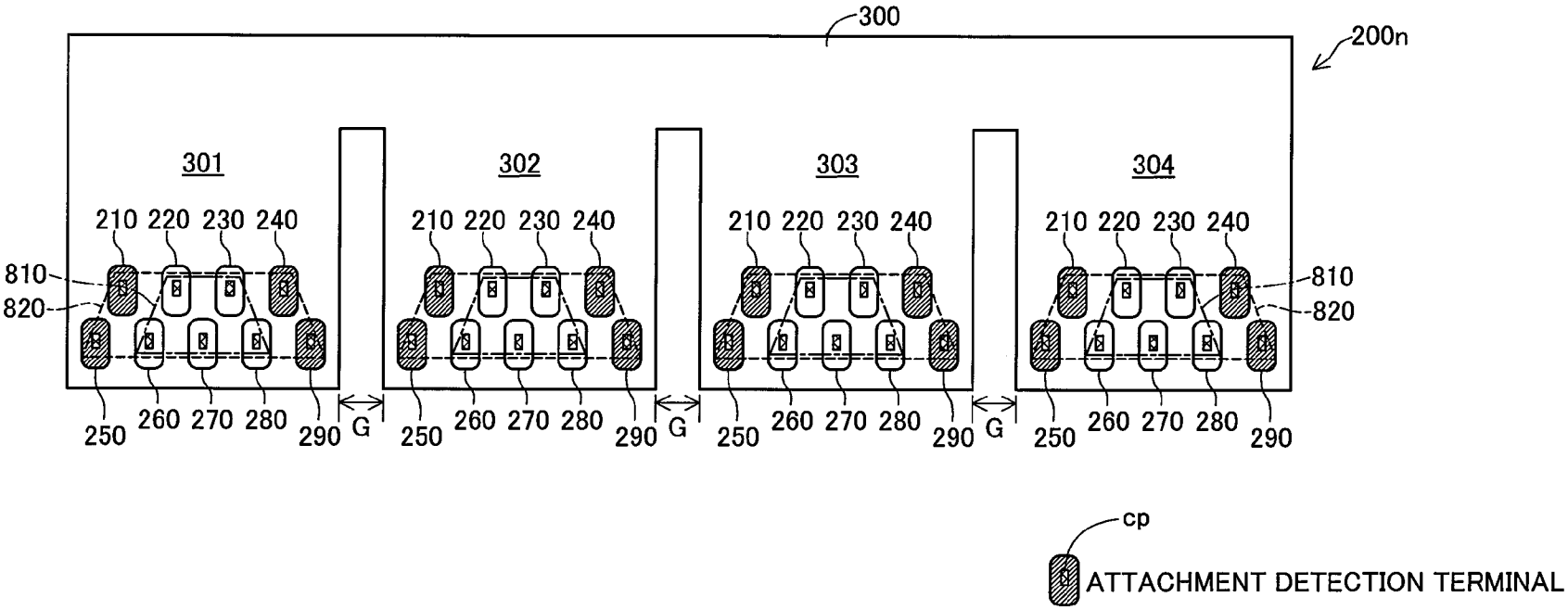
FIGS. 38A and 38B show the common circuit board configuration for other embodiments.

FIG. 38A is a diagram showing a common circuit board configuration to be used for other embodiments. This common board 200*n* is in a form wherein four small board sections 301-304 per each of the four cartridges are connected by the connecting section 300. Between each pair of plural small board sections exist a gap G. The size of this gap G is typically about 3 mm or more. In each small board section, the distance from each of the nine terminals 210-290 to a closest terminal is less than 1 mm. Also, contact portions cp of the nine terminals 210-190 within each small board section are aligned with almost constant intervals. In other words, contact portions of the nine terminals 210-290 on each small boar section are arranged more or less evenly. It is possible to connect the four sets of terminals on the common board 200*n* at the same time as connecting the apparatus-side terminals for four cartridges within the cartridge attachment unit 2100 by attaching the common board 200*n* to the cartridge attachment unit 2100 shown in FIG. 27. In this case, ink containers (ink tanks) may be attached to the cartridge 2100 separately from the common board 200*n*. Or otherwise, plural ink tanks may be installed at a location outside the cartridge attachment unit 2100 so that ink is supplied from these ink tanks to the print head 2050 of the carriage 2030 via supply tubes. Also, the common board 200*n* may used for a multi-color integrated cartridge with an ink tank divided into several ink chambers.

Each of the small board sections 301-304 of the common board 200*n* includes the same plural terminals 210-290 as those of the board 200 in FIG. 3A. The arrangement of these terminals 210-290 and their contact portions is the same as that of the board 200A of FIG. 3, FIG. 8 or FIG. 20. Various options may be adopted for the connection relation between the several sets of terminals 210-290 on the common board 200*n* and a memory device or a high-voltage device. For example, among N sets (N is an integer no less than 2) of terminals 210-290, N sets of memory terminals 220, 230, 260, 270 and 280 may be commonly connected to a single memory device or to N number of memory devices individually. Also, when applying this common board 200*n* to the second or third embodiment, N sets of terminals 250 and 290 may be commonly connected to a single high-voltage device (204 or 208) or to N number of high-voltage devices individually. Here, various devices (elements and circuits) may be also used as a high-voltage device other than resistance elements and sensors. For example, a variety of devices such as capacitors, coils and a combination of these may be used as high-voltage devices. The same holds true for other embodiments.

In each of the small board sections 301-304, contact portions of the attachment detection terminals 210, 240, 250 and 290 are placed at four corners of the cluster area 820 of contact portions of the plural terminals 210-290. Therefore, concerning each of the small board sections 301-304, it is possible to detect whether plural memory terminals enclosed by the attachment detection terminals 210, 240, 250 and 290 are surely in proper contact.

Figure 38B:
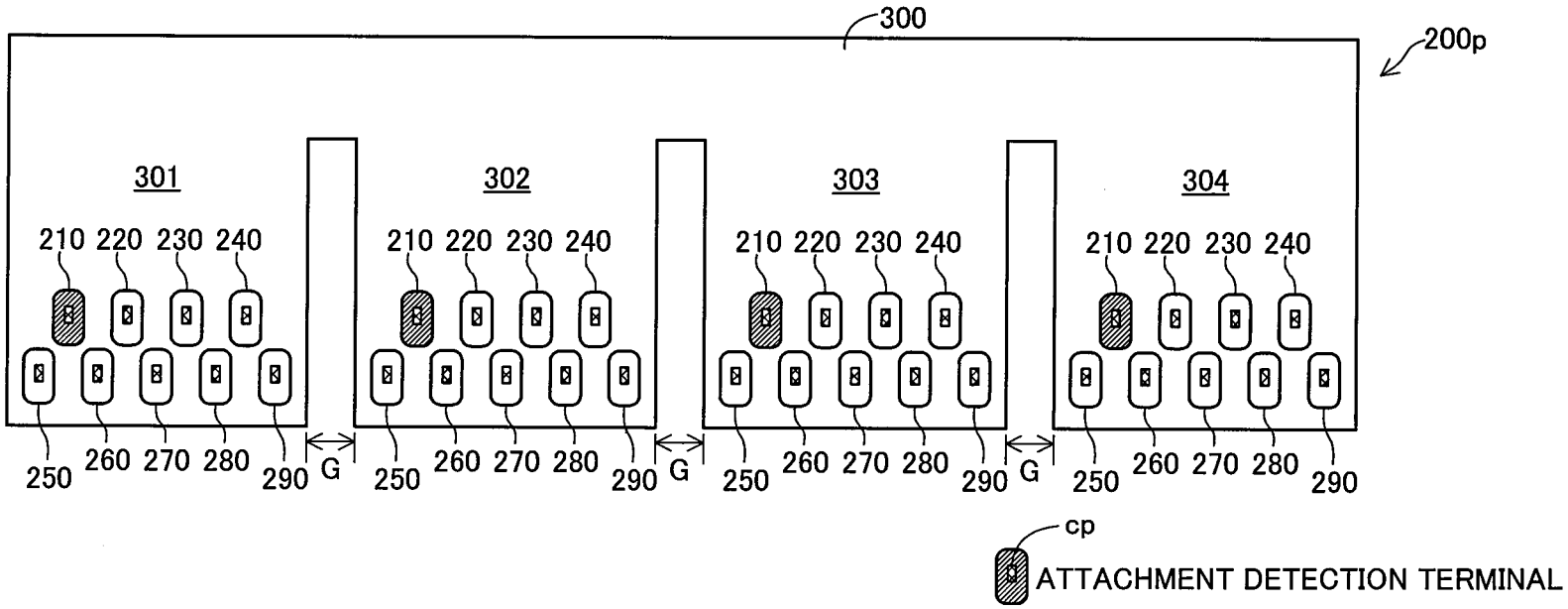

FIG. 38B shows a common circuit board configuration 200*p* as a comparative example. In this comparative example of the common board 200*p*, the only attachment detection terminal provided is one attachment detection terminal 210 per each of the plural small board sections 301-304. Since this comparative example of the common board 200*p* has only one attachment detection terminal in each small board section, it is impossible to detect whether plural memory terminals in each small board section are in proper attachment condition with good contact. Especially due to the gap G between each pair of plural small board sections, it is highly likely that the contact conditions of terminals in the plural small board sections 301-304 vary by each section. Therefore, if only one attachment detection terminal is provided in one small board section, it is impossible to detect whether plural memory terminals in each small board section are in proper attachment condition with good contact. The same may hold true for providing two attachment detection terminals in one small board section.

Thus, in using the common board 200*n*, it is possible to detect whether plural memory terminals in each small board section are in proper attachment condition with good contact by providing attachment detection terminals at four corners of the quadrangular cluster area defined by contact portions of a group of terminals provided in each small board section. In this specification, the word "board" refers to a circuit board member corresponding to a particular location (one holding slot) of one cartridge in the cartridge attachment unit. In other words, each of the small board sections 301-304 is a "board" in FIG. 38A.

Figure 39A:
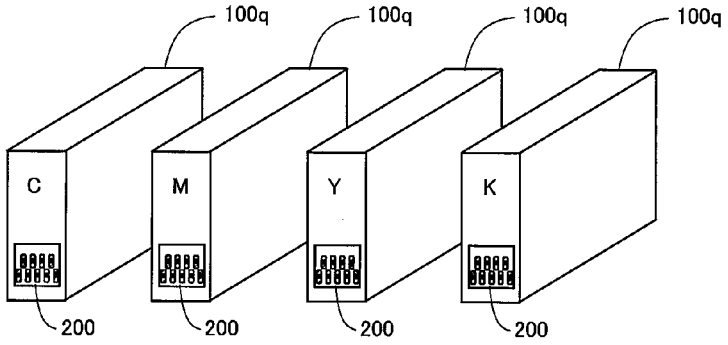
FIGS. 39A-39C show configurations of the color-by-color independent cartridges, integrated multi-color cartridge compatible therewith, and their common circuit board.
Figure 39B:
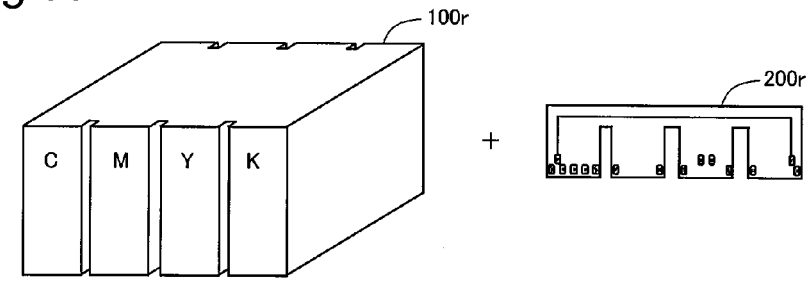
Figure 39C:
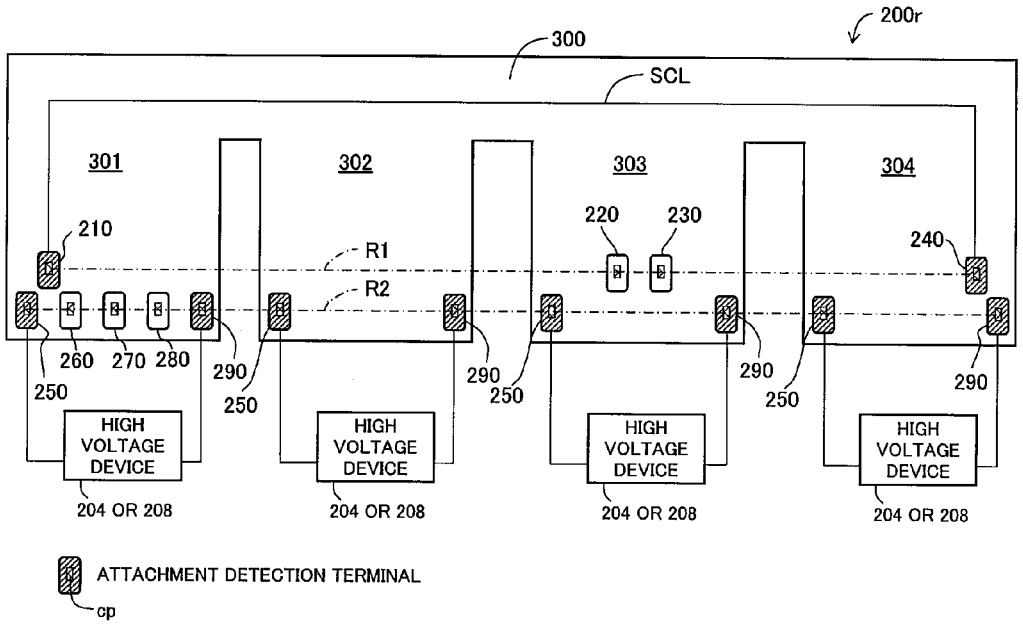

FIGS. 39A-39C show configurations of color-by-color independent cartridges, an integrated multi-color cartridge compatible therewith, and their common circuit board. In FIGS. 39A-39C, the structures of cartridges and circuit boards are simplified for the convenience of illustration. The cartridges 100*q* in FIG. 39A are color-by-color independent cartridges, each of which has the circuit board 200 on its front surface. These cartridges 100*q* are independently attachable to the cartridge attachment unit.

FIG. 39B shows a multi-color integrated cartridge 100*r* with its ink container divided into plural chambers to store plural color ink and a common board 200*r* to be used for it. The multi-color integrated cartridge 100*r* is compatible with the four independent cartridges 100*q*, and is in a form attachable to the cartridge attachment unit (or holder) to which four independent cartridges 100*q* are attached. The common board 200*r* may be attached to the cartridge attachment unit together with the multi-color integrated cartridge 100*r* while the board 200*r* is pre-attached to the cartridge 100*r*. Or otherwise, it is possible to attach the common board 200*r* and multi-color integrated cartridge 100*e* separately to the cartridge attachment unit. In the latter case, for example, the common board 200*r* is first attached to the cartridge attachment unit, and then the multi-color integrated cartridge 100*r* is attached thereto.

FIG. 39C shows a configuration of the common board 200*r*. Like the common board 200*n* shown in FIG. 38A, this common board 200*r* has a form of four small board sections 301-304 per each of the four color-by-color independent cartridges 100*q* connected by the connecting section 300. In each of the small board sections 310-304, a pair of attachment detection terminals 250 and 290 are placed. This configuration is the same as that of the common board 200*n* in FIG. 38A. The differences between the common board 200*n* of FIG. 38A and the common board 200*r* of FIG. 39C are as follows:

<Difference 1> As to the common board 200*n* of FIG. 38A, the other pair of attachment detection terminals 210 and 240 are provided in each of the small board sections 301-304, whereas in case of the common board 200*r* of FIG. 39C, one attachment detection terminal 210 is placed on the small board section 301 at one end and the other detection terminal 240 is placed on the other small board section 304 at the other end, which are in short-circuit connection by a wiring SCL.

<Difference 2> As to the common board 200*n* of FIG. 38A, plural memory terminals 220, 230, 260, 270 and 280 are provided in each of the small board sections 301-304, whereas in case of the common board 200*r* of FIG. 39C, only one set of these memory terminals 220, 230, 260 270 and 280 are provided for the entire common board 200*r*.

In the example of FIG. 39C, the memory terminals 220 and 230 in the upper row R1 are provided in the third small board section 303, and the memory terminals 260, 270 and 280 in the lower row R2 are provided in the first small board section 301. Here, the functions of the memory terminals 220, 230, 260, 270 and 280 are the same as those explained in FIG. 3A. Each of the memory terminals 220, 230, 260, 270 and 280 may be placed in any of the small board sections 301-304 with no difference. This type of configuration may be adopted when memory devices of the circuit board 200 in the plural independent cartridges 100*q* are connected by a bus to the printing apparatus's control circuit.

Figure 40:
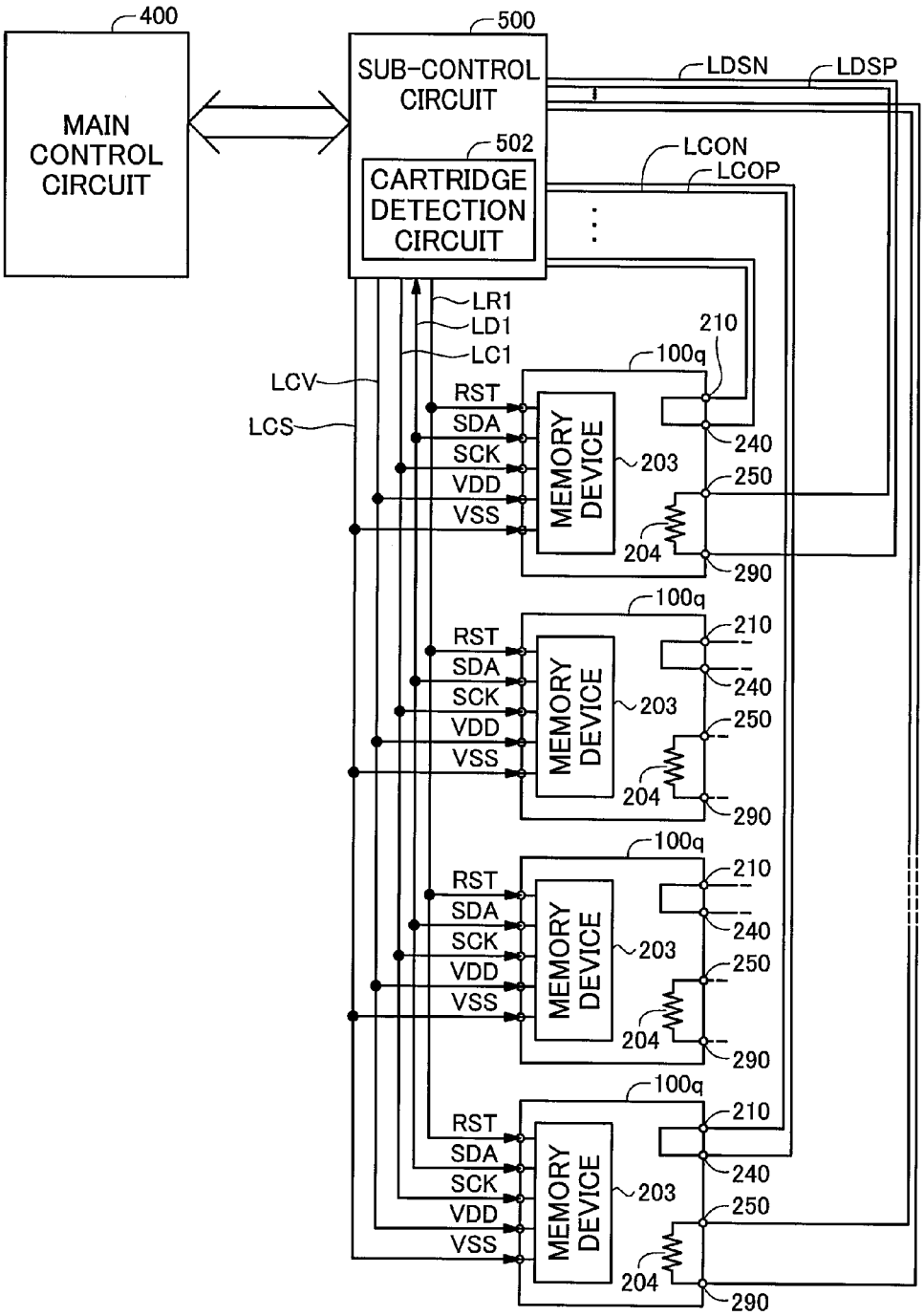
FIG. 40 shows a circuit configuration of the printing apparatus fit for the cartridge in FIG. 39B.

FIG. 40 is a diagram showing an electric configuration of a printing apparatus suitable for the cartridges of FIG. 39A. FIG. 40 shows a situation where the color-by-color independent cartridges 100*q* shown in FIG. 39A are attached. Memory device 203 of each cartridge 100*q* is connected by a bus to the sub-control circuit 500 by plural wirings LR1, LD1, LC1, LCV and LCS. On the other hand, the resistance element 204 of each cartridge 100*q* is connected individually to the cartridge detection circuit 502 by signal lines LDSN and LDSP. Also, the attachment detection terminals 210 and 240 of each cartridge 100*q* are individually connected to the cartridge detection circuit 502 by signal lines LCON and LCOP. The same configuration as the one shown in FIG. 22, for example, may be applied to the connection relation between the four terminals 210, 240, 250 and 290 for attachment detection and the cartridge detection circuit 502. According to this circuit configuration, the memory device 203 of each of the plural color-by-color independent cartridges is connected by a bus. Therefore, when the multi-color integrated cartridge 100*r* shown in FIG. 39B and the common board 200*r* are used in lieu of plural color-by-color independent cartridges 100*q*, at least one memory device may be provided to the common board 200*r*. Accordingly, in the common board 200*r* shown in FIG. 39C, only one set of memory terminals 220, 230, 260, 270 and 280 are provided for the entire common board 200*r*.

Figure 41:
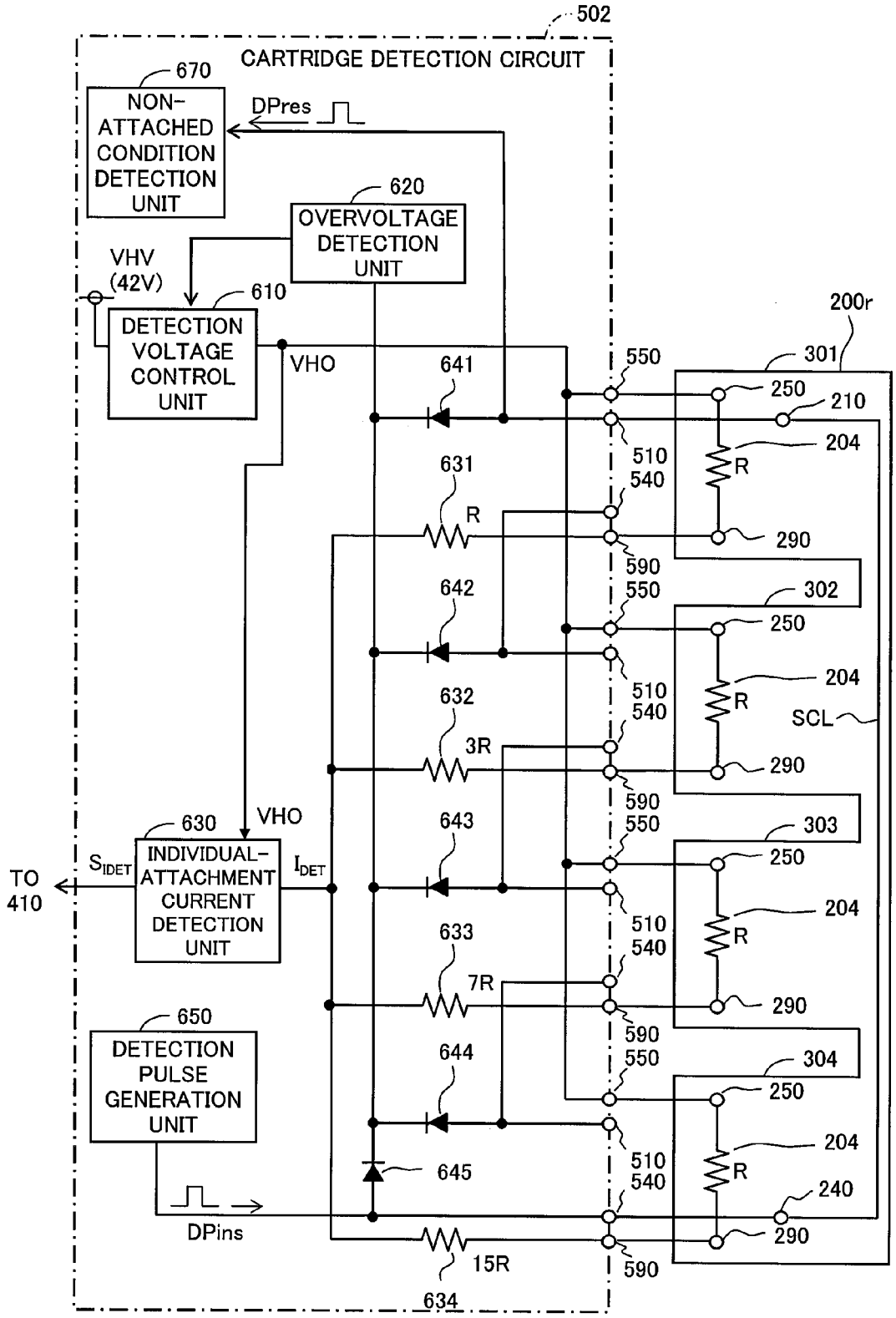
FIG. 41 shows the conditions of contact between the cartridge detection circuit and the common circuit board.

FIG. 41 is a diagram showing the condition of contact between the cartridge detection circuit 502 and the common board 200*r* of FIG. 39C. The circuit configuration of the cartridge detection circuit 502 is equivalent to that in FIG. 22, but the four cartridges IC1-IC4 in FIG. 22 are replaced by a common board 200*r* in FIG. 41. The pair of attachment detection terminals 250 and 290 connected to the resistance element 204 provided in each of the small board sections 301-304 are respectively connected to the corresponding apparatus-side terminals 550 and 590 of the cartridge detection circuit 502. Therefore, if each attachment detection process by the individual-attachment current detection unit 630 is carried out under the condition of having the common board 200*r* attached, it is judged that all cartridges are attached. Also, as mentioned above, in the common board 200*r*, one attachment detection terminal 210 is placed on the small board section 301 at one end and the other detection terminal 240 is placed on the other small board section 304 at the other end, which are in short-circuit connection by a wiring SCL. Therefore, when a process of non-attached condition detection is carried out by the detection pulse generation unit 650 and non-attached condition detection unit 670, it is judged that the cartridges are properly attached. Here, as evident by comparing FIG. 22 with FIG. 41, the circuit in FIG. 41 is configured in such a way that only the end terminals 240 and 210, among plural pairs of terminals 240 and 210 that are series-connected in sequence in the circuit of FIG. 22, are placed on the common board 200*r*, and these end terminals 240 and 210 are in short-circuit connection by a wiring SCL. Even when such a common board 200*r* is used, the cartridge detection circuit 502 evaluates the situation as properly attached, which allows the subsequent processes such as printing to be executed. As a high-voltage device for the common board 200*r*, those other than the resistance element 204 (e.g. sensor) may be used.

It is sufficient to provide at least one memory device 203 to the common board 200*r* in FIG. 39C, or one memory device 203 may be provided per each ink color. Also, one or more sets of the plural memory terminals 220, 230, 260, 270 and 280 may be provided depending on the number of memory devices 203.

In the common board 200*r* of FIG. 39C, like in the circuit board in FIG. 3A, contact portions cp of the plural terminals are divided into the upper row R1 (first row) and the lower row R2 (second row). That is, in the upper row R1, contact portions cp of the attachment detection terminals 210 and 240 as well as contact portions of the two memory terminals 220 and 230 are placed. Also, in the lower row R2, the plural pairs of attachment detection terminals 250 and 290 as well as the three memory terminals 260, 270 and 280 are placed. Since contact portions cp of attachment detection terminals are placed at both ends of the upper row R1 and the lower row R2, respectively, it is possible to accurately confirm the contact conditions of memory terminals located in between. Also, the distance between contact portions cp of the attachment detection terminals 210 and 240 at both ends of a set of contact portions cp of the plural terminals located in the upper row R1 is larger than the distance between two contact portions cp at both ends among contact portions cp of the memory terminals 260-280 located in the lower row R2. As mentioned above, in this configuration, contact portions cp of the four attachment detection terminals (two contact portions cp of the attachment detection terminals 210 and 240 located at both ends of the upper row R1, and two contact portions cp of the attachment detection terminal 250 in the small board section 301 and the attachment detection terminal 290 in the small board sections 304, located at both ends of the lower row R2) are placed outside the area where the memory terminals' contact portions are arranged, and at the same time, at four corners of a quadrangular area encompassing such area, which makes it possible to accurately evaluate on the printing apparatus side whether the cartridges are properly attached or not.

Figure 42A:
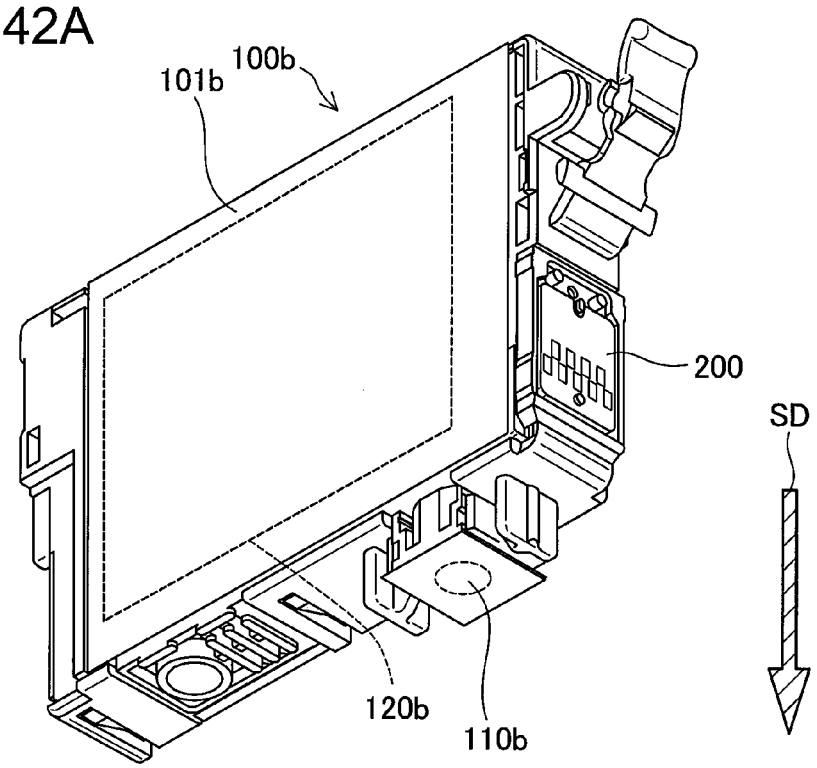
FIGS. 42A and 42B are perspective views showing a configuration of the ink cartridge according to another embodiment.
Figure 42B:
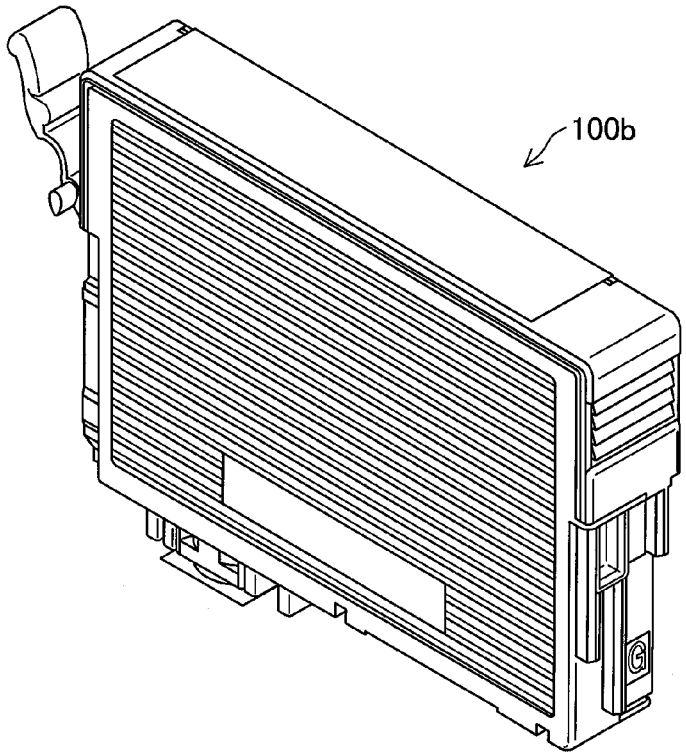

FIGS. 42A and 42B are perspective views showing a configuration of the cartridge according to another embodiment. This cartridge 100*b* too is for use in on-carriage type small format inkjet printers, and includes a case 101*b* in an approximate shape of cuboid to contain ink and a board 200. The attachment direction SD of this cartridge 100*b* and the board 200 (direction of attachment them in the cartridge attachment unit) is downward vertical. Inside the case 101*b*, an ink chamber 120*b* is formed to contain ink. On the bottom surface of the case 101*b*, an ink supply outlet 110*b* is formed. The opening of the ink supply outlet 110*b* is sealed with a film before use. This cartridge 110*b* is in a different shape from that of the cartridge 100*a* of FIG. 28. Especially, it is quite different from the cartridge 100*a* in FIG. 28 in that the board 200 is fixed on the vertical side surface of the case 101*b*. Various embodiments and variation examples mentioned above are applicable to the cartridge 100*b* and its board 200, too.

Figure 43:
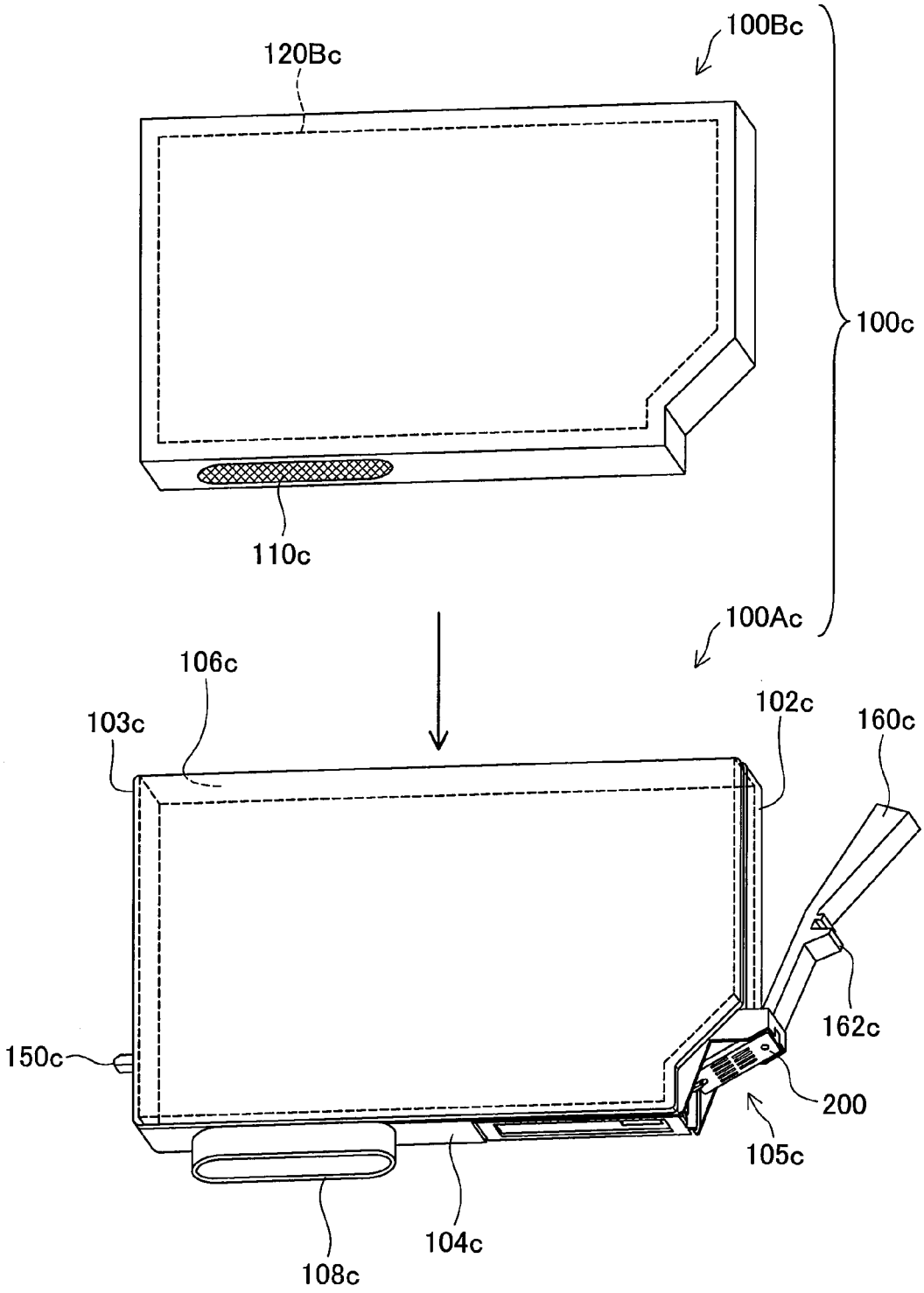
FIG. 43 is a perspective views showing a configuration of the ink cartridge according to another embodiment.

FIG. 43 is a perspective view showing a configuration of the cartridge according to still another embodiment. This cartridge 100*c* is divided into an ink container 100Bc and an adapter 100Ac. The cartridge 100*c* is compatible with the cartridge 100*a* of FIG. 28. The ink container 100Bc includes an ink chamber 120Bc and an ink supply outlet 110*c*. The ink supply outlet 110*c* is formed on the bottom surface of the case 101Bc and is communicated with the ink chamber 120Bc.

The adapter 100Ac is different in its appearance from the cartridge 100*a* of FIG. 28 only in that it has an opening 106*c* on its top in which a space for receiving the ink container 100Bc, and otherwise have almost the same outline shape as the cartridge 100*a* of FIG. 28. In other words, the adapter 100Ac is in an approximate shape of a cuboid as a whole, and its external surfaces are composed of five planes out of six orthogonally intersecting planes except the ceiling surface (top surface) and a slanted board holder 105*c* provided at the bottom corner. On the first side surface (frontend surface) 102*c* of the adaptor 100Ac, a lever 160*c* is provided, which is equipped with an engaging projection 162*c*. On the bottom surface 104*c* of the adaptor 100Ac, an opening 108*c* is formed that allows the ink supply tube 2080 of the cartridge attachment unit 2100 to pass through when the cartridge is attached to the cartridge attachment unit 2100. Under the condition where the ink container 100Bc is held in place in the adapter 100Ac, the ink supply outlet 110*c* of the ink container 100Bc is connected to the ink supply tube 2080 of the cartridge attachment unit 2100. Near the bottom end of the first side surface 102*c* of the adaptor 100Ac, a slanted board holder 105*c* is formed to which the board 200 is fixed. On the second side surface (back end surface) 103*c* opposing the first side surface 102*c*, an engaging projection 150*c* is provided.

In using this cartridge 100*c*, the ink container 100Bc is to be combined with the adapter 100Ac, and both of these are attached simultaneously to the cartridge attachment unit 2100. Alternatively, the adopter 100Ac may be attached first to the cartridge attachment unit 2100, and then the ink container 100Bc may be attached inside the adaptor 100Ac. In the latter case, the ink container 100Bc may be attached or detached independently while the adaptor 100Ac remains attached to the cartridge attachment unit 2100.

Figure 44:
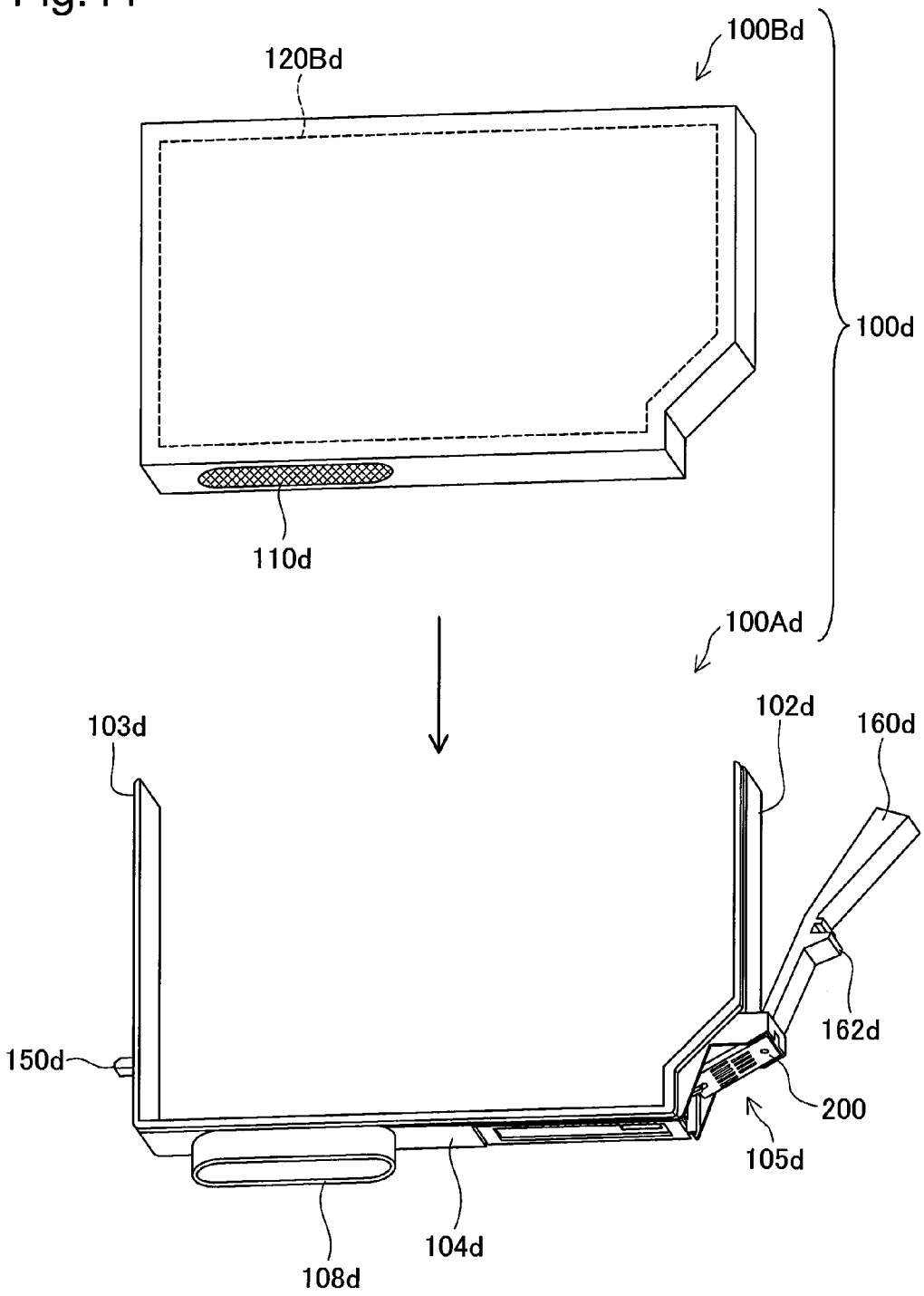
FIG. 44 is a perspective views showing a configuration of the ink cartridge according to another embodiment.

FIG. 44 is a set of perspective views showing a configuration of the cartridge according to still another embodiment. This cartridge 100*d* is also divided into an ink container 100Bd and an adapter 100Ad. The adaptor 100Ad includes a first side surface 102*d*, a bottom surface 104*d*, a second side surface 103*d* opposing the first side surface 102*d*, and a slanted board holder 105*d* installed near the bottom end of the first side surface 102*d*. The main difference from the cartridge shown in FIG. 43 is that the adaptor 100Ad of FIG. 44 has no member composing the two side surfaces (the largest surfaces) intersecting the first and second side surfaces 102*d* and 103*d* and the bottom surface 104*d*. A lever 160*d* is provided on the first side surface 102*d*, and an engaging projection 162*d* is formed at the lever 160*d*. another engaging projection 150*d* is provided at the second side surface 103*d*. The ink container 100Bd includes an ink chamber 120Bd to store ink and an ink supply outlet 110*d*. This cartridge 100*d* is usable in more or less the same way as the cartridges 100*c* and 100*d* of FIGS. 43 and 44 respectively.

Figure 45:
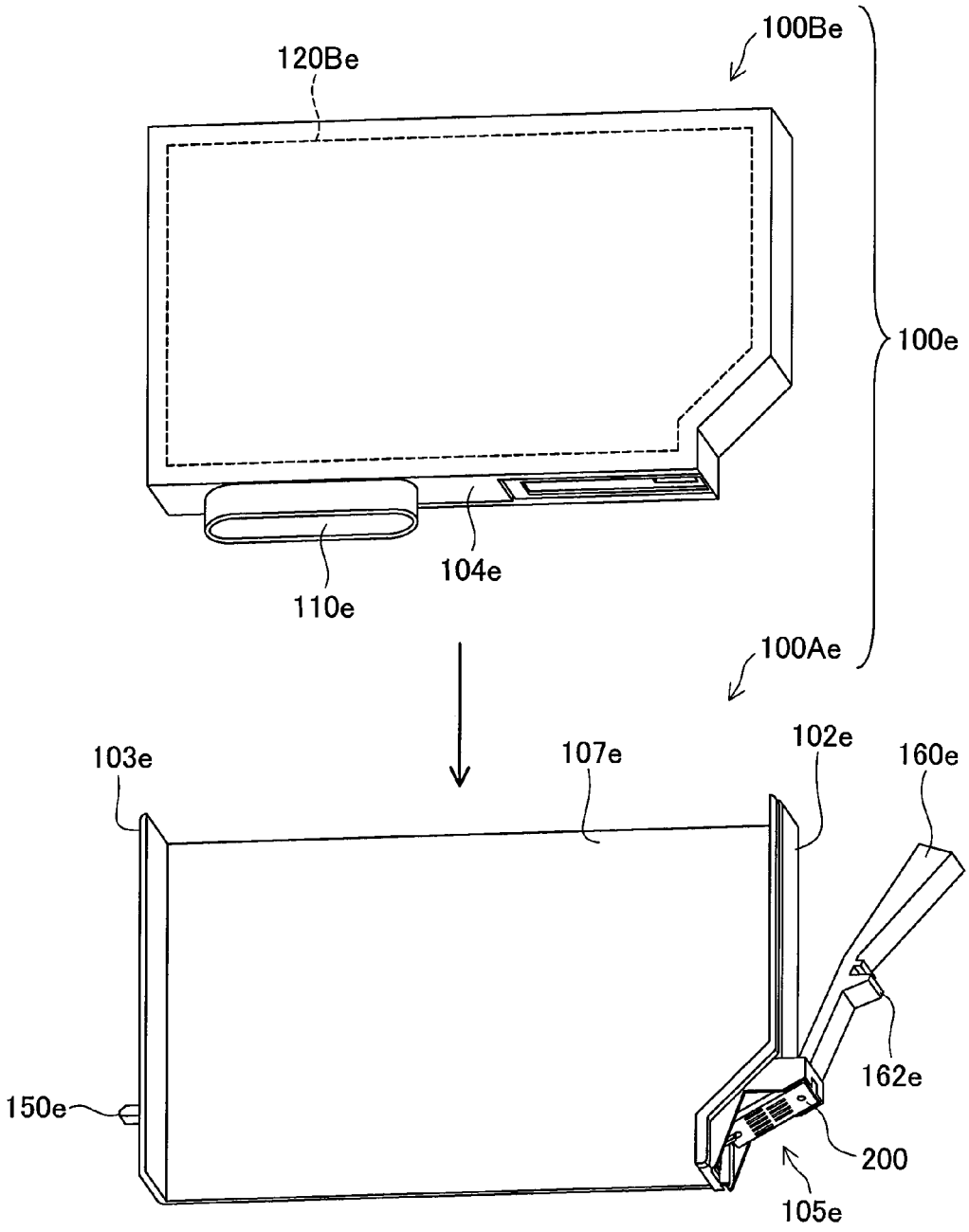
FIG. 45 is a perspective views showing a configuration of the ink cartridge according to another embodiment.

FIG. 45 is a perspective view showing a configuration of the cartridge according to still another embodiment. This cartridge 100*e* is also divided into an ink container 101Be and an adapter 100Ae. The adapter 100Ae includes a first side surface 102*e*, a second side surface 103*e* opposing the first side surface 102*e*, a third side surface 107*e* provided between the first and second side surfaces 102*e* and 103*e*, and a slanted board holder 105*d* installed near the bottom end of the first side surface 102*d*. The ink container 100Be includes an ink chamber 120Be to store ink and an ink supply outlet 110*e*. The bottom surface 104*e* of the ink container 100Be is in an approximately the same form as the bottom surface 104*a* of the cartridge 100*a* shown in FIG. 28. This cartridge 100*e* is usable in more or less the same way as the cartridges 100*c* and 100*d* of FIGS. 43 and 44.

As evident from the examples described in FIGS. 43-45, the cartridge may also be divided into an ink container (also called "ink material container") and an adapter. In this case, the circuit board is preferably attached to the adaptor. The cartridge configuration that is divided into an ink container and an adaptor may also be applied to the cartridge 100 shown in FIGS. 2A and 2B. An adaptor compatible with the cartridge 100*a* of FIG. 28 preferably comprise a first side surface 102*c* (or 102*d*, 102*e*) equipped with a lever with an engaging structure, a second side surface 103*c* (or 103*d*, 103*e*) opposing the first side surface, another surface provided between the first and second side surfaces (bottom surface 104*c*, 104*d* or a third side surface 107*e*), and a board holder 105*c* (or 105*d*, 105*e*) provided near the bottom end of the first side surface. Adapters compatible with cartridges that have a sensor for detecting a remaining ink amount may have the sensor provided either in the adapter or in the ink container. In this case, the sensor is connectable to terminals on the circuit board provided on the adapter.

The above variation examples of various embodiments have a common attribute in that the terminals on the board are placed two-dimensionally at the same height from the surface thereof, and the contacts between the terminals on the board and those on the apparatus side are sliding contacts wherein the contact portions cp move slidingly. Therefore, they have a common problem of being vulnerable to dirt or dust between the terminals on the board and those on the apparatus side. In light of this problem, it is preferable to use a voltage as high as possible for attachment detection in order to secure an enough margin against noise caused by dirt or dust.

F. Variation Examples

This invention is not limited to the above embodiments or other embodiments, but may be implemented to the extent not to deviate from its intentions in various aspects, including the following variations, for example.

Variation Example 1

The arrangement of the boards and contact portions in each of the above embodiments may be varied in many ways. For example, concerning the board according to the above embodiments, plural terminals and their contact portions are arranged in two rows parallel to each other along the line perpendicular to the attachment direction of the cartridge, but instead, they may be arranged in 3 or more rows.

Also, there may be any number of attachment detection terminals such as five or more. In addition, many variations other than the above are possible for the type and arrangement of plural terminals for the memory device. For example, the reset terminal may be omitted. However, plural contact portions for the memory device are preferably arranged in a cluster so that contact portions of other terminals (those for attachment detection) do not get in the way between those of memory device terminals.

Variation Example 2

In each of the above embodiments, the sensor 208 (FIG. 9) or the resistance element 204 (FIG. 21) is used in addition to the memory device 203, but plural electric devices installed on the cartridge are not limited to these, and one or more kinds of any electric devices may be installed on the cartridge. For example, as a sensor for detecting the amount of ink, an optical sensor instead of a sensor using piezo elements may be installed. Also, as an electric device that is applied with a high voltage higher than 3.3V, other devices other than the sensor 208 (FIG. 9) and resistance element 204 (FIG. 21) may be used. Moreover, in the third embodiment, the memory device 203 and resistance element 204 are both provided on the board 200, but electric devices for a cartridge may be placed on any other member. For example, the memory device 203 may be placed on a cartridge case, an adaptor, or a different structure other than a cartridge. The same holds true for the second embodiment.

Variation Example 3

In the third embodiment mentioned above, the four resistances 701-704 for attachment detection are formed by the resistance element 204 in the nth cartridge and the corresponding resistance elements 63*n* (n=1-4) in the cartridge detection circuit 502, but the value of each resistance for attachment detection may be achieved solely by one resistance element, or by three of more resistance elements. For example, the resistance 701 for attachment detection composed of two resistance elements 204 and 631 may be replaced by a single resistance element. The same applies to other resistances for attachment detection. In constructing a single resistance for attachment detection with plural resistance elements, distribution of resistance values for those resistance elements is randomly variable. Also, the single or plural resistance elements may be placed only on either the cartridge or on the main body or the cartridge attachment unit of the printing apparatus. If all the resistances for attachment detection are placed on the cartridge, for example, no resistance element composing the resistance for attachment detection is needed any more in the main body or the cartridge attachment unit of the printing apparatus.

Figure 46:
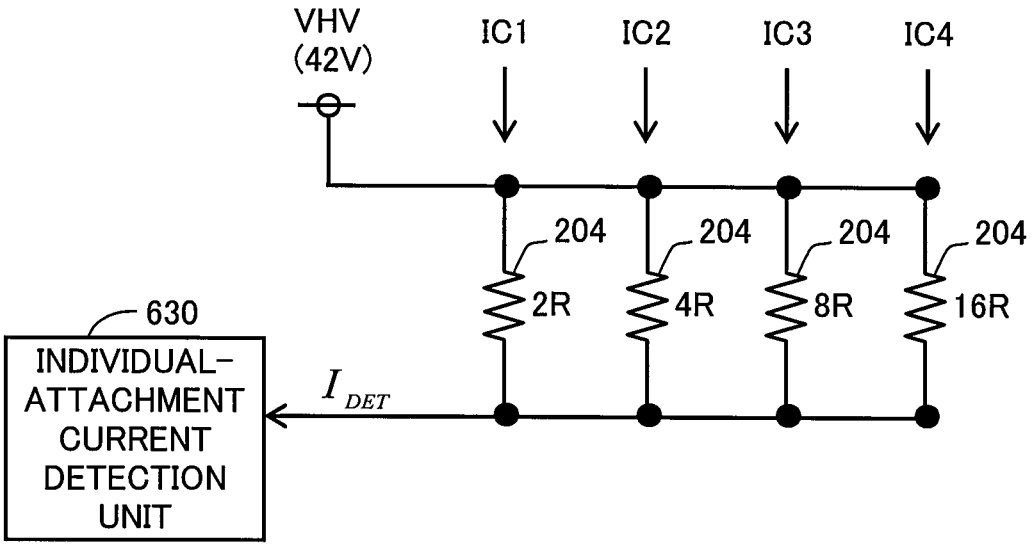
FIG. 46 shows a variation example of the circuit for the individual-attachment current detection unit.

FIG. 46 is a diagram showing a variation example of a circuit configuration of the individual attachment detection unit. This circuit is the one in FIG. 23 with the resistance elements 631-634 of the cartridge detection circuit 502 omitted, and the resistance value of the resistance element 204 is changed according to the cartridge type. In other words, the resistance value of the resistance element 204 in the nth (N=1-4) cartridge is set at $2^n$R (R is constant). The circuit of FIG. 46 may obtain such characteristics that the detection current $I_{DET}$ is uniquely determined according to the $2^N$ kinds of attachment conditions of N number of cartridges.

Variation Example 4

Among various components described in each of the above embodiments, those elements having nothing to do with any special purpose, function or effect may be dispensable. Also, among the various processes mentioned above, any part of any processes and elements related thereto may be omitted.

Variation Example 5

In each of the above embodiments, this invention is applied to ink cartridges, but it is also applicable to a printing material storage (container) for storing other printing materials such as toner.

This invention may be applied not only to inkjet printers and their cartridges but also to any liquid injection devices that inject liquid other than ink and their liquid containers. For example, it is applicable to the following liquid injection devices and their liquid containers:

(1) Image recording devices of facsimile machines etc.

(2) Color material injection materials used for manufacturing color filters for image display devices such as LCD's, (3) Electrode material injection devices used for forming electrodes of organic electro luminescence display and field emission display (FED) devices etc.

(4) Liquid injection devices that inject liquid containing biological organic materials used for manufacturing biochips.

(5) Specimen injection devices used as precision pipettes.

(6) Lubricant injection devices.

(7) Resin injection devices.

(8) Liquid injection devices that inject lubricant with pinpoint accuracy into precision instruments such as watches and cameras.

(9) Liquid injection devices that inject transparent resin such as ultraviolet curable resin on circuit boards in order to form micro hemispherical lenses (optical lenses) used for optical communication elements.

(10) Liquid injection devices that inject acidic or alkaline etching liquid to etch circuit boards.

(11) Liquid injection devices equipped with a liquid injection head for discharging a very small amount of droplets of any other liquid.

The word "droplet" refers to any liquid form discharged from a liquid injection device including granular, teardrop and filamentous forms. Also, the word "liquid" means any material that may be injected by a liquid injection device. For example, the "liquid" may be any material in liquid phase including liquid-like materials such as high or low viscosity fluid materials, sol, gel, other nonorganic solvents, organic solvents, solutions, liquid resin, and liquid metal (melted metal). In addition, the "liquid" includes not only liquid as one phase of a material but also materials wherein grains of functional materials made of solids such as pigments and metal particles are dissolved, dispersed or mixed in solvents. Typical examples are ink and liquid crystal described in the above embodiments. Here, "ink" refers to any material including liquid-like compositions such as regular water-soluble and oil-soluble ink, gel ink and hot melt ink.

Variation Example 5

Various appearances or outer shapes are applicable to the cartridges and adapters other than those described in the above embodiments and variations. For example, the invention is applicable to the cartridges and adapters that have an appearances or outer shape which is provided with terminals at positions suitable for getting in contact with a plurality of apparatus-side terminals.

What is claimed is:

1. A circuit board electrically connectable to a plurality of apparatus-side terminals of a cartridge attachment unit of a printing apparatus, comprising:

a plurality of first terminals through which a power source voltage and signals for operating a memory device are supplied from the printing apparatus; and a plurality of second terminals to be used for detecting connection conditions between the plurality of apparatus-side terminals and the circuit board, wherein the plurality of first terminals have a plurality of first contact portions that get in contact with corresponding apparatus-side terminals, the plurality of second terminals have a plurality of second contact portions that get in contact with corresponding apparatus-side terminals, the plurality of first and second contact portions are arranged so as to form a first row and a second row, and four contact portions among the plurality of second contact portions are placed at both ends of the first and second rows, respectively.

2. The circuit board according to claim 1, wherein
among the four contact portions of the plurality of second contact portions,
two contact portions placed at both ends of the first row are connected with each other and neither of them are connected to a fixed voltage, and
two contact portions placed at both ends of the second row are connectable to an electric device.

3. The circuit board according to claim 2, wherein
a contact portion of a ground terminal for the memory device is placed at the center of the second row.

4. The circuit board according to claim 1, wherein
during detection of connection conditions between the plurality of apparatus-side terminals and the circuit board,
a voltage which is no higher than a first power supply voltage supplied to a power terminal for the memory device is applied to the two contact portions at both ends of the first row, and
a voltage which is no higher than a second power supply voltage for driving a print head of the printing apparatus and higher than the first power supply voltage is applied to the two contact portions at both ends of the second row.

5. The circuit board according to claim 4, wherein
during detection of connection conditions between the plurality of apparatus-side terminals and the circuit board,
a first attachment inspection signal is inputted, as a first pulse signal, to one of the two contact portions at both ends of the first row, and a first attachment response signal is outputted from the other of the two contact portions in response to the first attachment inspection signal, and
a first voltage no more than the second power supply voltage and higher than the first power supply voltage is applied to one of the two contact portions at both ends of the second row, and a voltage lower than the first voltage and higher than the first power supply voltage is outputted from the other of the two contact portions at both ends of the row.

6. The circuit board according to claim 5, wherein
the two contact portions at both ends of the first row are also used for detecting an overvoltage applied to the two contact portions at both ends of the first row, and
a high level voltage of the first attachment inspection signal is set lower than the overvoltage.

7. The circuit board according to claim 1, wherein
two contact portions placed at both ends of the second row are connectable to an electric device, and
the electric device is a resistance element installed in the circuit board.

8. The circuit board according to claim 1, wherein
the plurality of first terminals include a ground terminal for supplying a ground voltage from the printing apparatus to the memory device, a power supply terminal for supplying power at a different voltage than the ground voltage from the printing apparatus to the memory device, a clock terminal for supplying clock signals from the printing apparatus to the memory device, a reset terminal for supplying reset signals from the printing apparatus to the memory device, and a data terminal for supplying data signals from the printing apparatus to the memory device, and
two of the first contact portions are placed in the first row, and three of the first contact portions are placed in the second row.

9. The circuit board according to claim 1, wherein
a distance between two contact portions which are placed at both ends among the first and second contact portions existing in the first row is longer than a distance between two contact portions which are placed at both ends among the first contact portions existing in the second row.

10. The circuit board according to claim 1, wherein
the circuit board is to be attached to a cartridge attachment unit of the printing apparatus that comprises a print head and the cartridge attachment unit.

11. The circuit board according to claim 1, further comprising the memory device.

* * * * *